US010610764B2

(12) United States Patent
Tyler

(10) Patent No.: US 10,610,764 B2
(45) Date of Patent: Apr. 7, 2020

(54) SKATEBOARD TRUCK ASSEMBLY AND WHEEL CONTROL STRUCTURES

(71) Applicant: Gerald Tyler, Santa Ana, CA (US)

(72) Inventor: Gerald Tyler, Santa Ana, CA (US)

( * ) Notice: Subject to any disclaimer, the term of this patent is extended or adjusted under 35 U.S.C. 154(b) by 0 days.

(21) Appl. No.: 16/281,813

(22) Filed: Feb. 21, 2019

(65) Prior Publication Data

US 2019/0255423 A1 Aug. 22, 2019

Related U.S. Application Data

(60) Provisional application No. 62/633,332, filed on Feb. 21, 2018.

(51) Int. Cl.
*B62M 1/00* (2010.01)
*A63C 17/01* (2006.01)

(52) U.S. Cl.
CPC ..... *A63C 17/012* (2013.01); *A63C 17/015* (2013.01)

(58) Field of Classification Search
CPC ..... A63C 17/012; A63C 17/015; A63C 17/00; A63C 17/01; A63C 17/0093
See application file for complete search history.

(56) References Cited

U.S. PATENT DOCUMENTS 4,109,925 A * 8/1978 Williams ..... A63C 17/01 280/11.28
4,159,830 A * 7/1979 Solimine ..... A63C 17/012 280/11.28
4,398,735 A * 8/1983 Evans ..... A63C 17/01 280/11.28
4,645,223 A 2/1987 Grossman
5,263,725 A 11/1993 Gesmer et al.
6,318,739 B1 * 11/2001 Fehn, Jr. ..... A63C 17/0046 280/11.223
6,474,666 B1 * 11/2002 Andersen ..... A63C 17/0093 280/11.28
6,979,007 B1 * 12/2005 Hosoda ..... A63C 17/01 280/87.041
7,080,845 B2 * 7/2006 Inchley ..... A63C 17/0093 280/87.042
7,150,460 B2 * 12/2006 Williams ..... A63C 17/0093 280/87.042

(Continued)

FOREIGN PATENT DOCUMENTS

DE 100 53 501 A1 5/2002
WO WO 2014/133485 9/2014
WO WO 2017/186656 11/2017

OTHER PUBLICATIONS

"Double Pivot Trucks." https://wackyboards.blogspot.com/2009/09/double-pivot.html, accessed Feb. 2019, please consider published before Feb. 21, 2018.

(Continued)

*Primary Examiner* — James M Dolak
(74) *Attorney, Agent, or Firm* — Knobbe Martens Olson & Bear LLP

(57) ABSTRACT

A skateboard or longboard truck having configured to couple with a deck of the skateboard or longboard. The truck including a base and a hanger. The hanger disposed within a hanger aperture of the base. The hanger rotatably coupled with the base by a pivot assembly. The rotation of the hanger with respect to the base controlled by a compression assembly.

28 Claims, 63 Drawing Sheets

(56) References Cited

U.S. PATENT DOCUMENTS

| | | | | |
|---|---|---|---|---|
| 7,219,907 | B2 * | 5/2007 | Chang | A63C 17/0093 280/11.225 |
| 7,243,925 | B2 * | 7/2007 | Lukoszek | A63C 17/0093 280/11.28 |
| 7,635,136 | B2 * | 12/2009 | Cole | A63C 17/12 180/165 |
| 7,744,100 | B2 * | 6/2010 | Cole | A63C 17/12 280/11.115 |
| 8,186,694 | B2 | 5/2012 | Nelson et al. | |
| 8,251,384 | B1 * | 8/2012 | Christensen | A63C 17/015 280/11.115 |
| 8,424,882 | B2 | 4/2013 | Visinski et al. | |
| 8,448,954 | B2 | 5/2013 | Wilson | |
| 8,783,699 | B2 * | 7/2014 | Gesmer | A63C 17/012 280/87.042 |
| 8,888,108 | B1 | 11/2014 | Beaty et al. | |
| 9,010,777 | B2 * | 4/2015 | Braden | A63C 17/012 280/11.28 |
| 9,144,730 | B1 | 9/2015 | Visinski et al. | |
| 9,145,030 | B2 * | 9/2015 | Williams | B60B 35/025 |
| 9,199,158 | B2 | 12/2015 | Docter et al. | |
| 9,289,676 | B2 * | 3/2016 | Docter | A63C 17/0093 |
| 9,295,902 | B2 | 3/2016 | Lininger, Jr. | |
| 9,821,215 | B2 * | 11/2017 | Ivazes | A63C 17/0046 |
| 9,950,244 | B1 * | 4/2018 | Sargis | A63C 17/12 |
| 10,376,773 | B2 * | 8/2019 | Chung | A63C 17/01 |
| 10,391,384 | B2 * | 8/2019 | Powell | A63C 17/015 |
| 10,398,961 | B2 * | 9/2019 | McGowan | A63C 17/0093 |
| 2005/0167938 | A1 | 8/2005 | Chung et al. | |
| 2006/0119062 | A1 | 6/2006 | Lukoszek | |
| 2008/0252026 | A1 * | 10/2008 | Kang | A63C 17/0093 280/11.27 |
| 2011/0089659 | A1 | 4/2011 | Hunt | |
| 2015/0061252 | A1 | 3/2015 | Lininger, Jr. | |

OTHER PUBLICATIONS

International Search Report and Written Opinion in International application No. PCT/US2019/018687 dated Jun. 19, 2019, 14 pages.

* cited by examiner

330

SKATEBOARD TRUCK ASSEMBLY AND WHEEL CONTROL STRUCTURES

BACKGROUND

Field

The inventions described herein generally relate to wheel support structures, for example, skateboard and longboard trucks.

Related Art

Standard board designs (e.g., skateboard, longboard, or other) generally include a deck with two wheeled trucks bolted to the deck (e.g., front and rear). To steer the longboard, the user stands on the deck and leans left or right to actuate the two-wheeled trucks into a turn. A straight path can generally be maintained by keeping the deck level with the ground. Existing trucks include kingpin trucks, but these have various drawbacks. Accordingly there is a need for improved trucks.

SUMMARY

A first truck for coupling with an underside of a deck includes a base and a hanger for coupling with one or more wheels. The base includes a mounting flange and a hanger aperture. The base can optionally include first and second shaft apertures aligned along a pivot axis. First and second bushing apertures are aligned along a compression axis. The hanger includes a center portion with first and second wings extending from the center portion. First and second shaft seats are on opposite sides of the center portion. First and second wheel axles extend from the first and second wing portions, respectively. The first and second wheel axles support first and second wheels. The first and second wheel axles align along a wheel axis. First and second bushing seats are on opposite sides of the center portion of the hanger.

A roll aperture extends through first and second bottom surfaces of the first and second bushing seats. The central portion of the hanger is located within the hanger aperture of the base. First and second shafts pivotably couple the hanger with the base. The first shaft extends through the first shaft aperture of the base and into the first shaft seat of the hanger. The second shaft extends through the second shaft aperture of the base and into the second shaft seat of the hanger. The first and second shafts align with the pivot axis of the base and the hanger rotates about the first and second shafts. The first and second shaft seats include first and second bearings, respectively.

First and second bushings provide roll stiffness to the rotation of the hanger. Both of the first and second bushings have an inner aperture. The first bushing sits in the first bushing seat of the hanger and the second bushing sits in the second bushing seat of the hanger. A first force transfer bushing slideably engages within the first bushing aperture of the base. A second force transfer bushing slideably engages within the second bushing aperture of the base. A compression bolt adjusts the roll stiffness of the hanger. The compression bolt aligns along the compression axis of the base and extends through the first and second bushing apertures of the base, the first and second force transfer bushings, the inner apertures of the first and second bushings, the roll aperture of the hanger, and a nut. The compression bolt applies compression force to the hanger through the first and second bushings by rotation relative to the nut.

A second truck with a base is configured to couple with a deck and includes a hanger aperture and a hanger disposed within the hanger aperture of the base and pivotable about a pivot axis. A compression bolt disposed through the hanger along a compression axis, the compression axis transverse to the pivot axis. First and second ends of the hanger are fully constrained against translation perpendicular to the pivot axis and first and second ends of the compression bolt are slidingly engaged with the base through the first and second force transfer bushings.

According to another aspect of the disclosure, the base has first and second shaft apertures aligned along the pivot axis.

According to another aspect of the disclosure, the base has first and second bushing apertures aligned along the compression axis.

According to another aspect of the disclosure, the base includes a pivot angle of the pivot axis defined between a mounting flange of the base and the pivot axis.

According to another aspect of the disclosure, the hanger has a center portion with first and second wings extending from the center portion. First and second shaft seats are disposed on opposite ends of the center portion. First and second wheel axles extend from the first and second wing portions, respectively, and support first and second wheels. The first and second wheel axles are aligned in a wheel axis. First and second bushing seats are on opposite sides of the center portion. A roll aperture is disposed through first and second bottom surfaces of the first and second bushing seats.

According to another aspect of the disclosure, the second truck includes first and second shafts for pivotably coupling the hanger with the base. The first shaft is disposed through the first shaft aperture of the base and into the first shaft seat of the hanger. The second shaft is disposed through the second shaft aperture of the base and into the second shaft seat of the hanger. The first and second shafts aligned with the pivot axis of the base and the hanger rotatable about the first and second shafts.

According to another aspect of the disclosure, the second truck includes first and second bushings for providing roll stiffness to the rotation of the hanger. Each of the first and second bushings has an inner aperture. The first bushing is in the first bushing seat of the hanger and the second bushing disposed in the second bushing seat of the hanger.

According to another aspect of the disclosure, the second truck includes a first force transfer bushing slideably disposed within the first bushing aperture of the base and a second force transfer bushing slideably disposed within the second bushing aperture of the base.

According to another aspect of the disclosure, the second truck includes the compression bolt for adjusting the roll stiffness of the hanger. The compression bolt is aligned along the compression axis of the base and disposed through the first and second bushing apertures of the base, the first and second force transfer bushings, the inner apertures of the first and second bushings, the roll aperture of the hanger, and a nut. The compression bolt is configured to apply a compression force to the hanger through the first and second bushings by rotation relative to the nut.

According to another aspect of the disclosure, the second truck includes first and second bearings. The first and second bearings are disposed in the first and second shaft seats, respectively. The first and second shafts engaged within the respective first and second bearings.

In another aspect of the disclosure, the second truck has first and second bearings. The first bearing sits within the first shaft seat and slideably engages with a cylindrical surface of the first shaft. The second bearing sits within the second shaft seat and slideably engages with a cylindrical surface of the second shaft.

In another aspect of the disclosure, the first bearing includes a first flange. A first side of the first flange is flush with a surface around the first shaft seat on the central portion of the hanger. A second side of the first flange is flush with a surface around the first shaft aperture of the base.

In another aspect of the disclosure, the compression bolt is made of steel. The compression bolt has an outside diameter of approximately 0.25 inches. The first and second bushings are made of urethane. The inner apertures thereof have a diameter of approximately 0.375 inches.

In another aspect of the disclosure, increasing compression on the hanger by rotation of the compression bolt relative to the nut deforms the first and second bushings to at least partially fill a space disposed between a surface of the inner aperture of the first bushing and an outer surface of the compression bolt.

In another aspect of the disclosure, a roll bar sits on the compression bolt between the first and second urethane bushings. A first sleeve of the roll bar extends at least partially into the inner aperture of the first bushing and a second sleeve of the roll bar extending at least partially into the inner aperture of the second bushing.

In another aspect of the disclosure, an outer shape of the first force transfer bushing is noncircular and an inner shape of the first bushing aperture corresponds the shape of the first force transfer bushing. The first force transfer bushing translates within the first bushing aperture but is substantially prevented from rotating by an inner side of the first bushing aperture.

In another aspect of the disclosure, the base includes an outer arc. The first bushing aperture is disposed on the outer arc.

In another aspect of the disclosure, the pivot angle is between 0 and 60 degrees.

In another aspect of the disclosure, the nut is mechanically coupled with the first force transfer bushing.

In another aspect of the disclosure, the wheel axis is offset from the pivot axis in a rake direction.

In another aspect of the disclosure, the hanger includes limiters that engage with the base when the hanger rotates into contact with the base.

In another aspect of the disclosure, the limiters are received within recesses on the opposite ends of the center portion of the hanger and contact an inner surface of the base to limit rotation of the hanger.

In another aspect of the disclosure, the first shaft includes a head with outer threads and an inner key, the threads engaged with corresponding threads within the first shaft aperture of the base.

In another aspect of the disclosure, the first bottom surface of the first bushing seat includes a conical or tapered surface.

In another aspect of the disclosure, the first shaft seat of the hanger is a floating seat assembly.

In another aspect of the disclosure, an angled section of the first and second wings is aligned parallel to the mounting flange.

In another aspect of the disclosure, the first and second wings include a double layer wing structure.

In another aspect of the disclosure, the first and second wings include a suspension system with a four-bar suspension mechanism.

A fourth truck for coupling with a deck includes an internal structure pivotably coupled with an external structure by a pivot assembly. The internal structure extends within an aperture of the external structure. A compression assembly couples between the internal structure and the external structure. The compression assembly has an elongate member aligned along a compression axis and disposed through a roll aperture of the internal structure. Opposite ends of the elongate member couple within the external assembly. First and second elastic members are disposed on opposite sides of the internal structure and within the aperture of the external structure. The first and second elastic members limit rotation of the internal structure relative to the external structure.

In another aspect of the disclosure, the internal structure is a hanger and the external structure is a base.

In another aspect of the disclosure, the internal structure is a base and the external structure is a hanger.

In another aspect of the disclosure, the hanger includes a protruding grinding surface.

In another aspect of the disclosure, the pivot assembly has first and second pivot shafts aligned along a pivot axis. The first and second shafts are disposed on opposite sides of the aperture of the external structure.

In another aspect of the disclosure, each of the opposite ends of the elongate member is slidingly engaged with the external structure through a force transfer bushing.

A fourth truck includes a base coupled with a deck. A hanger pivotably couples with the base. The hanger is pivotable about an axis. A compression bolt extends through the hanger transverse to the axis. First and second ends of the hanger are fully constrained against translation perpendicular to the axis and first and second ends of the compression bolt are slidingly engaged with the base.

In another aspect of the disclosure, a hanger has an elongated axis extending laterally between two wheels along their axis of rotation. The hanger has a central portion that accepts bilateral constraints in first and second dimensions, each dimension orthogonal to the hanger's elongated axis.

An external support structure is generally externally surrounding the central portion of the hanger and allows the hanger to laterally protrude therefrom and extend therethrough. The external support structure supports and constrains at least two axis-specific constraining structures. One structure corresponds to the first dimension and the other corresponds to the second dimension.

The structures interact as follows when the truck is assembled: the first axis-specific support structure exerts force on opposite sides of the hanger through two resilient contact structures and the second axis-specific support structure exerts force on opposite sides of the hanger through two pivot structures.

In another aspect of the disclosure, the two resilient structures are first and second bushings.

In another aspect of the disclosure, the first axis-specific support structure is supported in turn by extending through two opposite openings in the external support structure.

In another aspect of the disclosure, the first axis-specific support structure includes a compression bolt with a nut.

In another aspect of the disclosure, the two pivot structures are first and second shafts.

In another aspect of the disclosure, the second axis-specific support structure is supported in turn by extending through two opposite openings in the external support structure.

A fifth truck includes a base for coupling with a deck. The truck includes a hanger pivotably coupled with the base. The hanger is pivotable about a pivot axis. A compression bolt is disposed through the hanger along a compression axis transverse to the pivot axis. First and second ends of the hanger are fully constrained against translation perpendicular to the pivot axis and first and second ends of the compression bolt are engaged with the base. A compression force along the compression axis restricts rotation of the hanger.

A sixth truck includes a base configured to couple with a deck and a hanger pivotably coupled with the base. The hanger is pivotable about a pivot axis. A compression bolt is disposed through the base along a compression axis transverse to the pivot axis. First and second ends of the hanger are fully constrained against translation perpendicular to the pivot axis and first and second ends of the compression bolt are engaged with the hanger. A compression force along the compression axis restricts rotation of the hanger.

In another aspect of the truck, the hanger has a base aperture. In another aspect of the truck, a wheel axis of the hanger is offset from the pivot axis in a rake direction. In another aspect of the truck, the hanger has a grinding surface extending below the base when the truck is coupled with the deck. In another aspect of the truck, first and second force transfer bushings are engaged within the hanger.

A seventh truck has a base configured to couple with a deck and a hanger pivotably coupled with the base and pivotable about a pivot axis. The base has first and second shaft apertures aligned along the pivot axis and first and second bushing apertures aligned along a compression axis. The hanger has a center portion with first and second wings extending from the center portion. First and second shaft seats are on opposite ends of the center portion. First and second wheel axles extend from the first and second wing portions, respectively, and are configured to support first and second wheels. The first and second wheel axles are aligned in a wheel axis. First and second bushing seats are on opposite sides of the center portion.

In another aspect of the truck, the first shaft seat of the hanger is a floating seat.

The foregoing summary is illustrative only and is not intended to be limiting. Other aspects, features, and advantages of the devices and/or other subject matter described in this application will become apparent in the teachings set forth below. The summary is provided to introduce a selection of some of the concepts of this disclosure. The summary is not intended to identify key or essential features of any subject matter described herein.

DETAILED DESCRIPTION

The various features and advantages of the systems and devices of the technology described herein will become more fully apparent from the following description of the embodiments illustrated in the figures. These embodiments are intended to illustrate the principles of this disclosure, and this disclosure should not be limited to merely the illustrated examples. The features of the illustrated embodiments can be modified, combined, removed, and/or substituted as will be apparent to those of ordinary skill in the art upon consideration of the principles disclosed herein.

Conventional board trucks are generally of the kingpin type (including the reverse kingpin and the standard kingpin). Kingpin-type trucks include a base and a hanger that rotates relative to the base at an angle. The hanger is coupled to the base at one end with a pivot cup. Another end of the hanger couples with a kingpin extending from the base. The coupling of the hanger with the kingpin is generally done through one or more bushings. Commonly, the bushings are made of a flexible material, such as urethane, making the connection between the hanger and the kingpin relatively unconstrained (e.g., the hanger can move radially, axially, and rotate with respect to the kingpin).

The effect of the kingpin/bushing support for the hanger allows for a great degree of "play" in the position of the hanger with respect to the base, including during its rotation. One sign of play is that the deck can be leaned with respect to the trucks without either or both of the trucks turning (e.g., without rotation of the hanger) and/or the trucks can turn without leaning the board. In certain applications, play (or excessive play) and/or the wobble created thereby is considered undesirable because it can be difficult for a user to control the board under various circumstances (e.g., riding downhill, encountering bumps, wobble at high speeds, etc.).

In the kingpin-type trucks, the weight of a user of the board is transferred from the deck and rests in part on the bushings. Thus, the weight of the user and the properties of the truck and bushings have an influence on the performance of the truck during use.

Accordingly there is a need for improved truck designs, certain aspects of which may address the problems with the existing truck designs. For example, one goal of certain embodiments described herein is to provide steering precision (e.g., kinematic control over rotation) and/or precision rotation between the hanger and the base. Another goal of certain embodiments is to separate suspension mechanisms from steering mechanisms. Another goal of certain embodiments is to eliminate the kingpin structure. Another goal of certain embodiments is to provide a truck structure that can include limiters to eliminate wheel bite.

Figure 1:
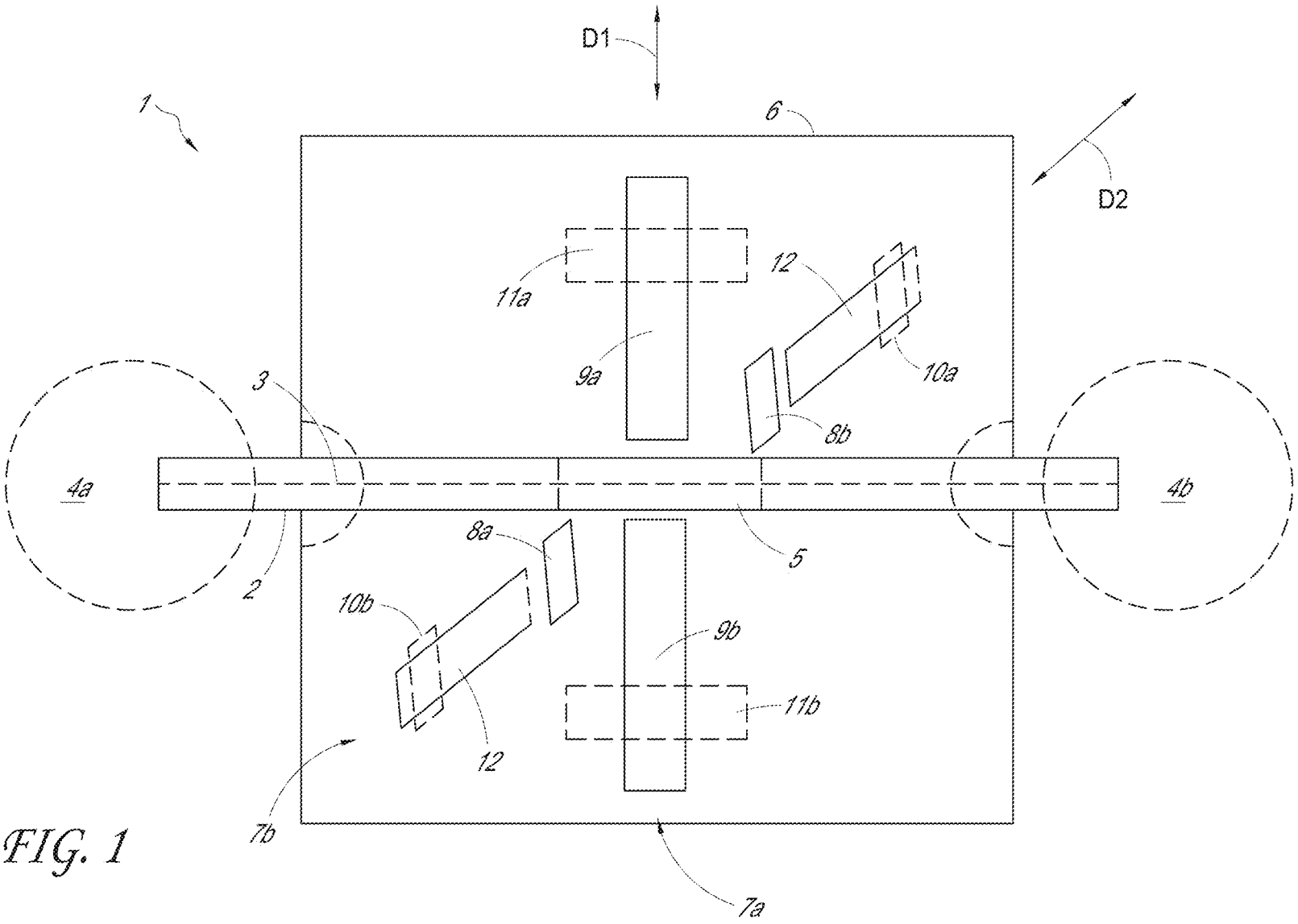
FIG. 1 is a schematic overview of a truck.

FIG. 1 illustrates a schematic view of a truck 1. This schematic illustration is not limited to any particular structure, but the other figures provided herein generally correspond and provide examples of the features described and represented here. The truck 1 includes a hanger 2 having an elongated axis 3. The elongated axis 3 extends laterally between two wheels 4*a*, 4*b* along their axis of rotation. The hanger has a central portion 5 that accepts bilateral constraints in first and second dimensions D1, D2. An external support structure 6 generally externally surrounds the central portion 5 of the hanger 2. The external support structure 6 generally allows the hanger 2 to laterally protrude from and extend through the external support structure 6.

The external support structure 6 constrains at least two axis-specific constraining structures 7*a*, 7*b*. The first axis-specific constraining structure 7*a* corresponds to (e.g., is aligned with) the first dimension D1 and the second axis-specific constraining structure 7*b* corresponds to the second dimension D2. The first dimensions D1 is orthogonal with the elongated axis 3. The second dimension D2 can be at any angle with respect to the elongated axis 3 (e.g., the second dimension D2 can be directly into and out of the page in FIG. 1 or parallel with elongate axis 3), with the exception of being equivalent (parallel) to first dimension D1.

As depicted here, the first axis-specific support structure 7*a* can exert force on opposite sides of the hanger 2 through two pivot structures, 9*a*, 9*b*. The two pivot structures 9*a*, 9*b* can be first and second shafts. The first axis-specific support structure 7*a* can be supported by and/or extend through two opposite openings 11*a*, 11*b* in the external support structure 6, the two opposite openings 11*a*, 11*b* on opposite sides of the hanger 2. The first axis-specific constraining structure 7*a* constrains translation of the hanger 2 (e.g., in directions orthogonal to the first dimension D1) and allows rotation of the hanger 2 about respective first axis-specific constraining structures 7*a* (e.g., rotation about an axis along the first dimension D1).

When assembled together, the second axis-specific support structure 7*b* exerts force on (e.g., on opposite sides of) the hanger 2 (e.g., on a flange of hanger 2), which it can do through two resilient contact structures 8*a*, 8*b*. The two resilient structures 8*a*, 8*b* can be first and second bushings. The second axis-specific support structure 7*b* can extend through (and/or be supported by) two opposite openings 10*a*, 10*b* in the external support structures 6, the two opposite openings 10*a*, 10*b* on opposite sides of the hanger 2. The second axis-specific support structure 7*b* can include a compression bolt 12 (which can be secured, for example, with a nut or other tapped structure).

Figure 2A:
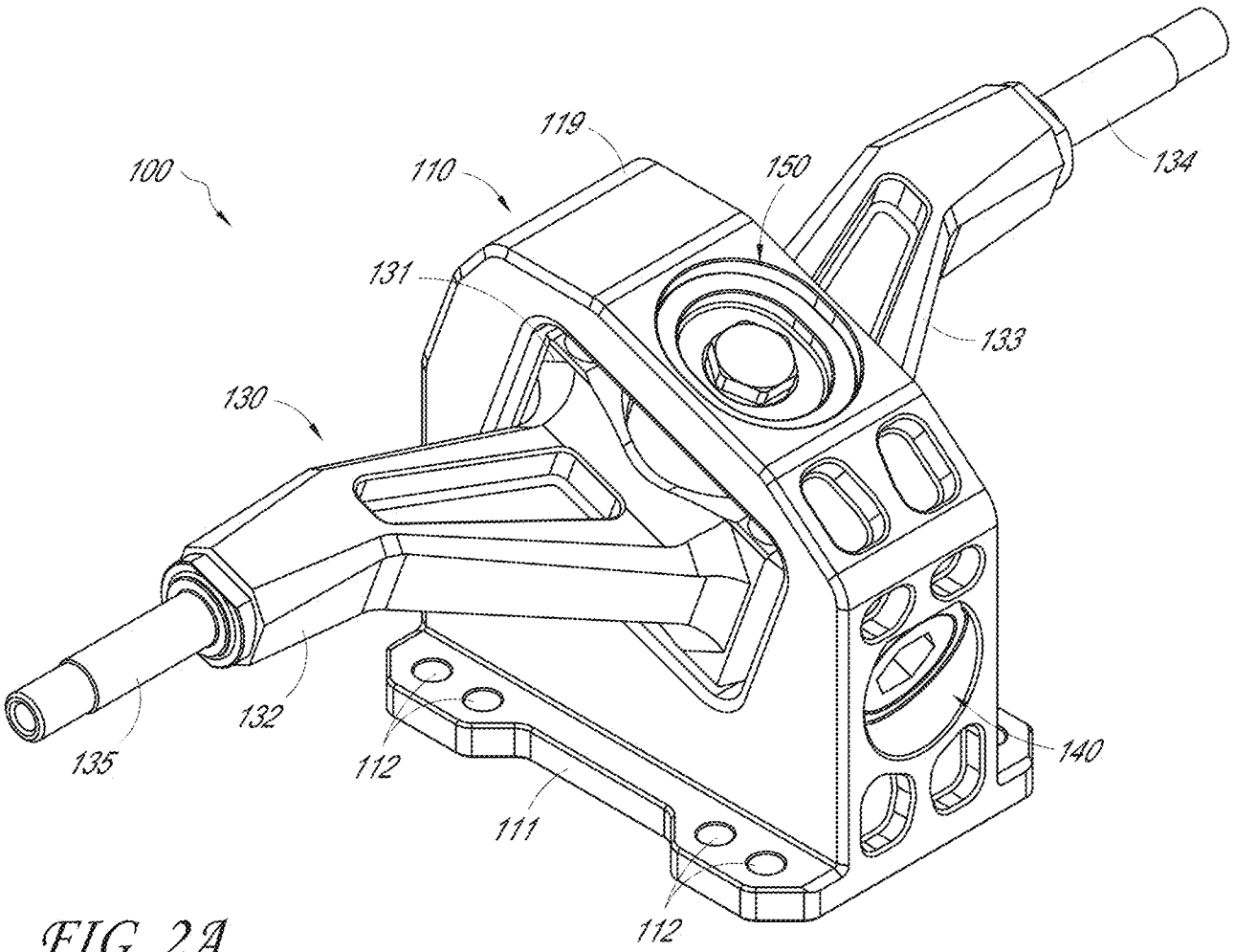
FIG. 2A is a front perspective view of a first embodiment of a truck.
Figure 2B:
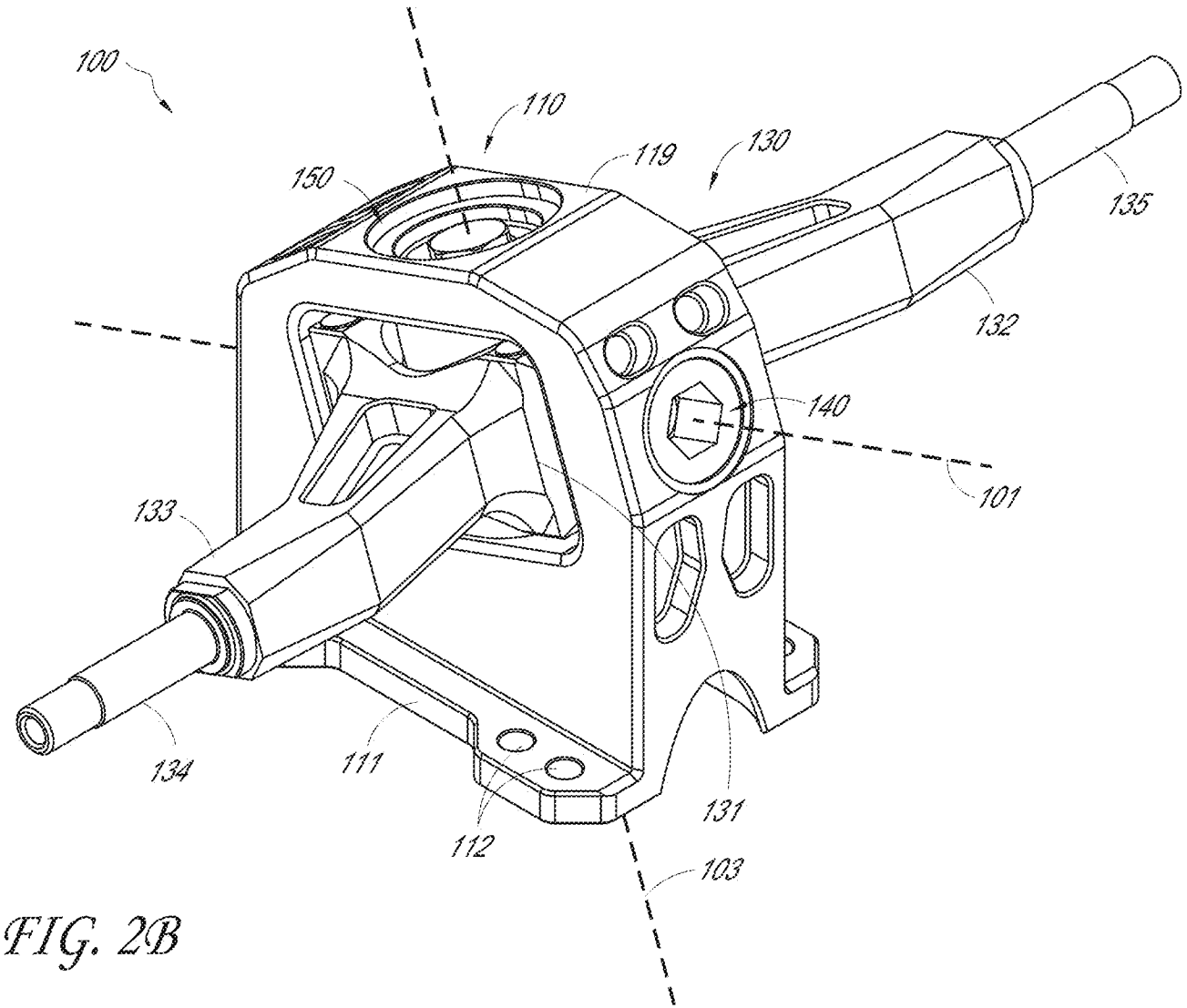
FIG. 2B is a rear perspective view of the truck of FIG. 2A.
Figure 2C:
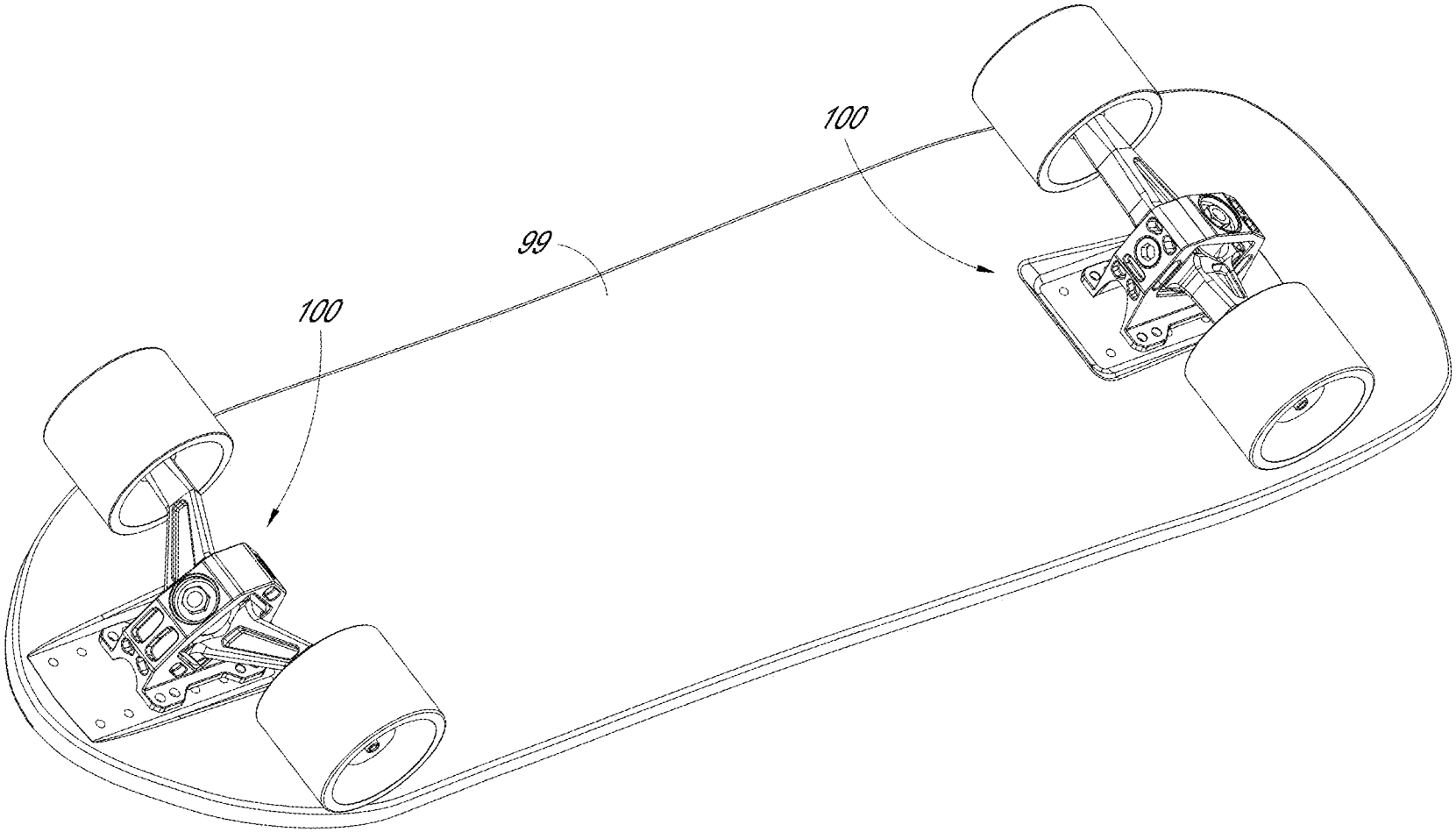
FIG. 2C is bottom perspective view of the truck of FIG. 2A mounted on a deck.
Figure 3:
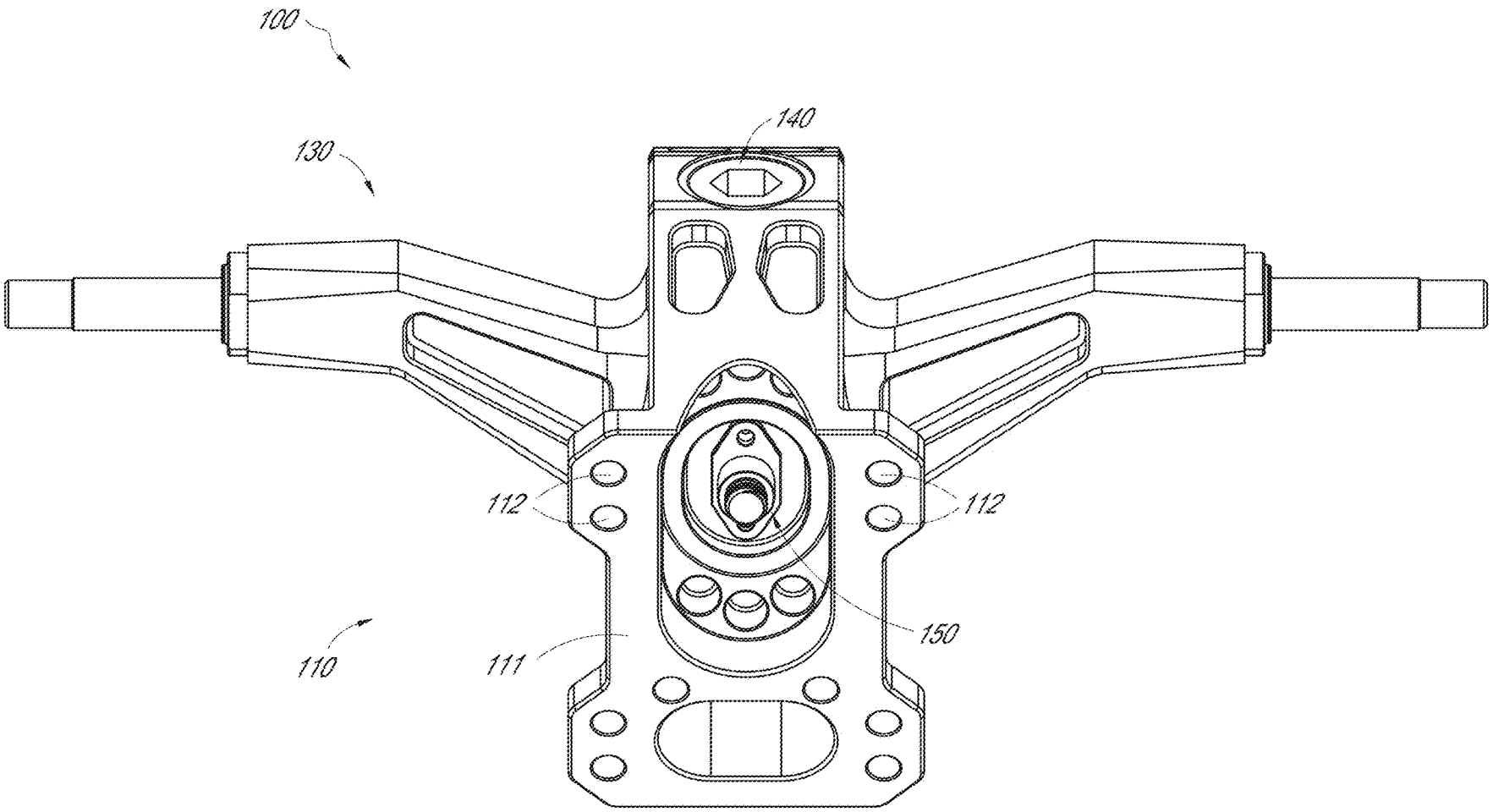
FIG. 3 is a top perspective view of the truck of FIG. 2A.

FIG. 2A illustrates an assembly with a truck 100. The truck 100 can include a base 110 and a hanger 130. The base 110 can couple with a deck 99 (as shown in FIG. 2C) of a skateboard, longboard or other type of wheeled vehicle ("board"), which would be positioned generally below the truck 100 in the orientation shown in FIG. 2A. The base 110 can include a mounting flange 111 for coupling with the deck. The flange 111 can include a plurality of attachment locations 112 for attachment with the deck. The attachment locations can comprise holes through the material of the flange 111. Other mechanical attachment mechanisms are also compatible with the base 110. The pattern of the mounting locations 112 can correspond to standard dimensional layouts for mounting trucks to decks of boards. The flange 111 can include a generally planar bottom portion that includes the mounting locations 112.

The base 110 can include a transverse portion 119. The base 110 and transverse portion 119 can form a robust structure that extends out from a deck and provides strength, support, and rigidity to the hanger 130. The base 110 can thereby improve wheel control, adjustment, and ultimately rotation and steering for the skateboard. The base 110 and transverse portion 119 can orient, support, and couple with the hanger 130, as described further herein. The base 110 can be pivotally coupled with the hanger 130 by a pivot assembly 140. The pivot assembly 140 can allow rotation of the hanger 130 about a pivot axis 101 (see FIG. 2B). By pivoting about the pivot assembly 140, the hanger 130 can move with respect to the base 110. In at least some implementations, movements of the hanger 130 are specifically constrained with respect to the base 110, such that rotation of the hanger 130 is allowed in a single axis and the wheels move in an arc about the pivot axis 101. This restriction of movement can be accomplished by constraining the hanger 130 radially (the pivot assembly 140 uses two fixed ends to eliminate wobble about the pivot axis 101) and also axially (the hanger 130 generally does not translate along the pivot axis 101). In some implementations, the axial constraint comes from the hanger 130 (or a bushing or bearing of the pivot assembly 140, as described below) pressing against one or more inner surfaces of base 110.

Figure 4:
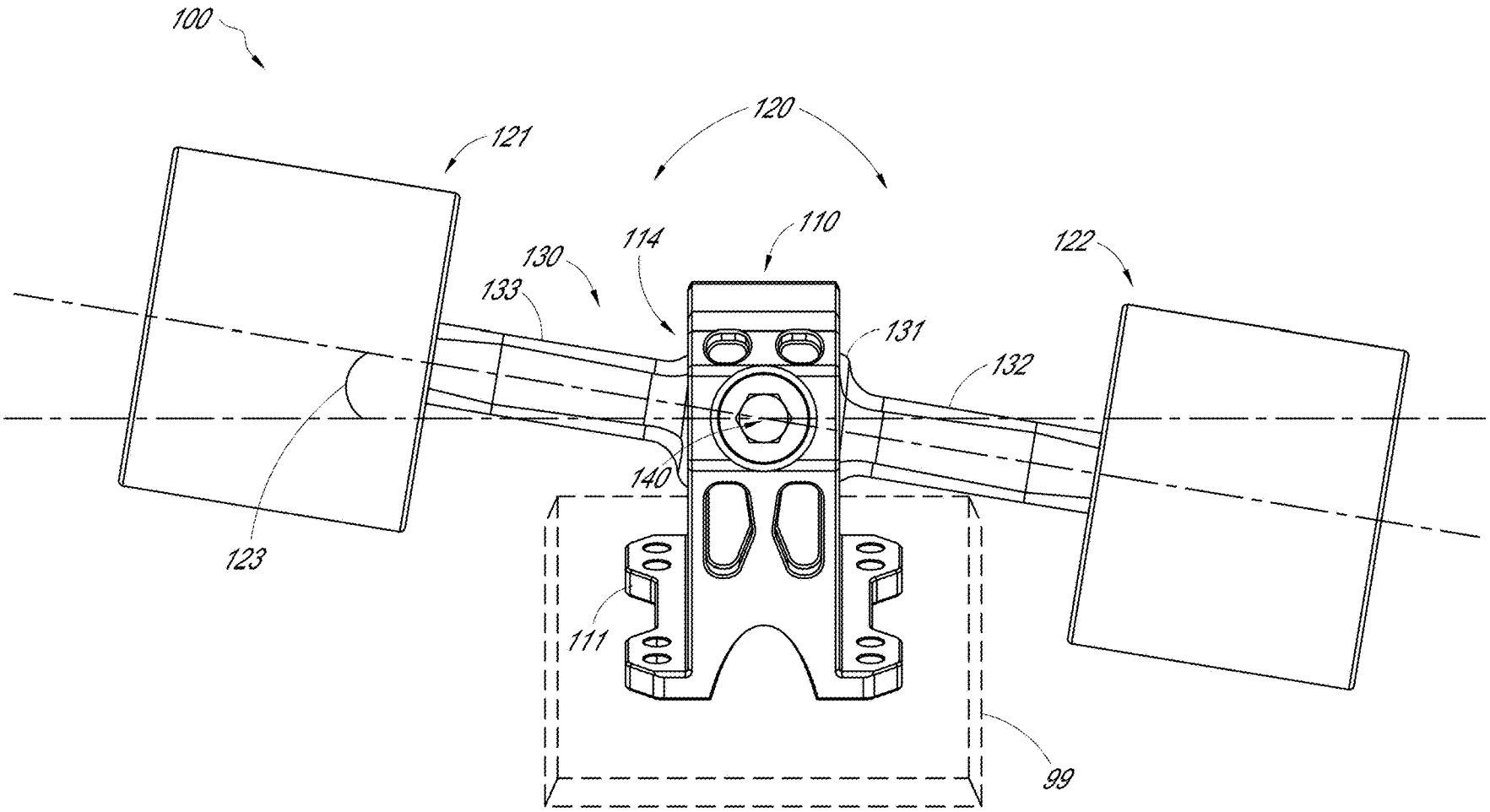
FIG. 4 is a rear view of the truck of FIG. 2A showing a wheel assembly in a first configuration.
Figure 5:
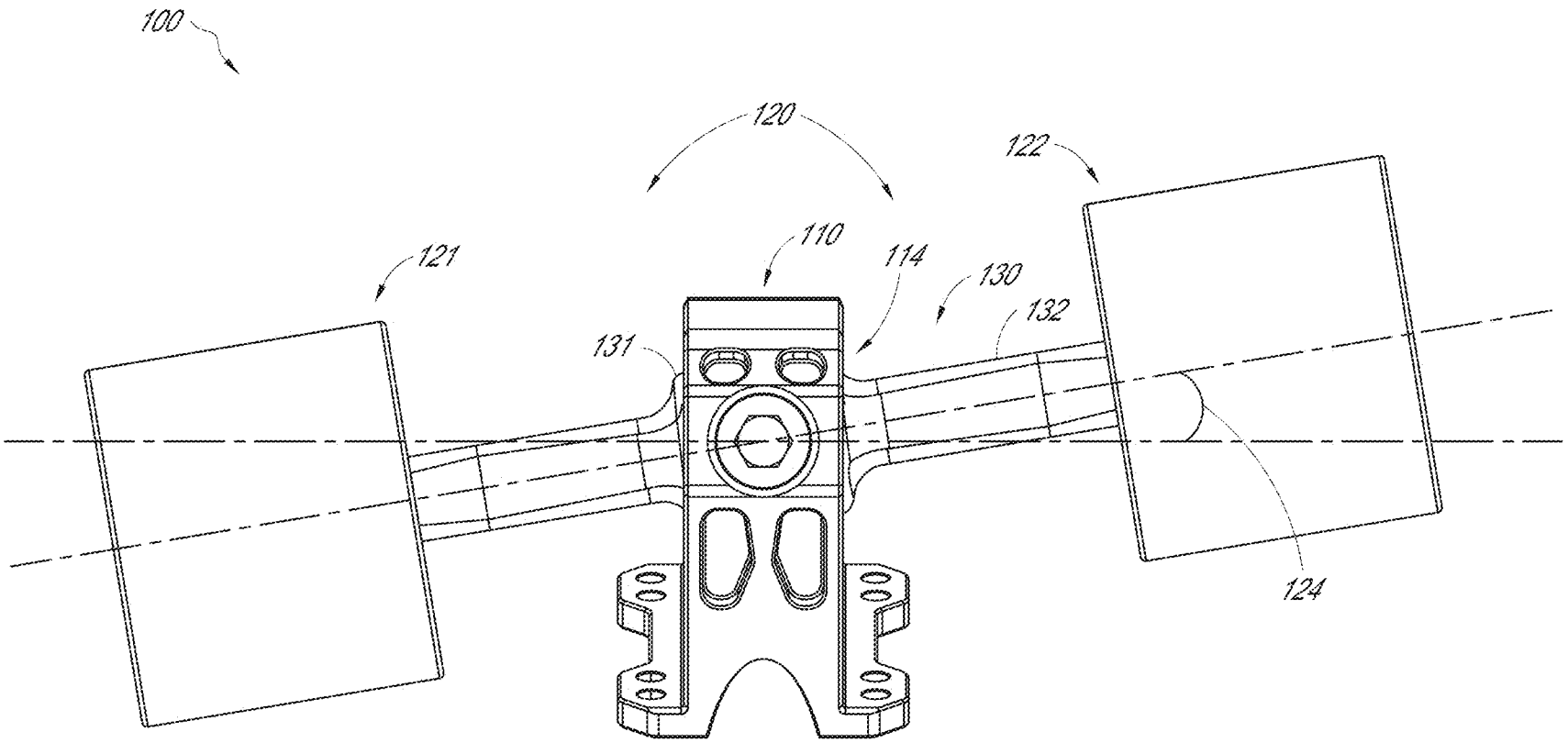
FIG. 5 is a rear view of the truck of FIG. 4 in a second configuration.

The hanger 130 can include a left wing 132 and a right wing 133 coupled together by a central portion 131. A left axle 135 can be coupled with an end of the left wing 132. The left axle 135 can be coupled with a wheel 122 of a wheel assembly 120, as shown in FIGS. 4-5. The right wing 133 can include a right axle 134 coupled with a wheel 121 of the wheel assembly 120. The wheel assembly 120 coupled with the hanger 130 can include conventional board components, such as commercially available wheels, bearings, nuts, etc.

The hanger 130 rotates with respect to the base 110 about the pivot axis 101 supported by the pivot assembly 140. As illustrated in a rear view of FIG. 4, rotation in a clockwise direction results in an angle 123 between the base 110 and the hanger 130. Similarly, as illustrated in FIG. 5, rotation in a counterclockwise direction results in an angle 124 between a line through the base 110 that is parallel to the deck and the hanger 130. Generally angles 123 and 124 are equivalent and between approximately 0-20 degrees, but may be greater than 20 degrees.

Rotation of the hanger 130 can be constrained by a compression assembly 150, including lower and upper bushings 153 and 155. The compression assembly 150 can provide roll-resistance to the rotation of the hanger 130 (e.g., the compression assembly 150 can bias the position of the hanger 130 to return to a neutral position that typically allows the skateboard to roll forward or backward in a straight line). The compression assembly 150 can be generally aligned along a compression axis 103 through the base 110. In certain implementations, the compression axis 103 can be approximately perpendicular to the pivot axis 101. Desirably, the compression axis 103 to not be fully aligned with the pivot axis 101; this allows bushings to directly control movement that occurs about the pivot axis 101. In certain implementations (as illustrated in FIGS. 2A-2B), the compression axis 103 is perpendicular to the pivot axis 101 and oriented generally vertically (almost orthogonal to the plane of the deck) thereby extending between the deck and a ground surface). In certain other implementations (not illustrated), the compression axis may be substantially aligned with the first and second wings 132, 133 of the hanger 130. Various orientations of the compression axis may be used. Compression is particularly useful when it exerts force on the hanger along an axis generally perpendicular to the hanger's pivot axis 101.

In a board assembly, two trucks (e.g. such as two instances of truck 100) can be coupled to an underside of a deck and fitted with wheels. In general, a front side of each truck faces outward (e.g., towards a nose and tail of the deck), with the pivot axis 101 starting closest to the deck on the outward end of the board (e.g., angled inwards). This assembly orientation allows of the board to be navigated by angling the deck toward the desired direction of travel: a left lean creates a left turn and a right lean creates a right turn. The right and left turns are created by rotation of the base 110 (e.g., leaning the deck), which changes the base's angle with respect to the hanger 130. Rotation of the base 110 causes rotation of the hanger 130 that results in a turn because the wheel assembly 120 engages the ground. Because the orientations of the two truck assemblies are opposite each other, the board can turn about varying radii based on the rotation of the hanger 130 on or both of the two truck assemblies, and based on the amount of lean provided by the rider.

Figure 9:
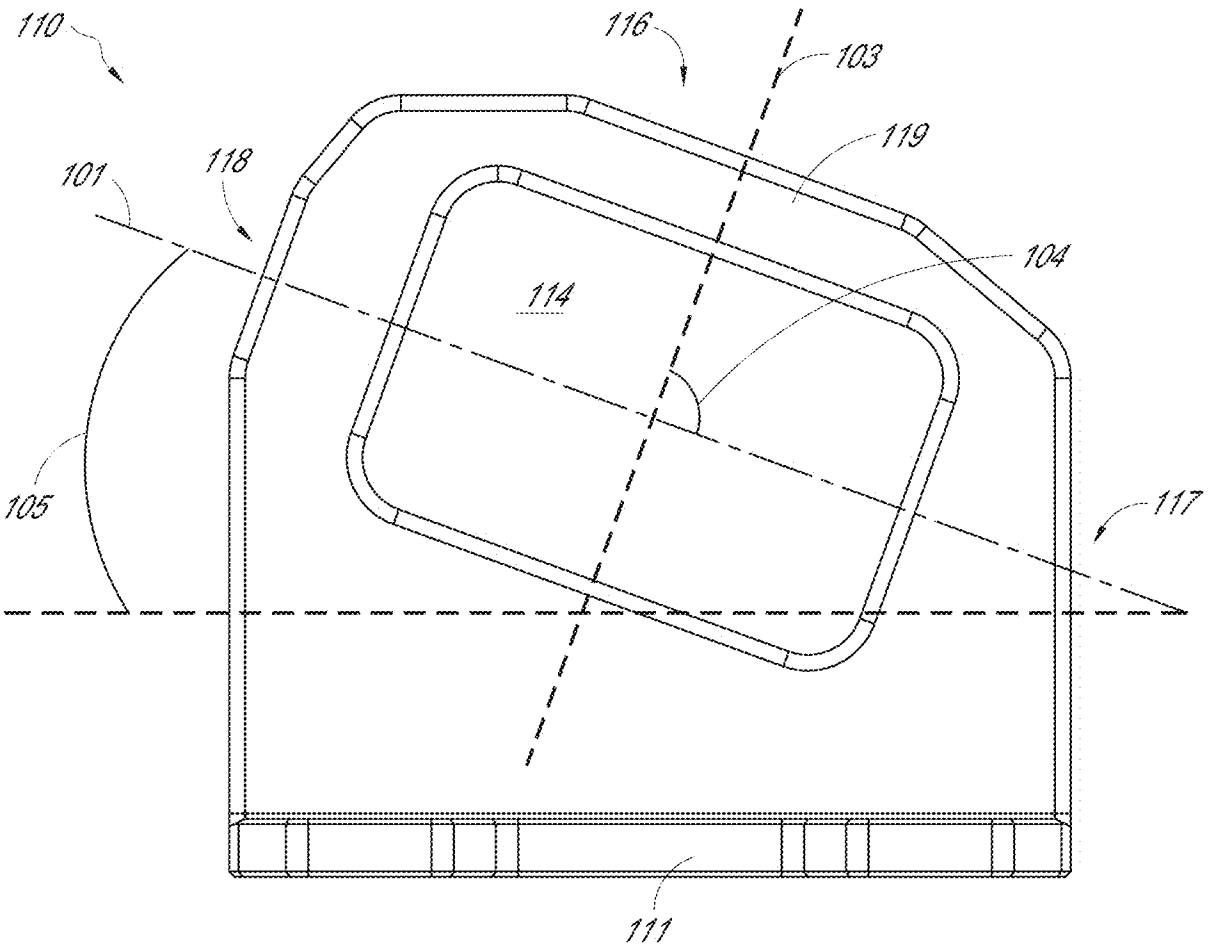
FIG. 9 is a side view of the base of FIG. 7.

As illustrated in FIG. 9, the pivot axis 101 can be at an angle 105 relative to the flange 111 of the base 110 (e.g. which is typically mounted parallel to the deck of board). The angle 105 generally affects the turning ability of the truck 100. For example, with a low value for the angle 105 (e.g., approximately 15-35 degrees) the truck 100 requires more board tilt for a given turning radius. With a high value for the angle 105 (e.g., approximately 40-55 degrees) the truck 100 requires less board tilt for a given turning radius. This is because the low value for the angle 105 causes less rotation of the hanger 130 (less turning of wheels based on the same deck tilt) and the high value for the angle 105 causes more rotation of the hanger 130 (more turning of the wheels based on the same deck tilt). The angle 105 can be adjusted and/or optimized for a particular purpose. For example, a high performance racing board may be constructed for a particular average downhill slope of a particular course, also accounting for the weight and preferences of an athlete. Generally, the angle 105 can be between 0 and 60 degrees. Preferably, the angle 105 is between approximately 15 and 55 degrees.

In certain implementations, a board can be assembled using a low angle truck at the tail of the deck and a high angle truck at the nose (or vice versa). Other combinations of angles are also useful to accomplish different goals. For example, some embodiments use consistent angles between front and back trucks (e.g., to allow for tricks or a board that rides the same in both directions), to reduce manufacturing cost and improve safety by making parts interchangeable and more likely to be kept in working order.

The hanger 130 is pivotably coupled with the base 110 about the pivot axis 101. In certain implementations, the only degree of freedom relative to the base for the hanger 130 is rotation about pivot axis 101. Longitudinal translation along the pivot axis 101 is adjusted to be effectively zero (e.g., less than approximately 0.002"). Moreover, the hanger is constrained (e.g., to allow rotation in a two-dimensional plane that extends orthogonal to the pivot axis) on both first and second ends 131*a* and 131*b* of the central portion 131 by the hanger 130 (e.g., by the front and rear shafts 141, 143—see FIG. 6). Thus, rotation of the base 110, such as by leaning of an attached deck, can translate into rotation of the hanger 130 with effectively no "play" (e.g., every angle of lean on the base 110 causes a corresponding rotation of the hanger 130, where the correspondence can be plotted linearly). In certain implementations that minimize play, the ratio of lean angle to rotation angle is 1:1 (i.e., where angle 105 is 45 degrees).

Constraining the hanger 130 to only movable by rotation offers substantial benefits over other types of truck design (e.g., kingpin-type) that exhibit play. For example, more precise control can be had over turning of a board by a user. An athlete who perceives an obstacle or other reason to turn can achieve a turning result in less time because the athlete's physical reaction translates more quickly into an actual turning effect of a skateboard. Moreover, the effect is more predictable and precisely correlated to an athlete's movements, and can thus be practiced more effectively over time and repeated with more confidence. Maintenance can also be improved, as bearings last longer than the pivot cups of other trucks. The significantly increased precision of the truck 100 allows for higher speeds with higher stability and/or tighter turns (e.g., even with loose bushing settings) and reduces and/or eliminates wobble.

Another benefit of truck 100 is the independent adjustment of roll resistance separately from the position of the hanger, in contrast to that exhibited by king-pin type and other types of conventional trucks. The compression assembly 150 can be compressed and decompressed without modification of or adjustment to the pivot axis 101. Moreover, using the truck 100, the weight of the user on the deck can be evenly distributed by the hanger, minimizing roll-resistance because the weight of the user is transferred through the base 110 and into the hanger without the intermediary of the bushings 153, 155.

In a conventional truck, the hanger is located by bushings so that the pivot axis location (and how much this axis moves) is determined by the tightness and stiffness of the bushings. This tightness and stiffness changes as the bushings are compressed on one side at a time during a turn. The pivot axis also moves (even on a smooth surface) as the board is tilted side to side because of the compression changes in the bushings; the pivot axis moves towards the stiffer side (the side the deck is leaning towards). This shifting of the pivot axis means that the rider is must lift the deck and the weight of the rider in order to turn causing excess wheel movement. The truck 100 can increase hanger control by reducing this unintended motion in the steering of the board. The overall increased control of the hanger movement by the truck 100 can also reduce wheel scrub. The control of wheel scrub afforded by the truck 100 can make the wheels last longer by wearing less and extend the range of electrically powered boards.

Figure 6:
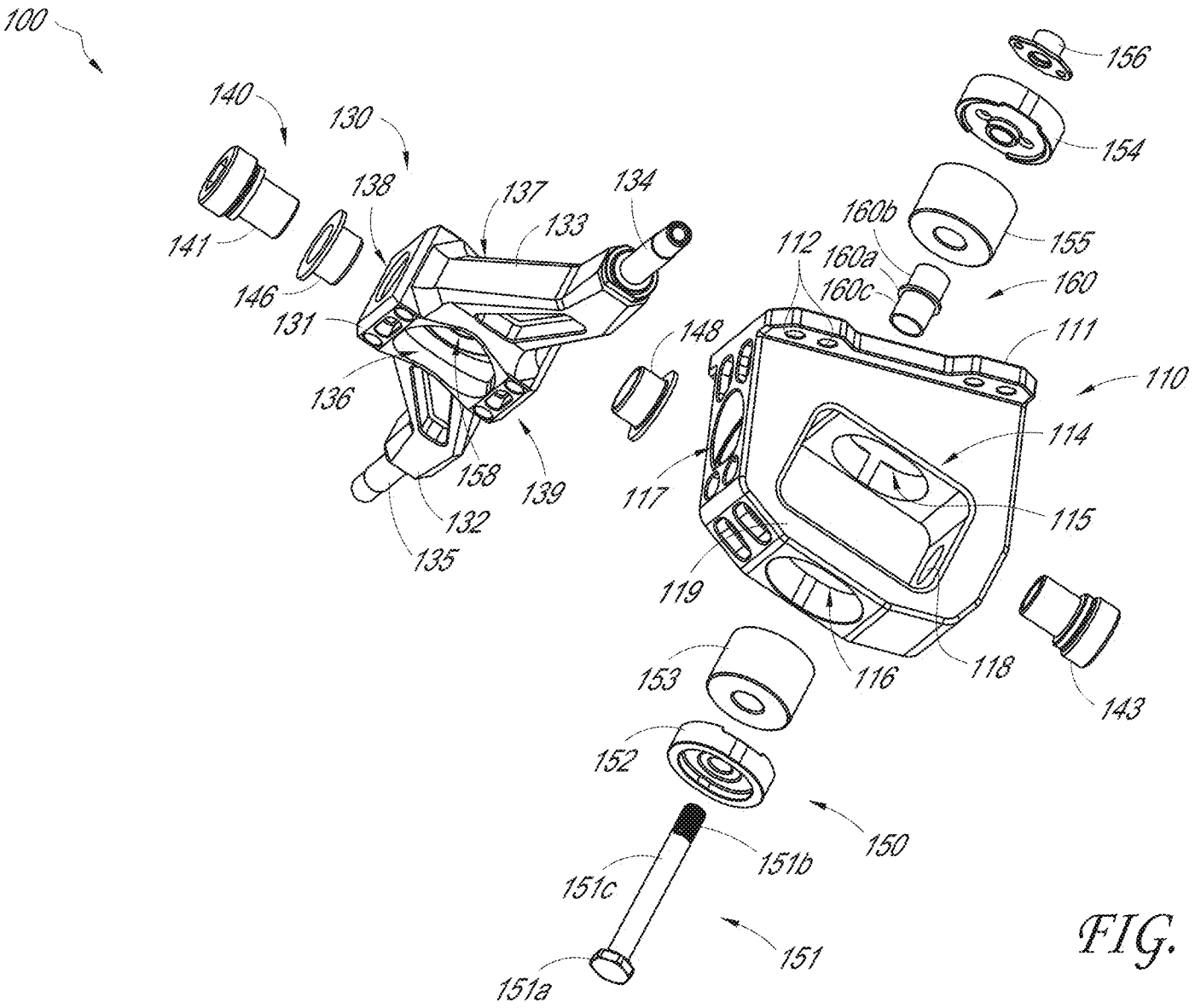
FIG. 6 is a perspective exploded view of the truck of FIG. 2A.

FIG. 6 illustrates a perspective exploded view of the truck 100, oriented as it would be when assembled to attach to a deck of a board. The base 110 can include a hanger aperture 114 in the transverse portion 119. The hanger 130 can be sized to extend through the hanger aperture 114. In some implementations, the transverse portion 119 can include an outer arc shape which may improve strength and aesthetics and provide a contour that is better for scraping along surfaces (e.g., asphalt roads) without catching. The base 110 can include a lower bushing aperture 116 and an upper bushing aperture 115. The lower bushing aperture 116 can be disposed generally within or on the outer arc shape of the base 110. The upper bushing aperture 115 can be disposed proximate to the flange 111. The lower and upper bushing apertures 116, 115 can be generally aligned with a compression axis 103 on opposite sides of the hanger aperture 114. The compression assembly 150 can be coupled with the base 110 through the lower and upper bushing apertures 115, 116.

The compression assembly 150 can include a compression bolt 151 with a first end 151*a* and a second end 151*b*. The first end 151*a*, in some implementations, can be a head of a bolt and the second end 151*b* can include the threaded portion of the bolt. In some implementations, the compression bolt is a shaft, pin or rod. The compression bolt 151 can include a generally cylindrical outer surface 151*c* (e.g., a diameter between ⅛" and ¾"). In certain implementations the cylindrical outer surface 151*c* can include a plurality of threads. In other implementations, the outer surface 151*c* can take any shape (e.g., polygonal cross-section, hexagonal cross-section, etc.). The compression bolt 151 can be generally in tension and apply compressive forces when assembled with the rest of the compression assembly 150.

The compression assembly 150 can further include a force transfer bushing 152. The force transfer bushing 152 engages with the lower bushing 153. The lower bushing 153 can be a conventional-type of urethane bushing, such as those commonly used in kingpin type skateboard trucks, or any other suitable type or material. Suitable materials include those with the right proportions of resilience and rigidity. In other implementations, the bushings can be spring or torsion bars. The compression assembly 150 can further include the upper bushing 155 that engages with an upper force transfer bushing 154. It can be helpful to include bushings both above and below such that force is exerted similarly from both directions. Adding additional or alternative bushings can allow refined adjustment of compression and turning response. Bushing size and geometry can also be adjusted to create desired effects. The function of the upper force transfer bushing 154 and upper bushing 155 (and/or the force transfer bushing 152 engages with the lower bushing 153) can be accomplished with more or fewer bushings. For example, the upper force transfer bushing 154 and upper bushing 155 (or equivalent lower bushings) can be coupled together into a single unit or integrally formed.

The second end 151*b* of the compression bolt 151 can be coupled with a force transfer bushing nut 156. In other implementations, the compression 151 bolt can be directly coupled with the upper force transfer bushing 154. The compression assembly 150 can be compressed/decompressed to varying degrees by the compression bolt 151 to add stiffness to the roll-resistance of the hanger 130 rotation about the pivot axis 101. In some embodiments, a threaded hole can be provided in the base 110 (e.g., in or above the flange 111) into which the compression bolt 151 may be tightly threaded.

In certain implementations, the compression assembly 150 includes a rollbar 160. As discussed further below, the rollbar 160 can include a first cylindrical section 160*b*, a second cylindrical section 160*c* and optionally a flange 160*a*. The rollbar 160 can be disposed on the compression bolt 151 (e.g., which can extend through a central aperture 160*d* of the rollbar 160). The first and second cylindrical portions 160*b*, 160*c* can extend into the lower and upper bushings 153, 155 respectively. The rollbar 160 and the bushings can be formed from complementary materials that slide or prevent sliding at the given forces, as desired. The flange 160*a* can provide a rigid transverse surface mechanically coupled to the shaft of the bolt 151 to improve strength and center bushings properly.

Along the pivot axis 101, the base 110 can include a front shaft aperture 117 and a rear shaft aperture 118. The front and rear shaft apertures 117, 118 can be aligned with and help form the pivot axis 101. In certain implementations the rear and/or front shaft apertures 117, 118 can be attached to receive front and rear shafts 141, 143. The front shaft 141 can be disposable within the front shaft aperture 117. The rear shaft 143 can be disposable within the rear shaft aperture 118. The front and rear shafts 141, 143 can be engaged with (e.g., inserted at least part-way into) the hanger 130 when assembled within the base 110 in a manner that allows the hanger 130 to be pivotable about the pivot axis 101.

The hanger 130 (e.g., at least one wing or the central portion 131) is insertable within the hanger aperture 114 of the base 110. The central portion 131 of the hanger 130 can include lower and upper sockets 136, 137, or other surfaces for engaging with the lower and upper bushings 153, 155. In the illustrated embodiment, lower socket 136 receives (e.g., having a diameter larger than the diameter of) the lower bushing 153. Similarly, the upper socket 137 receives the upper bushing 155. When assembled with the compression assembly 150, the lower and upper bushings can be generally nested within the lower and upper sockets 136, 137. In other implementations, the hanger 130 does not include sockets or the sockets can have different shapes than sockets 136, 137 (e.g., sockets may be flatter or more open).

The hanger 130 can include the roll aperture 158 (see FIG. 6) disposed through the central portion 131. In certain implementations the roll aperture 158 is disposed within a bottom surface 136*a* (see FIG. 10) of the lower socket 136 (e.g., into the upper socket 137 or otherwise through hanger 130). The compression bolt 151 can extend through the roll aperture 158. In certain implementations, the rollbar 160 can be disposed within the roll aperture 158 (e.g. at least a portion of the rollbar 160 can extend into or through the roll aperture 158). In certain implementations, the bottom surface 136*a* can be angled inward or outward (e.g., conical sections angled towards or away from the roll aperture 158) or include other non-planar surface structures to further customize roll-resistance with respect to abutting surfaces of the bushings 153, 155. These bushings and the surface 136 can be designed with complementary shapes. For example, one can be convex, the other concave. One can be angled positively, the other can be angled negatively. They can both be annular and flat, as illustrated. They can also have varying amount of abutment or overlap, which can be engineered for different purposes.

The central portion 131 can include the first and second ends 131*a*, 131*b*. In certain implementations, one or both of the front and rear ends comprise planar surfaces. In certain implementations, front and rear bearing surfaces may engage with the interior surface of the hanger aperture 114 (e.g., either directly, or indirectly as described below).

The central portion 131 can include a front bearing seat 138 and a rear bearing seat 139 (e.g., in front and rear ends or surfaces, respectively). The front bearing seat 138 can receive a front bearing 146. The rear bearing seat 139 can receive a rear bearing 148. In certain implementations of the central portion 131, the bearing seat 138 is surrounded by a planar portion which can seat the front bearing 146. Similarly, the central portion 131 around the rear bearing seat 139 can be generally planar for seating the rear bearing 148.

The truck 100, when assembled together, may be described generally as follows. Although described here in a specific order, the order of assembly can vary, with assembly of certain parts not contingent on the pre or post assembly of any other part of the truck 100. The hanger 130 is disposed within the hanger aperture 114 of the base 110. The front bearing 146 is located within the front bearing seat 138, the rear bearing 148 is located within the rear bearing seat 139. In certain implementations, a flange of the front and rear bearings 146, 148 can engage the inner surface of the hanger aperture 114. The hanger 130 can be maintained in position within the hanger aperture 114 by the front and rear bearings 146, 148 and cooperating parts along the pivot axis 101 (e.g. with no or very little lateral movement along the pivot axis 101). The front shaft 141 can be inserted within the front shaft aperture 117 and into the front bearing seat 138 and/or the front bearing 146. The rear shaft 143 can be inserted through the rear shaft aperture 118 and/or through the rear bearing 148 or the rear bearing seat 139. The front and rear shafts 141, 143 can be generally aligned (e.g., longitudinally) and the hanger 130 can pivot about the front and rear shafts 141, 143 about the pivot axis 101.

The compression assembly 150 can be assembled with the base 110 and about the hanger 130. The lower bushing 153 can be inserted through the lower bushing aperture 116 and into engagement with the hanger 130 (e.g. within the lower socket 136). The lower force transfer bushing 152 can then be inserted into the lower bushing aperture 116. The lower force transfer bushing 152 can be slidingly engaged with an inner surface of the lower bushing aperture 116. The upper bushing 155 can be inserted into the upper bushing aperture 115 and into engagement with the hanger 130 (e.g. within the upper socket 137). The upper force transfer bushing 154 can be inserted into the upper bushing aperture 115 and slidingly engaged with an inner surface thereof. Components of the compression assembly 150 can be generally coaxially aligned when assembled.

In certain implementations, the rollbar 160 can be inserted between the lower and upper bushings 153, 155 (e.g. after assembly of the hanger 130 for the assembly in at least one of the lower and upper bushings 153, 155). The first and second cylindrical portions 160*b*, 160*c* are disposed within the lower and upper bushings 153, 155 respectively.

The compression bolt 151 can be inserted through the lower force transfer bushing 152, the lower bushing 153, the rollbar 160 (if present), the hanger 130 (e.g., via the roll aperture 158), the upper bushing 155 and the upper force transfer bushing 154. The compression bolt 151 can be generally aligned with the compression axis 103. The second end 151*b* of the compression bolt 151 can be coupled (e.g. threaded into) the force transfer bushing nut 156. By rotation of the compression bolt 151 relative to the force transfer bushing nut 156, a compressive force along the compression axis 103 can be exerted against the hanger 130. This force against the hanger 130 can act to stabilize the position of rotation of the hanger 130 to a neutral orientation about the pivot axis 101. By increasing the compression forces on the compression axis (e.g. by tightening the compression bolt 151 with the force transfer bushing nut 156 or by adjusting durometer or materials within the compression assembly 150) the stiffness of the rotation of the hanger 130 with respect to the base 110 can be increased according to the preference of the user.

Figure 7:
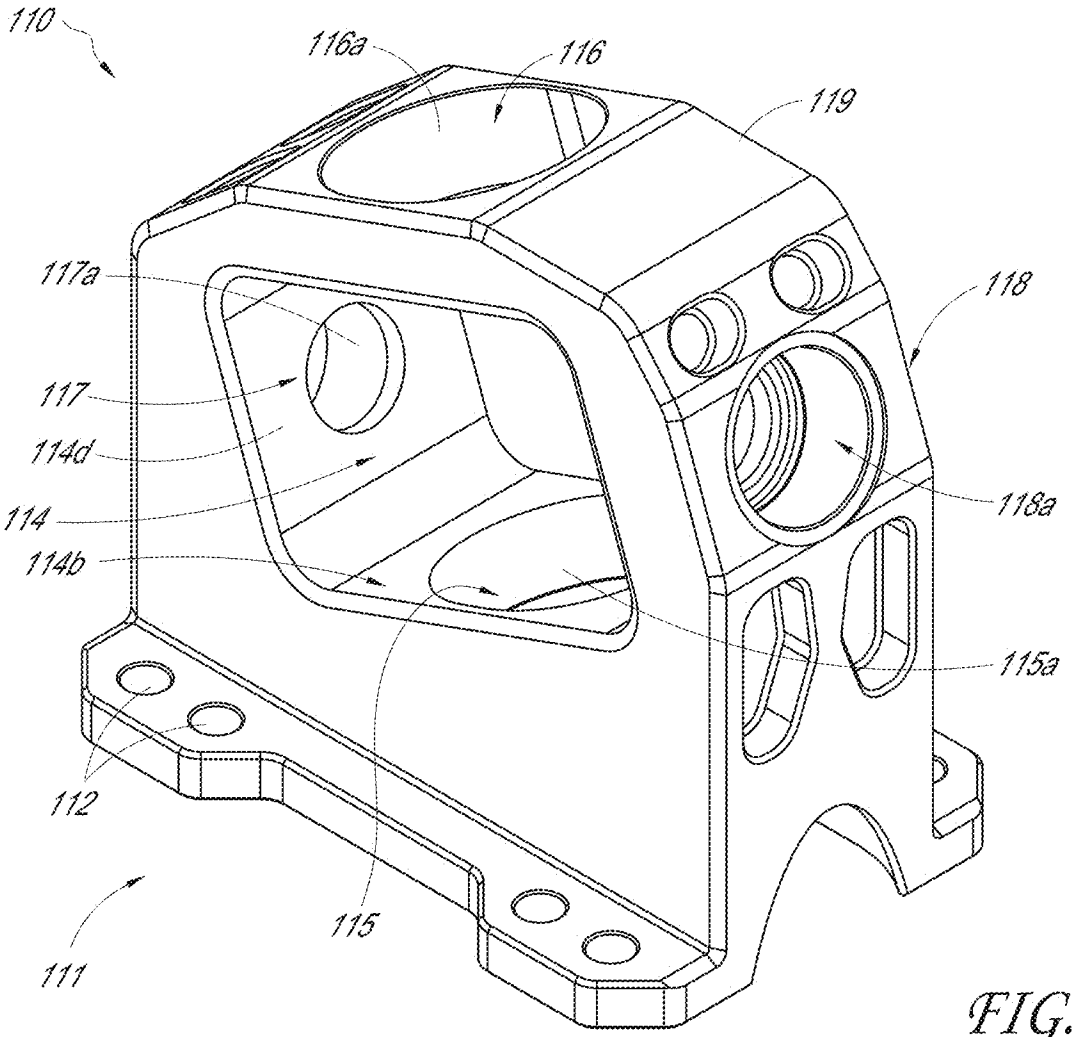
FIG. 7 is a perspective view of a base of the truck of FIG. 2A.
Figure 8B:
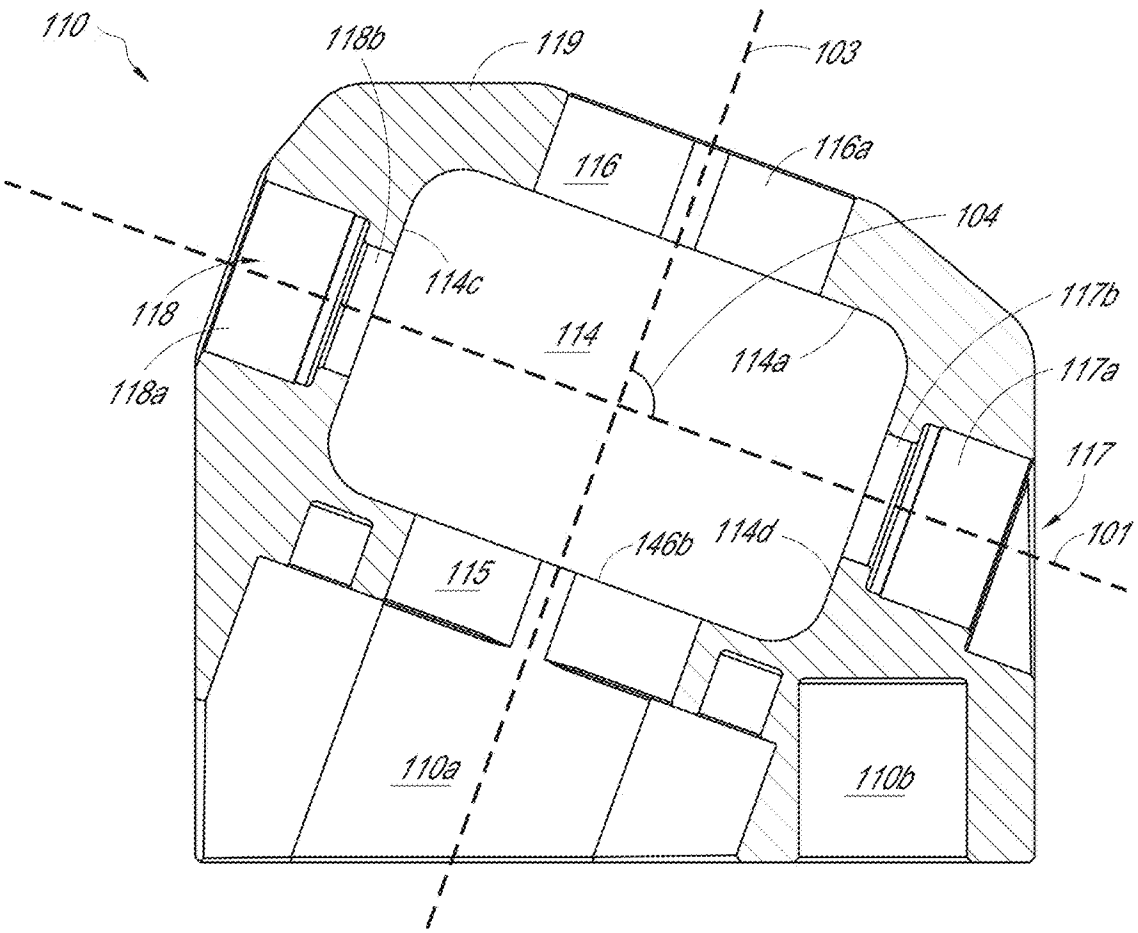
FIG. 8B is a section view taken along the line 8B-8B in FIG. 8A.
Figure 8A:
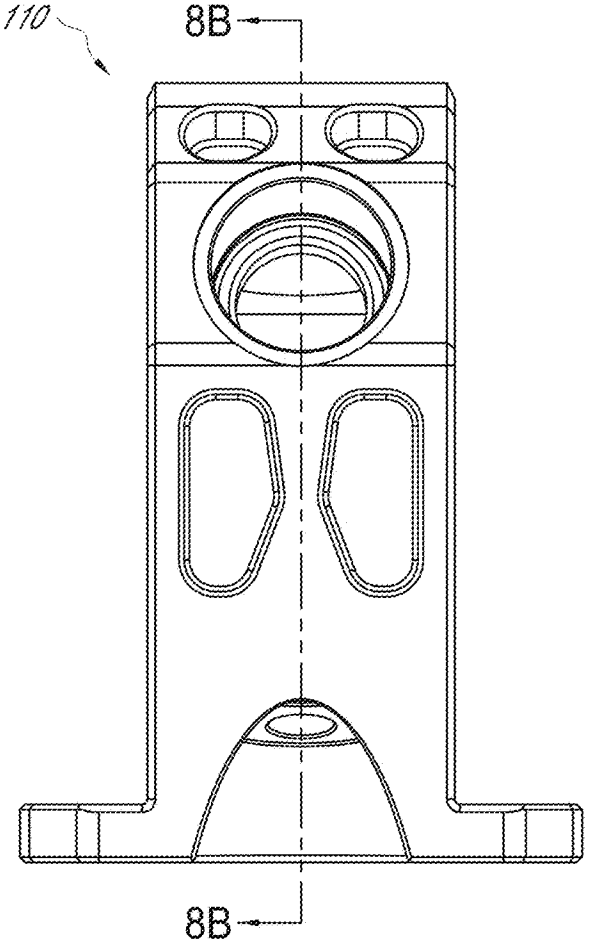
FIG. 8A is a rear view of the base of the truck of FIG. 7.

FIGS. 7-9 further illustrate the base 110. The base 110 can include the flange 111 and the transverse portion 119. The hanger aperture 114 can be disposed through the transverse portion 119. The hanger aperture 114 can receive the hanger 130. In some implementations, the hanger aperture 114 can be generally rectangular in shape, but can be any shape corresponding to (e.g., sized to receive) the hanger 130. The hanger aperture 114 can have an inner surface. For example, the inner surface can include, in some implementations, an upper surface 114*b*, a lower surface 114*a*, a front surface 114*c* and a back surface 114*d*. In some implementations, any or all of the upper surface 114*b*, lower surface 114*a*, front surface 114*c* and/or back surface 114*d* can be or comprise generally planar portions. These surfaces can be configured (e.g., by shape and/or materials) to be seated against complementary surfaces of a hanger 130.

The lower bushing aperture 116 can be disposed within or on an outer arc portion of the transverse portion 119. The upper bushing aperture 115 can be on the base 110 adjacent to the flange 111. A hollow space 110*a* in the base 110 can provide access to the upper bushing aperture 115 from the flange 111 side of the base 110. In certain implementations, the base 110 can further include one or more lightening spaces (e.g. 110*b*) designed to lighten the overall weight of the truck without significantly weakening it.

In certain implementations, the lower and/or upper bushing apertures 116, 115 can be have an elliptical cross-section. In certain implementations, the lower and/or upper bushing apertures 116, 115 can have circular cross-sections (or any other suitable shape) defined by corresponding inner surfaces 116*a*, 115*a*, respectively. Useful embodiments of these apertures provide strong, rigid support for a shaft that extends into the hanger and interacts with the hanger's surfaces (e.g., a flange or socket) to constrain rotation thereof about a non-parallel axis. In certain implementations, it can be desirable for the force transfer bushings 152, 154 to be slidable or translatable within the lower and upper bushing apertures 116, 115 but not rotatable within. This can aid in maintaining the orientation of the compression assembly 150 with respect to the base 110. Rotation can be reduced for example by including radial protrusions or other shapes that interact with constraining surfaces to reduce or prevent such rotation.

In certain implementations, the force transfer bushings 152, 154 assist in transferring forces from the hanger 130 to the base 110 (e.g., from rotation of the hanger 130 transferred through the bushings 153, 155 to the force transfer bushings 152, 154). In certain implementations, the force transfer bushings 152, 154 transfer forces, but not a transverse moment force from the hanger 130 to the base 110. This is because the force transfer bushings 152, 154 are positioned generally within the lower and upper bushing apertures 116, 115, aligning the force generally with the effective net center of rotation of the hanger 130.

This type of configuration offers significant advantages over kingpin-type trucks where the kingpin is fixedly extended from the base. For example, in a kingpin-type truck, the kingpin must be thicker and stronger than is generally required for the compression bolt 151 because the kingpin must withstand a transverse and offset "moment" force from the hanger (during rotation). Moreover, the compression bolt 151 is constrained at two positions along the compression axis 103 on both an upper end (e.g., proximate second end 151*b* and/or the flange 111) and a lower end (e.g., proximate head 151*a* and/or the outer arc of the transverse portion 119), while the kingpin is cantilevered. By allowing physical constraint on opposite sides of the hanger 130, the base 110 provides a rigid, strong, tunable skeleton that supports the axes and shafts described herein. Whereas the kingpin assembly wobbles and sways, configurations and structures described herein maintain a consistent orientation of a pivot axis 101. The substructure that extends from the flange 111 and generally surrounds the central portion of the hanger 130 allows a wide range of tightening possibilities. Whereas tightening a kingpin constrains or reduces the hanger's wobble in numerous dimensions, tightening the bushings 153, 155 constrains rotation in a more specific way. Similarly, loosening the bushings allows rotation of the hanger 130 to happen with less turning force, but it does not allow the hanger to wobble off axis.

The front shaft aperture 117 can include an inner surface 117*a* that can optionally be tapped to receive the front shaft 141. In certain implementations, the front shaft aperture 117 further includes a narrow region 117*b* for receiving only a portion of the front shaft 141. The rear shaft aperture 118 can include a tapped inner surface 118*a* and/or a narrow portion 118*b* for receiving the rear shaft 143.

Figure 10:
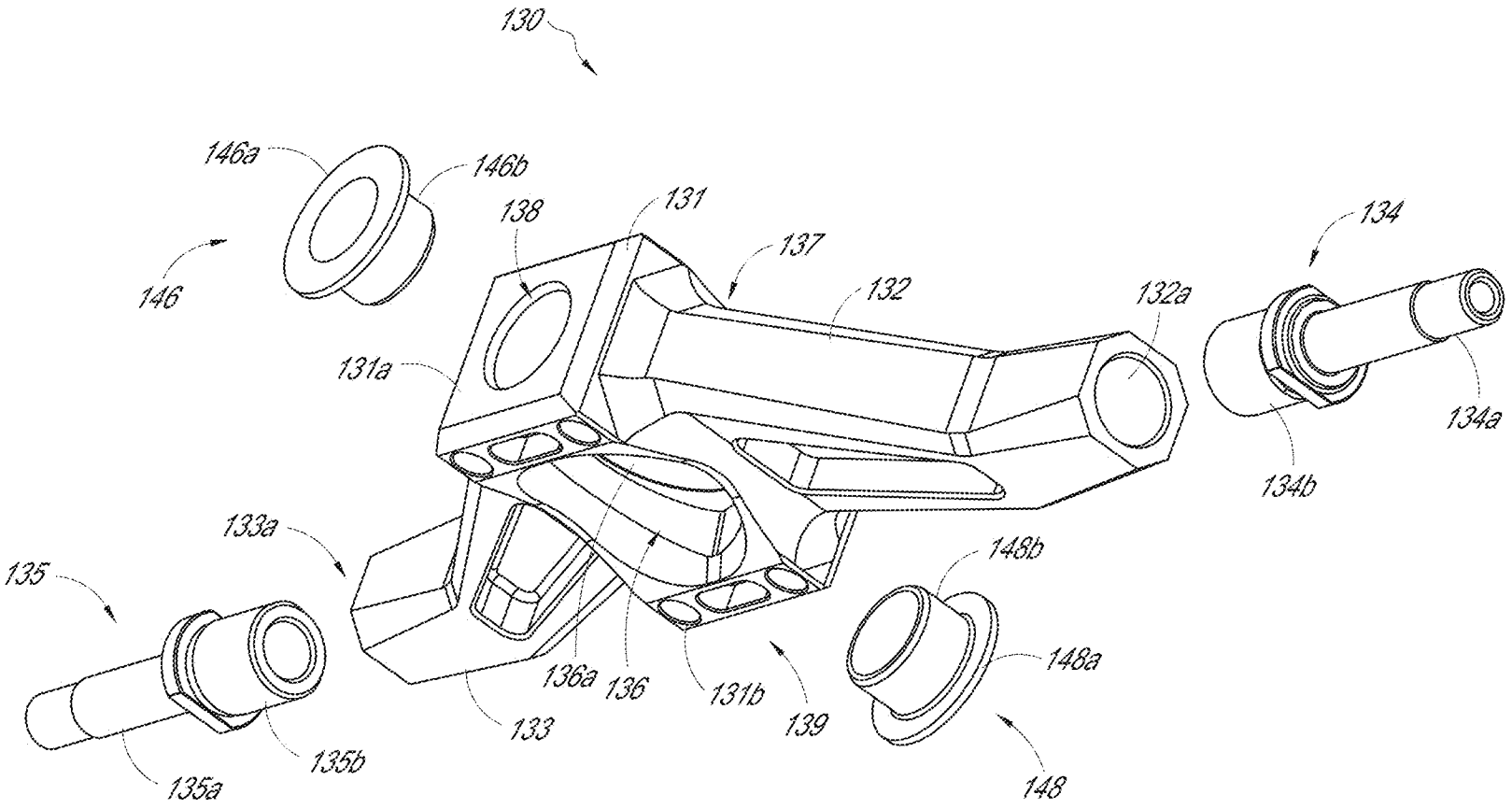
FIG. 10 is an exploded hanger assembly of the truck of FIG. 2A.
Figure 11A:
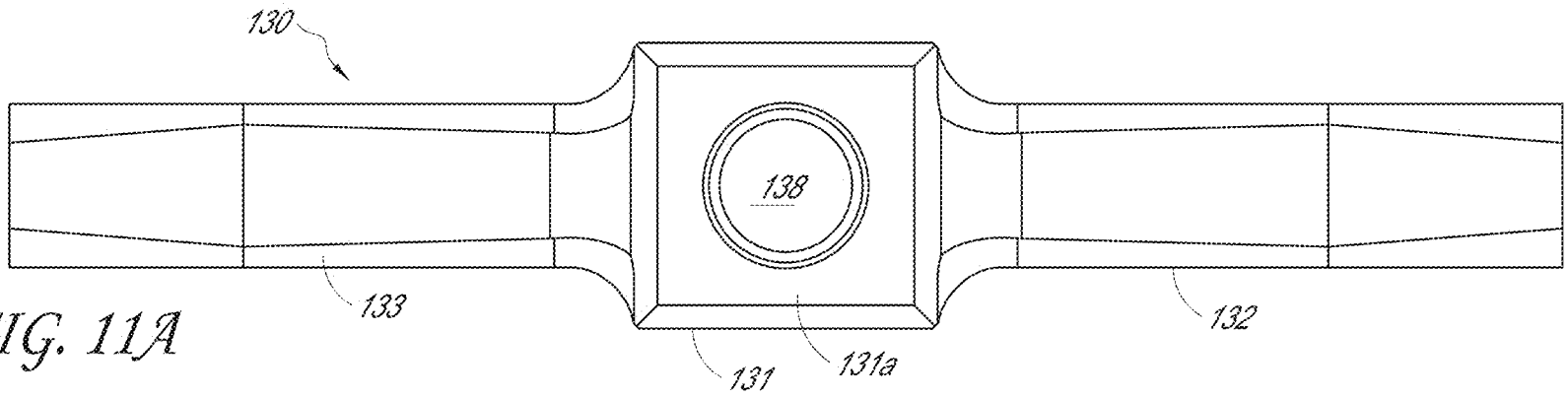
FIG. 11A is a bottom view of the hanger of FIG. 10.
Figure 11B:
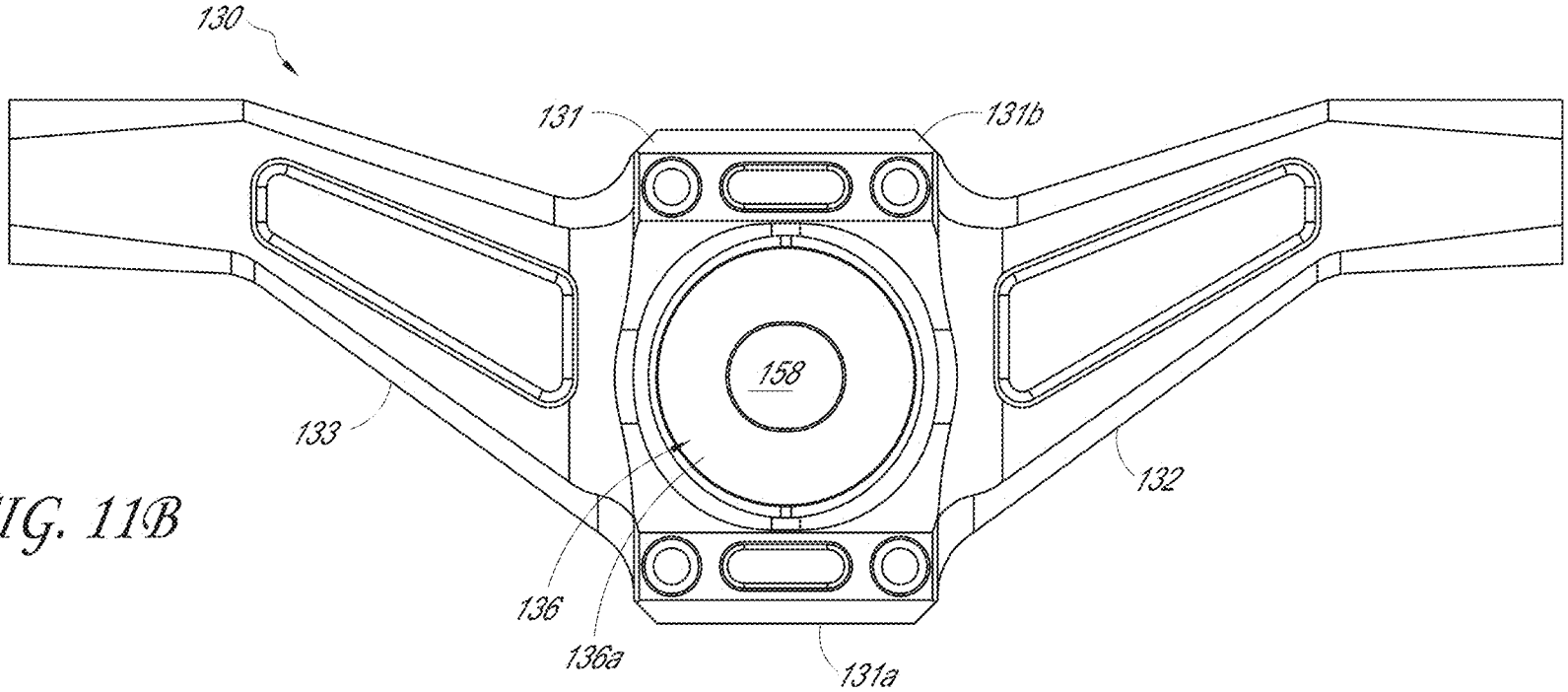
FIG. 11B is a back view of the hanger of FIG. 10.
Figure 12:
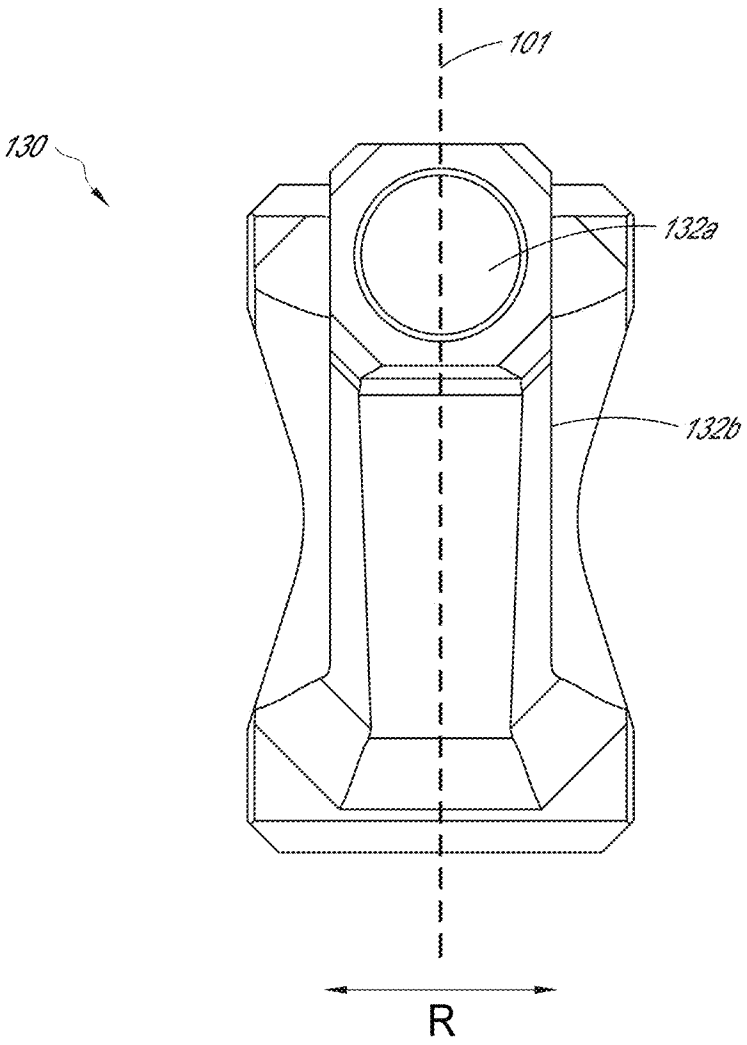
FIG. 12 is a side view of the hanger of FIG. 10.

FIGS. 10-12 illustrate the hanger 130. The hanger 130 can include one or more lightening holes to reduce the overall weight of the hanger 130 and to add to the hanger's design effect.

The left wing 132 of the hanger 130 is coupled with the left side of the central portion 131 and extends therefrom. The left axle 134 is coupled with the left wing 132. In certain implementations, the left wing 132 includes an aperture 132*a* for receiving the left axle 134. The aperture 132*a* can be tapped to provide support for threading. The left axle 134 can include threads 134*b* that can be received within the tapped aperture 132*a*. The left axle 134 and can further include a shaft 134*a* for receiving the wheel 122 and any associated bearings or other components of that assembly.

The right wing 133 can be coupled with the central portion 131 opposite the left wing 132. The right wing 133 can couple with the right axle 135. The right axle 135 can include a threaded region 135*b* and shaft 135*a* for coupling with the wheel 121. The left and right axles 134, 135 can align along a wheel axis. The threaded region 135*b* can be received within an aperture 133*a* of the right wing 133. In other implementations of the hanger 130, a single bar can extend between the left and right wings 132, 133 to form the right and left axles 134, 135 (e.g. the hanger 130 is cast around the single bar). The right wing 133 (and/or the left wing 132) can be generally transverse to (e.g., orthogonal, e.g., form a 90 degree angle) with a pivot axis 101 (e.g. the pivot axis 101 extending through the front and rear bearing apertures 138, 139).

The axles 134, 135 can be offset in a rake direction R orthogonal to the pivot axis 101 (e.g., either positively or negatively). As illustrated in FIG. 12, the aperture 132*a* for receiving the axle 134 is aligned with the pivot axis 101 (e.g. 0 rake).

Figure 13A:
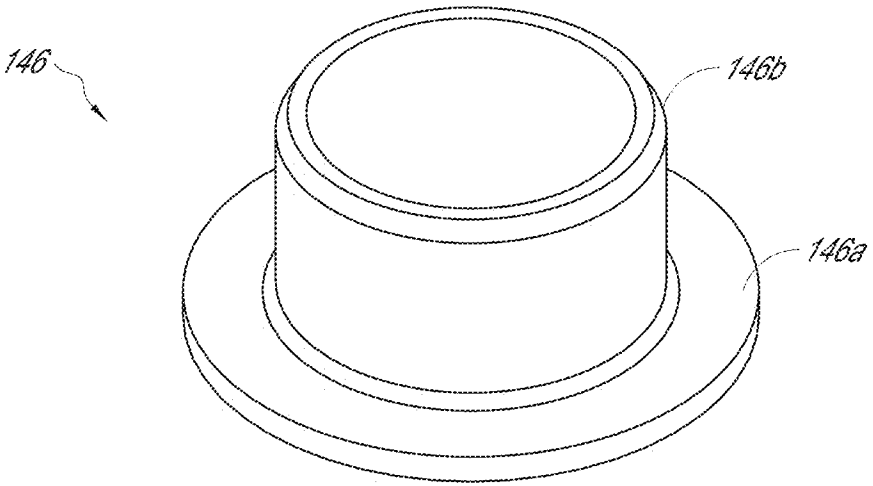
FIG. 13A is a perspective view of a bearing.
Figure 13C:
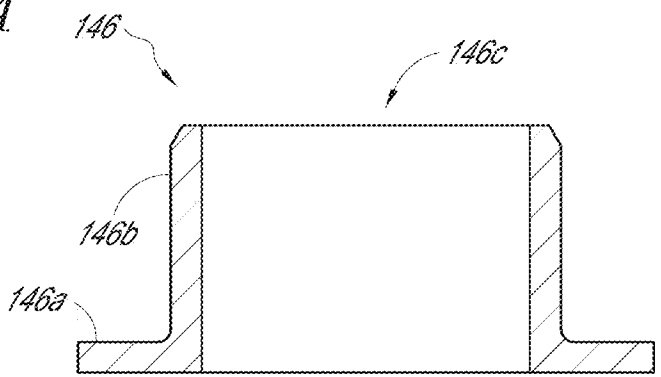
FIG. 13C is a section view taken along the line 13C-13C of FIG. 13B.
Figure 13B:
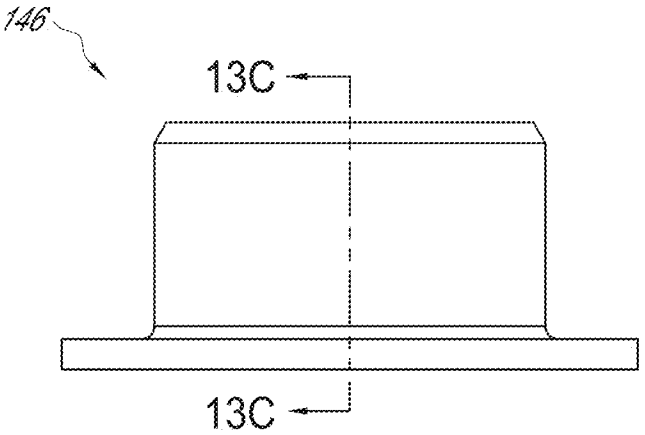
FIG. 13B is a side view of the bearing of FIG. 13A.
Figure 14B:
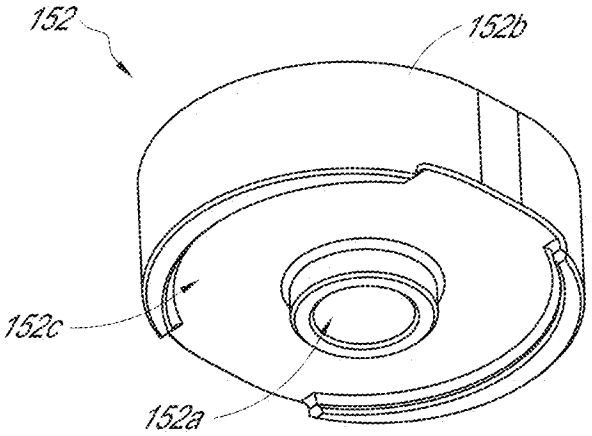
FIG. 14B is a bottom perspective view of a force transfer bushing of FIG. 14A.
Figure 14D:
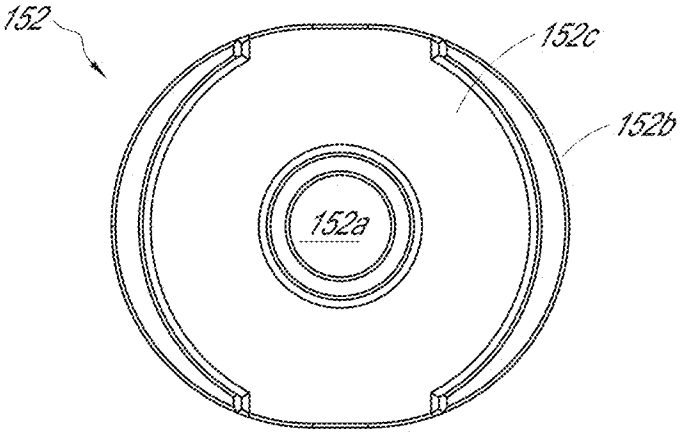
FIG. 14D is a bottom plane view of the force transfer bushing of FIG. 14A.
Figure 14A:
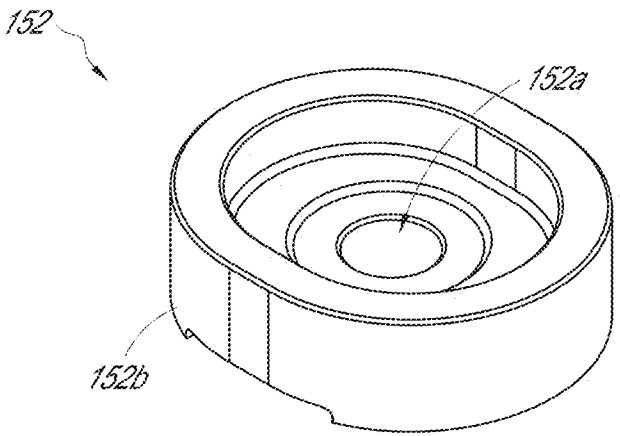
FIG. 14A is a perspective view of a force transfer bushing.
Figure 14C:
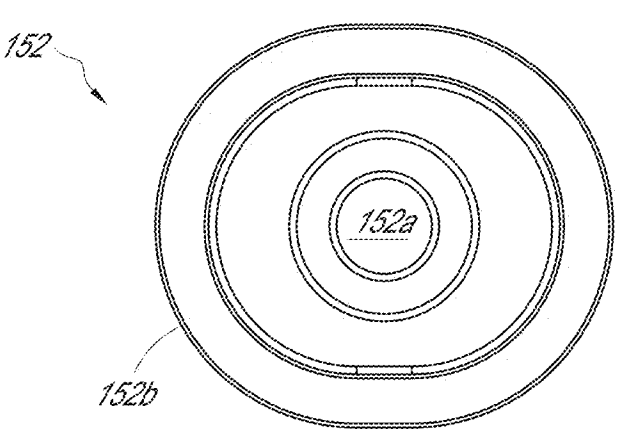
FIG. 14C is a top plane view of the force transfer bushing of FIG. 14A.

Referring to FIG. 13, the illustrated front bearing 146 can be identical to the rear bearing 148, but this is not required. The front bearing 146 can include a flange 146*a*, a cylindrical portion 146*b* and and/or an inner aperture 146*c* that extends through the bearing 146. The bearing 146 can be made out of any suitable material including high grade polymers or brass for example. The bearings 146 and 148 function to reduce friction between the shafts 141 and 143 and the hanger 130. The bearings 146 and 148 also function to precisely locate the hanger and can greatly increase the life (hours of use) of the truck 100. This allows for the hanger to rotate more easily and more freely and it provides a smoother ride and experience for user on the board using the truck 100. In other implementations, other types of bearings are used (e.g., ball and needle bearings).

Figure 15:
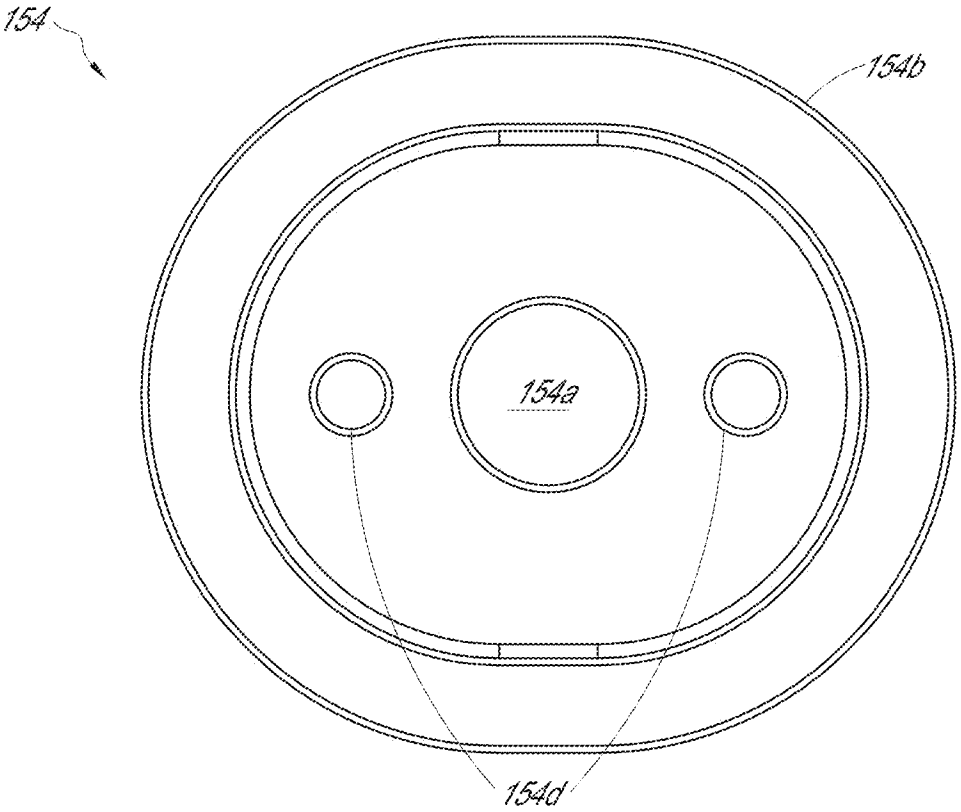
FIG. 15 is another implementation of a force transfer bushing.

FIGS. 14-15 illustrate example force transfer bushings 152 and 154. The force transfer bushing 152 can include an outer diameter 152*b* and an inner aperture 152*a*. The inner aperture can receive the compression bolt 151. The outer shape 152*b* can correspond to the inner surface 116*a* (e.g., shape) of the lower bushing aperture 116. One side of the force transfer bushing 152 can include a pocket or socket 152*c* for engaging with the bushing 153 (e.g. the socket 152*c* can include an outer lip for more securely engaging the bushing 153). The size and shape of the socket 152*c* can be configured in a great variety of ways which can help determine the performance characteristics of the truck 100. For example, the socket 152*c* can be more closed or more open. A more closed socket 152*c* creates a stiffer bushing reaction (e.g., a stiffer roll-resistance curve). A more open socket 152*c* allows more deformation of the bushing 153 which results in a softer roll-resistance curve of the hanger 130 about the pivot axis 101. As illustrated in FIG. 15, certain implementations the lower force transfer bushing 154 can include one or more apertures 154*d* for coupling with the force transfer bushing nut 156. In certain implementations, the orientation of the upper and lower force transfer bushing 152, 154 can be reversed (e.g., the orientation of the entire compression assembly 150 can be reversed).

Figure 16B:
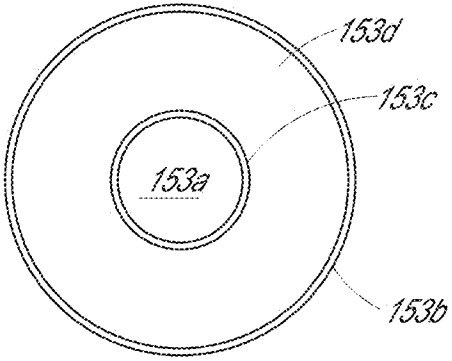
FIG. 16B is a top plan view of the bushing of FIG. 16A.
Figure 16C:
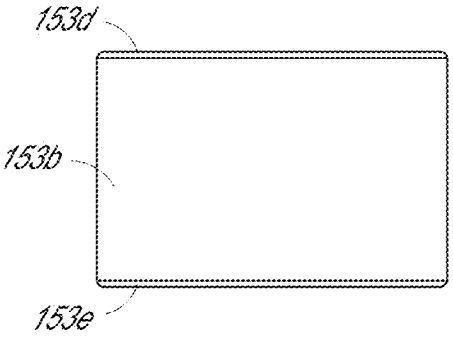
FIG. 16C is a side view of the bushing of FIG. 16A.
Figure 16A:
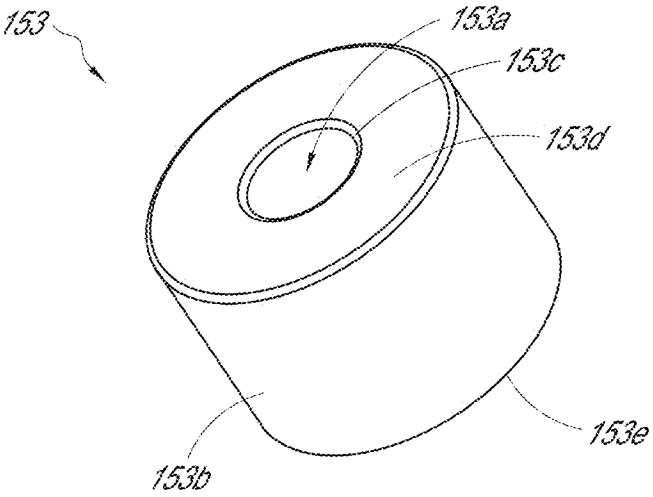
FIG. 16A is a perspective view of a bushing.

FIG. 16 illustrates the lower bushing 153, which can be identical to the upper bushing 155. In other implementations, the upper and lower bushings 153, 155 can be different to customize the roll-resistance curve desired by a user. For example, one of the upper or lower bushings 153, 155 can be made of a different material or have different dimensions (e.g., diameter, length or shape).

The lower bushing 153 can include a central aperture 153*a* with an inner surface 153*c*. the inner surface 153*c* can be cylindrical in certain implementations. The lower bushing 153 can include a first end 153*d* and a second end 153*e*. The first and second ends 153*d*, 153*e* can optionally be planar (e.g., to engage with the hanger 130 and/or the force transfer bushings 152, 154) or otherwise match the bottoms 136*a*, 137*a*. An outer surface 153*b* can be generally cylindrical. The illustrated bushing design is conventional and readily available in various sizes and materials. In certain implementations, the diameter of the inner aperture 153*a* is ⅜ of an inch. In some implementations, the aperture can be between approximately ⅛ inch and ¾ inches.

Figure 17B:
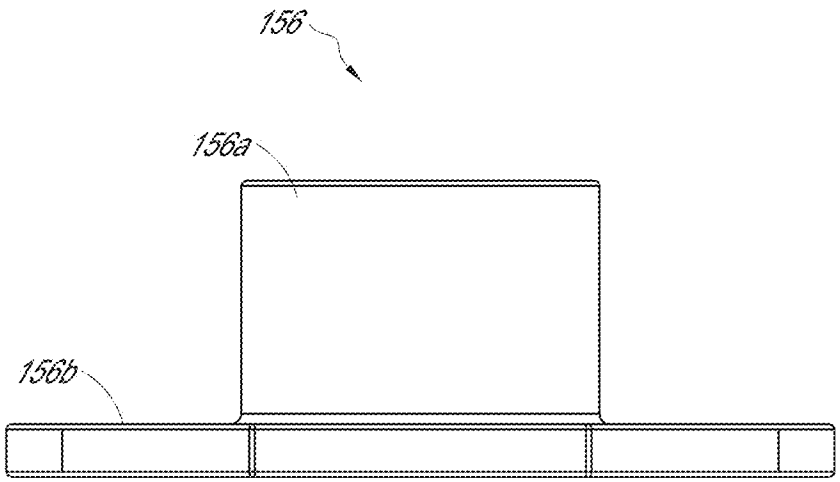
FIG. 17B is a side view of the force transfer bushing nut of FIG. 17A.
Figure 17A:
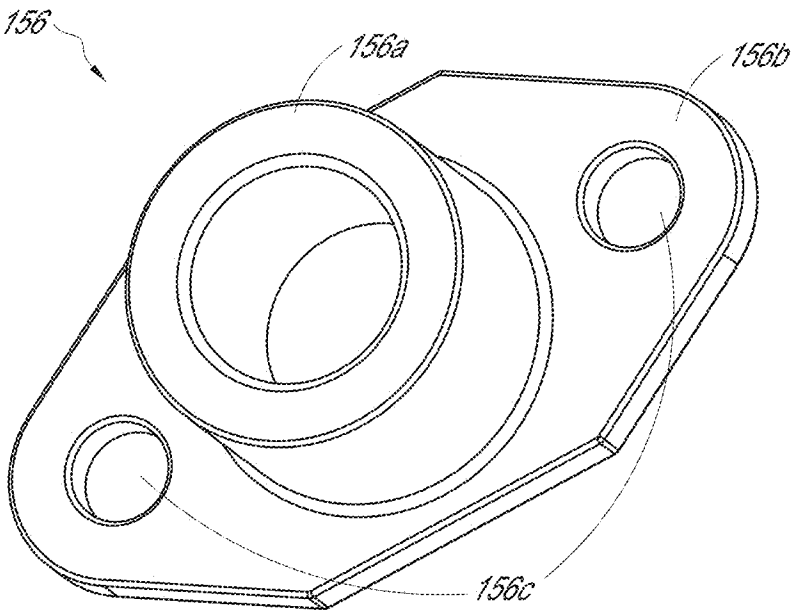
FIG. 17A is a perspective view of a force transfer bushing nut.

FIG. 17 illustrates the force transfer bushing nut 156. The force transfer bushing nut 156 can include a flange 156*b* and a cylindrical portion 156*a*. The cylindrical portion 156*a* can be tapped to engage with the second end 151*b* of the compression bolt 151. The flange 156*b* can include one or more apertures 156*c* or other coupling mechanisms for coupling with the upper force transfer bushing 154. In other implementations, a nut or the upper force transfer bushing 154 itself can be used to couple with the compression bolt 151.

Figure 18:
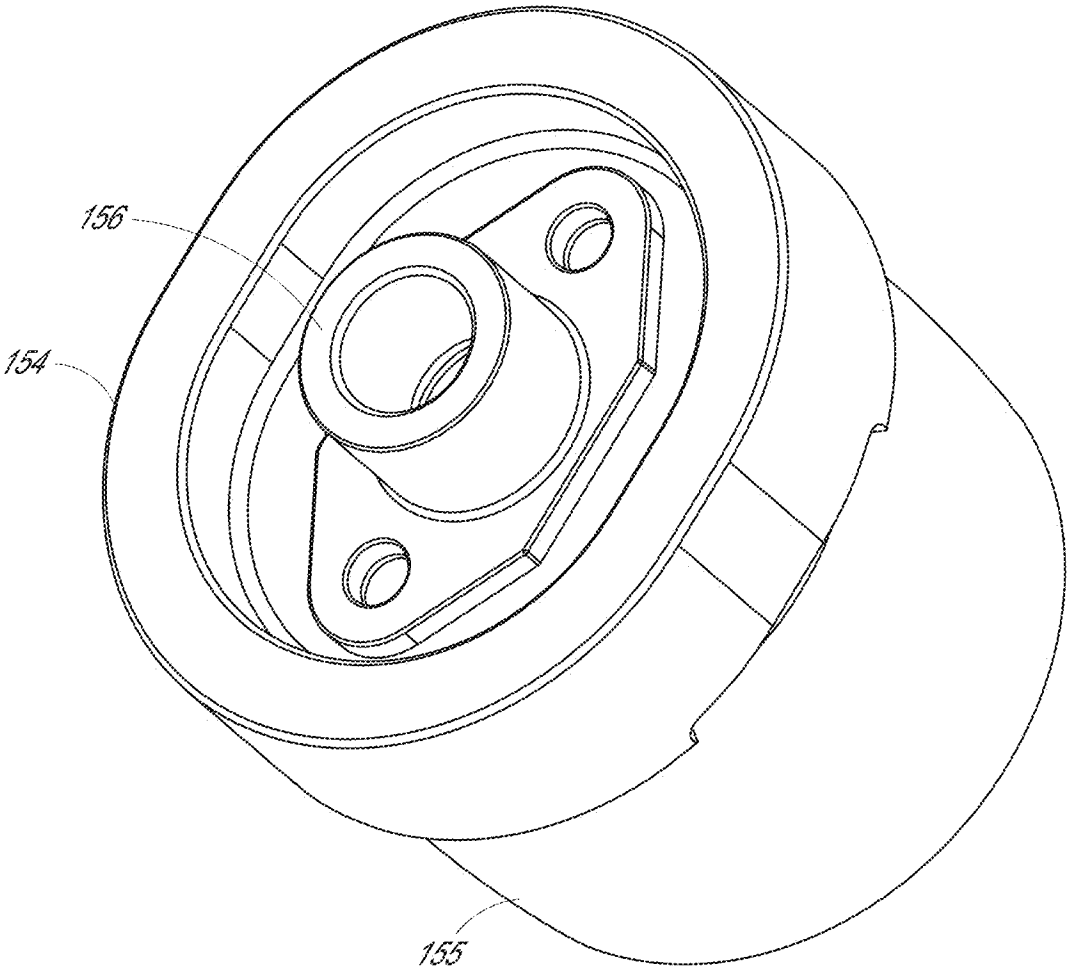
FIG. 18 is a perspective view of a compression assembly.

FIG. 18 illustrates an assembly of the force transfer bushing nut 156 with the upper force transfer bushing 154 and the second bushing 155. Central apertures at each of the force transfer bushing nut 156, the upper force transfer bushing 154 and the upper bushing 155 can be aligned along the compression axis 103. The upper bushing 155 can be seated within the socket 154*c* of the force transfer bushing 154.

Figure 19A:
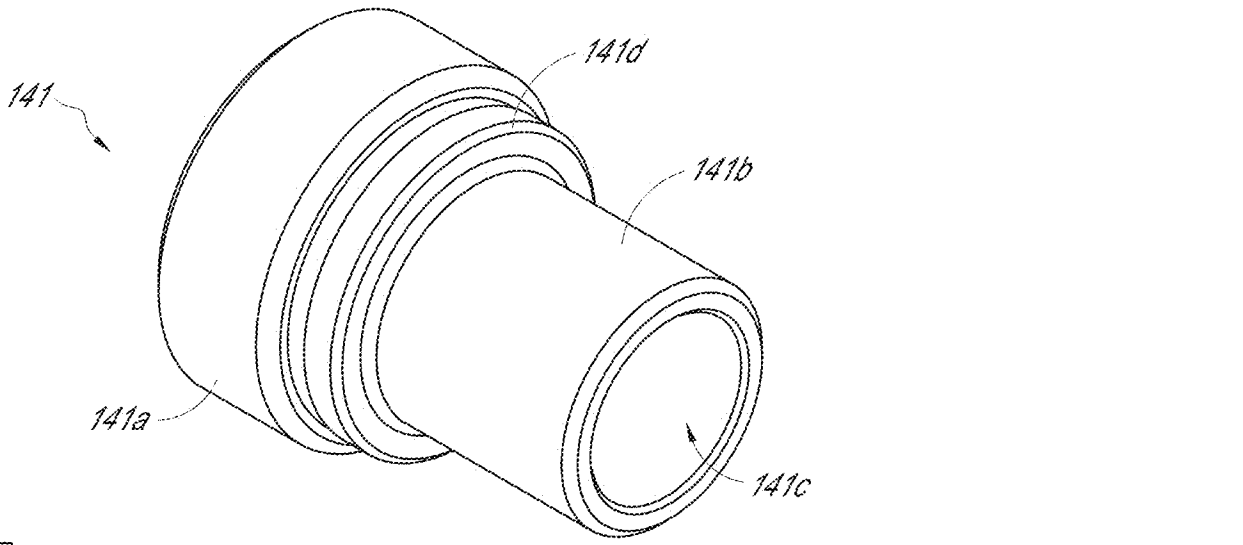
FIG. 19A is a perspective view of a shaft.
Figure 19C:
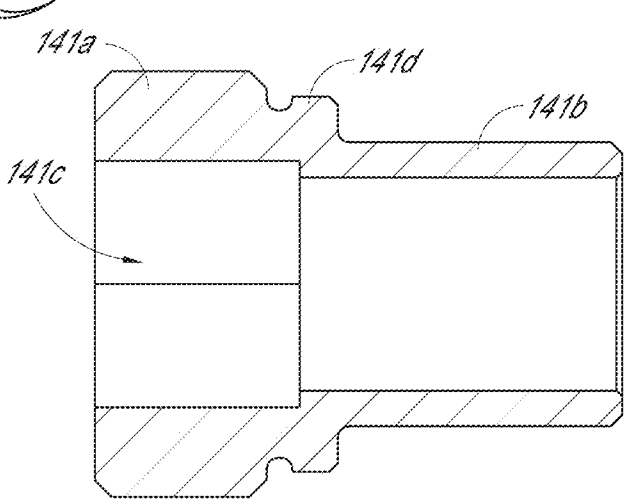
FIG. 19C is a section view taken along the line 19C-19C of FIG. 19B.
Figure 19B:
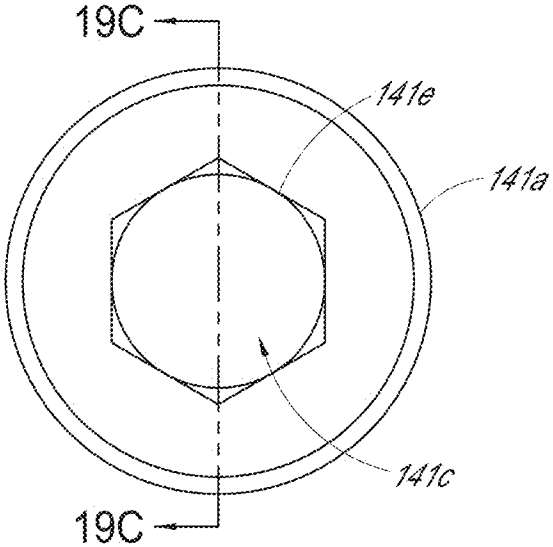
FIG. 19B is a top plan view of the shaft of FIG. 19A.

FIG. 19 illustrates the front shaft 141 which can be identical to the rear shaft 143. The front shaft 141 includes a threaded end 141*a* (not illustrated as threaded). The shaft 141 can include a cylindrical portion 141*b*. In certain implementations the cylindrical portion 141*b* can engage within the bearing 146 and/or within the bearing aperture 138 of the hanger 130 to provide at least one pivot location for the hanger 130 about the pivot axis 101.

The shaft 141 can include a key 141*e* in the threaded end 141*a*. In certain implementations the key 141*e* can be a hexagonal shape that can be used to allow for the rear shaft 143 to be installed with the truck 100 within the shaft apertures 117, 118 using a tool to tighten therein. Conventional skateboard tools can be used for this purpose (e.g. Allen wrenches and the like). In certain implementations a central aperture 141*c* extends through the shaft 141. The threaded end 141*a* can be engaged with the tapped inner surface 117*a*/118*a* of the front and rear shaft apertures 117, 118 to couple with the hanger 130 and base 110.

Figure 20:
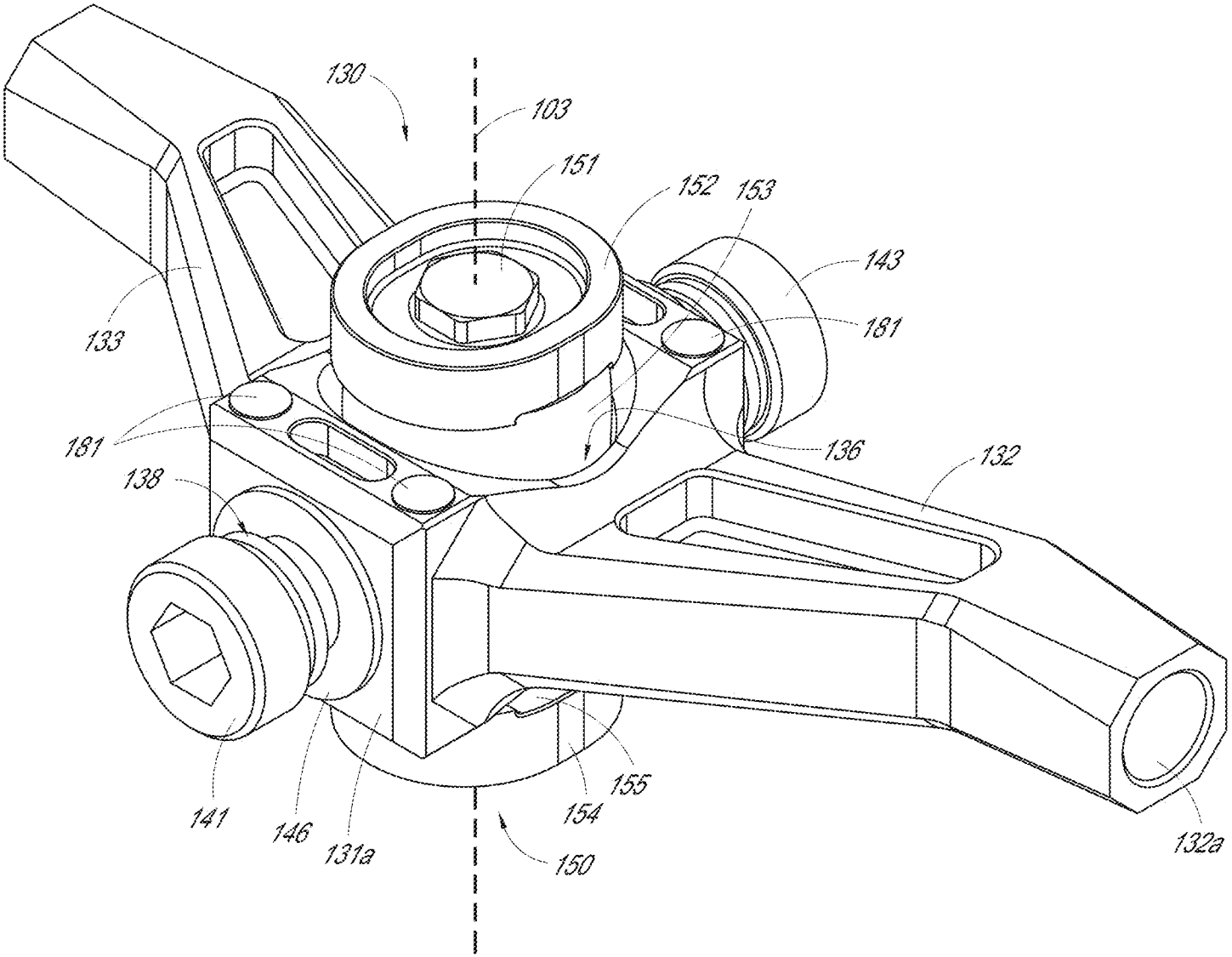
FIG. 20 is a perspective view of a hanger and compression assembly.

FIG. 20, shows a partially assembled view of the truck 100 showing the hanger 130 with the compression assembly 150 and the front and rear shafts 141, 143. The compression assembly 150 can be generally assembled along the compression axis 103 as described above. The front and rear shafts 141, 143 can be assembled with first and second ends 131*a*, 131*b* of the central portion 131 (e.g. within the bearings 146, 148 or the bearing apertures 138, 139).

Figure 21:
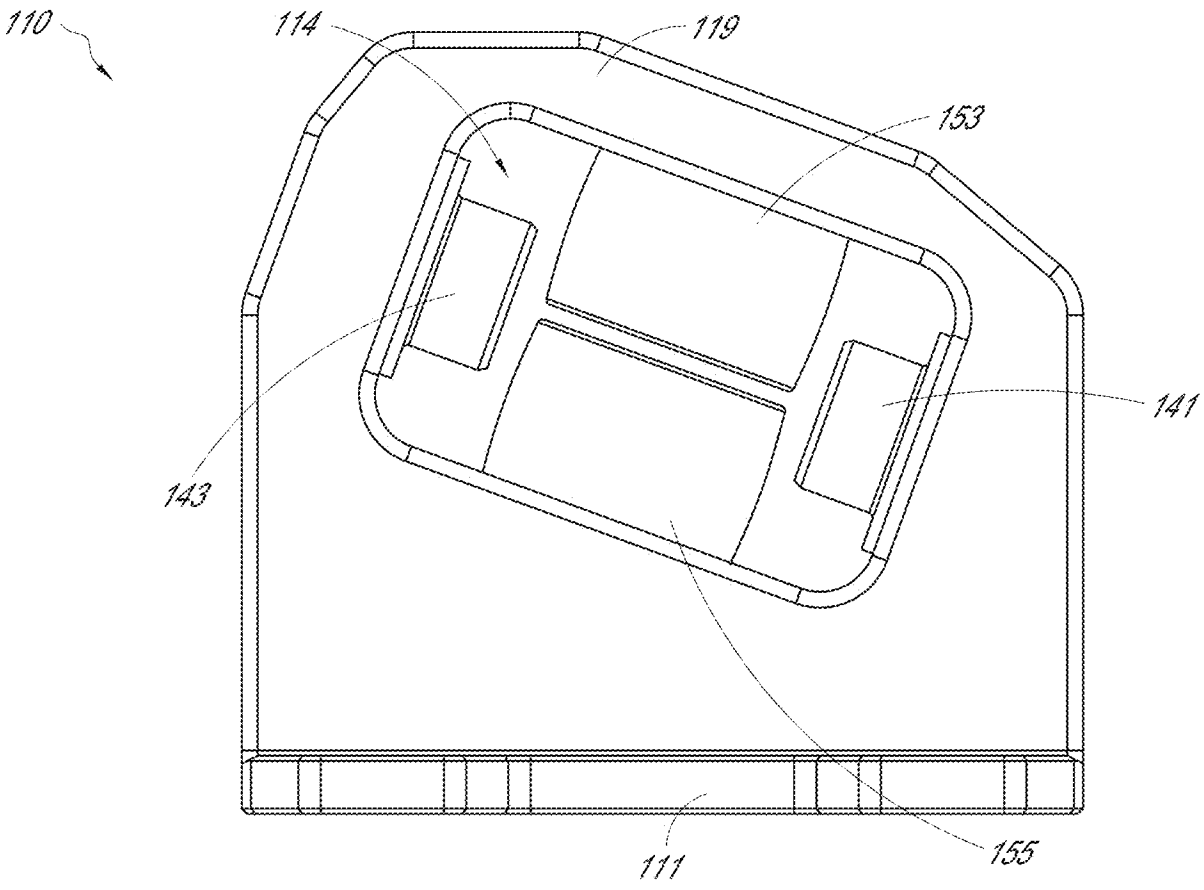
FIG. 21 is a side view of a base assembly.
Figure 22:
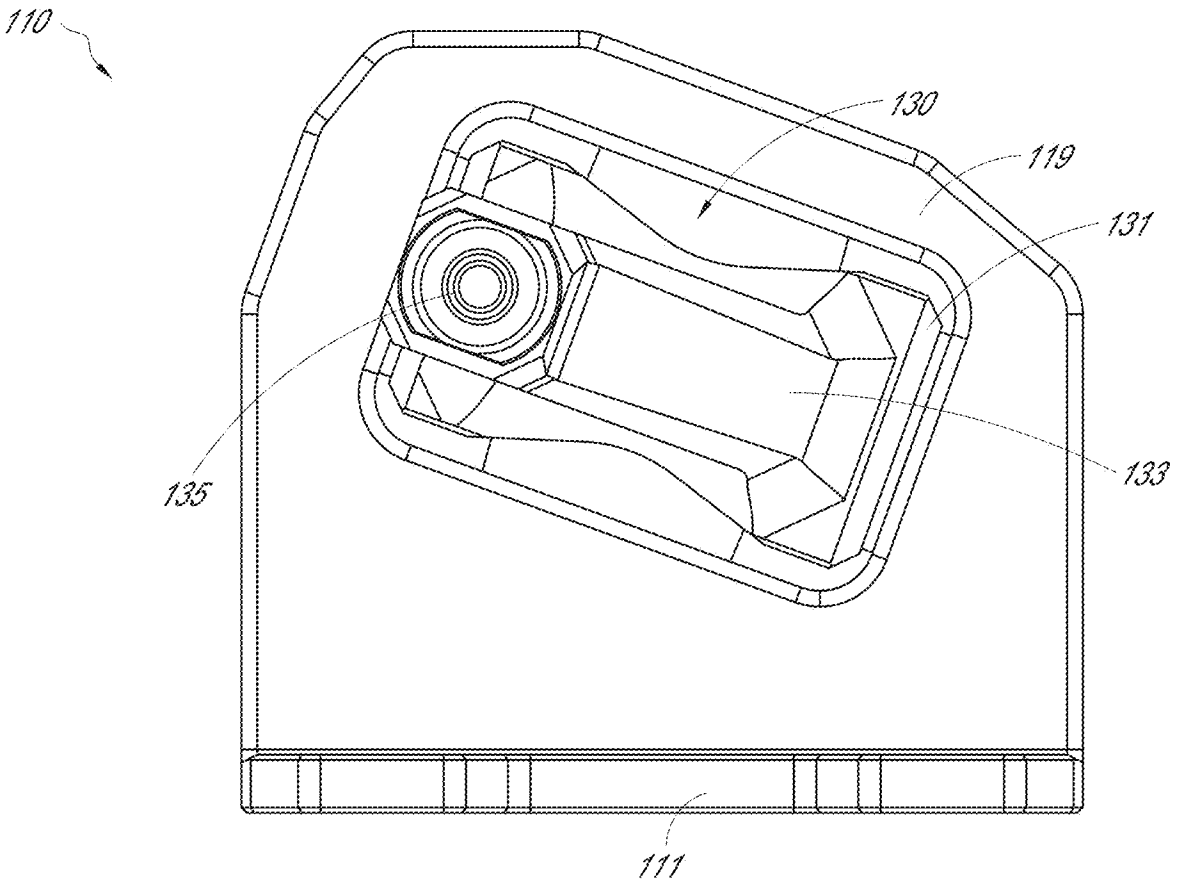
FIG. 22 is a side view of the truck of FIG. 2A.
Figure 23:
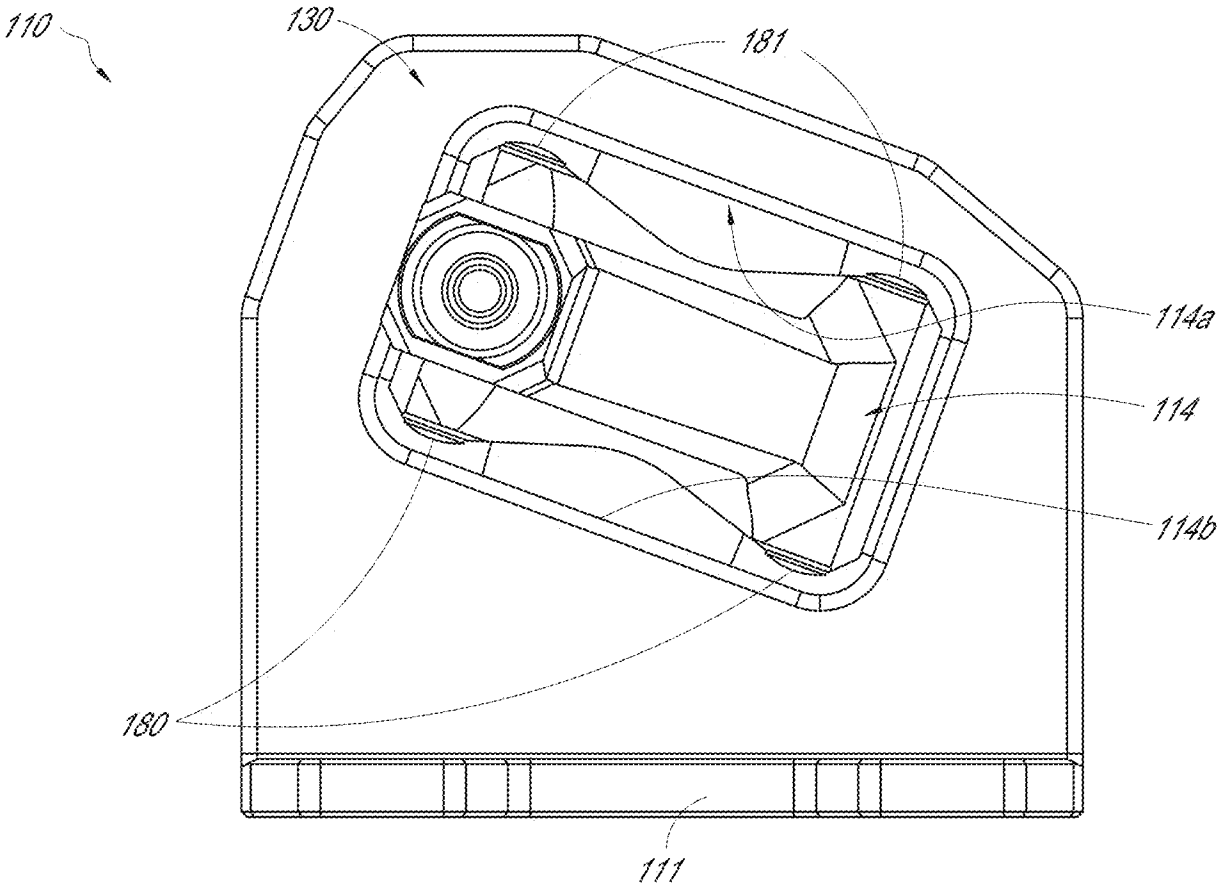
FIG. 23 is another side view of the truck of FIG. 2A.

FIG. 21 illustrates a partially assembled view of the base 110 with the lower and upper bushings 153, 155 and the front and rear shafts 141, 143. FIG. 22 shows the same view as FIG. 21 further adding the hanger 130 within the hanger aperture 114. As illustrated in FIG. 23, the hanger 130 can, in some implementations, include one or a plurality of limiters 181. The limiters 181 can be rubber, plastic, metal, or other material that are inserted into apertures of the hanger 130 and/or apertures within the base 110 (e.g. within the inner surfaces of the hanger aperture 114, such as in the upper surface 114*b* or lower surface 114*a*). The limiters 181 can be inserted by a user who desires to further limit rotation of the hanger 130 with respect to the base 110. Specifically, this can be done to limit the angles 123, 124 that the hanger can rotate with respect to the base. Where a hard material is used, the limiters 181 can provide a hard stop. Where a softer or resilient material (e.g., springs or rubber) is used, the limiters 181 can be used to provide for a smoother stop for the skateboard using the truck 100.

Figure 24:
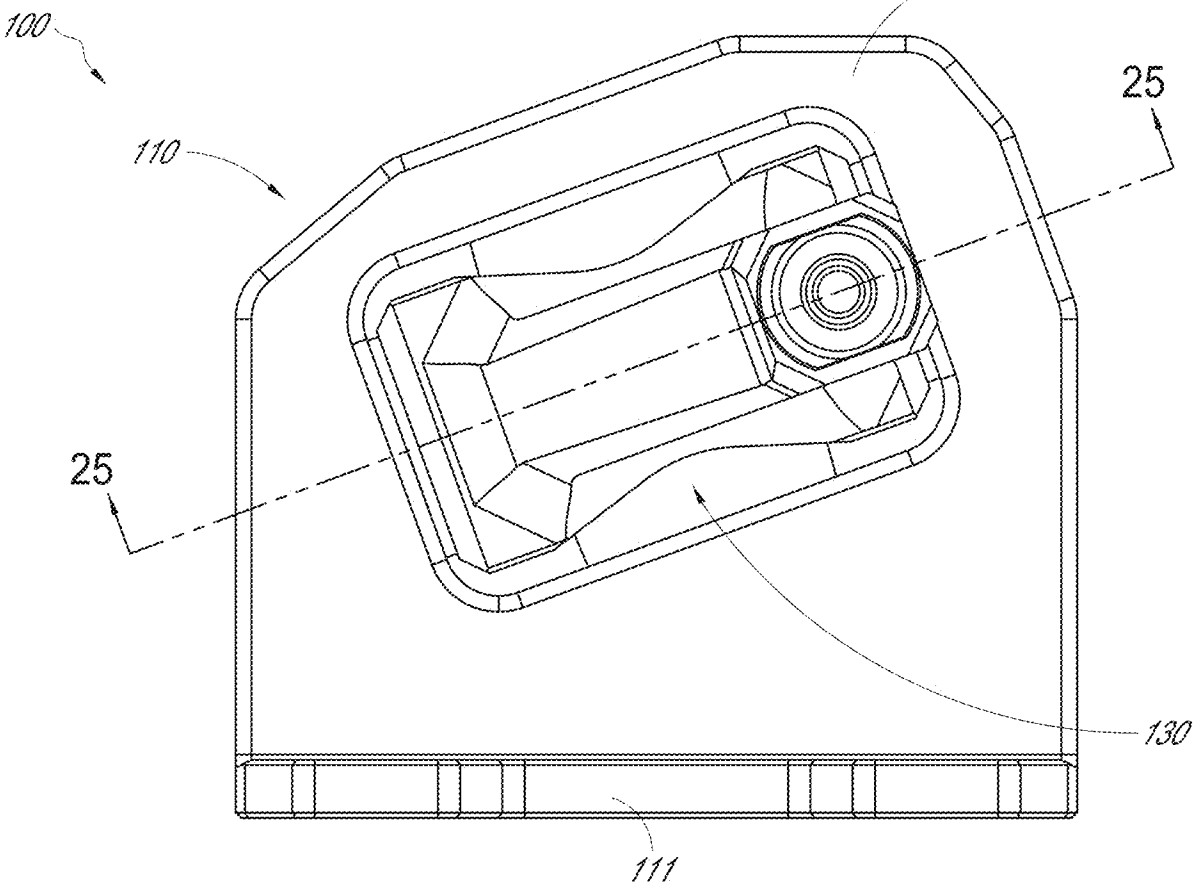
FIG. 24 is an opposite side view of the truck of FIG. 2A.
Figure 25:
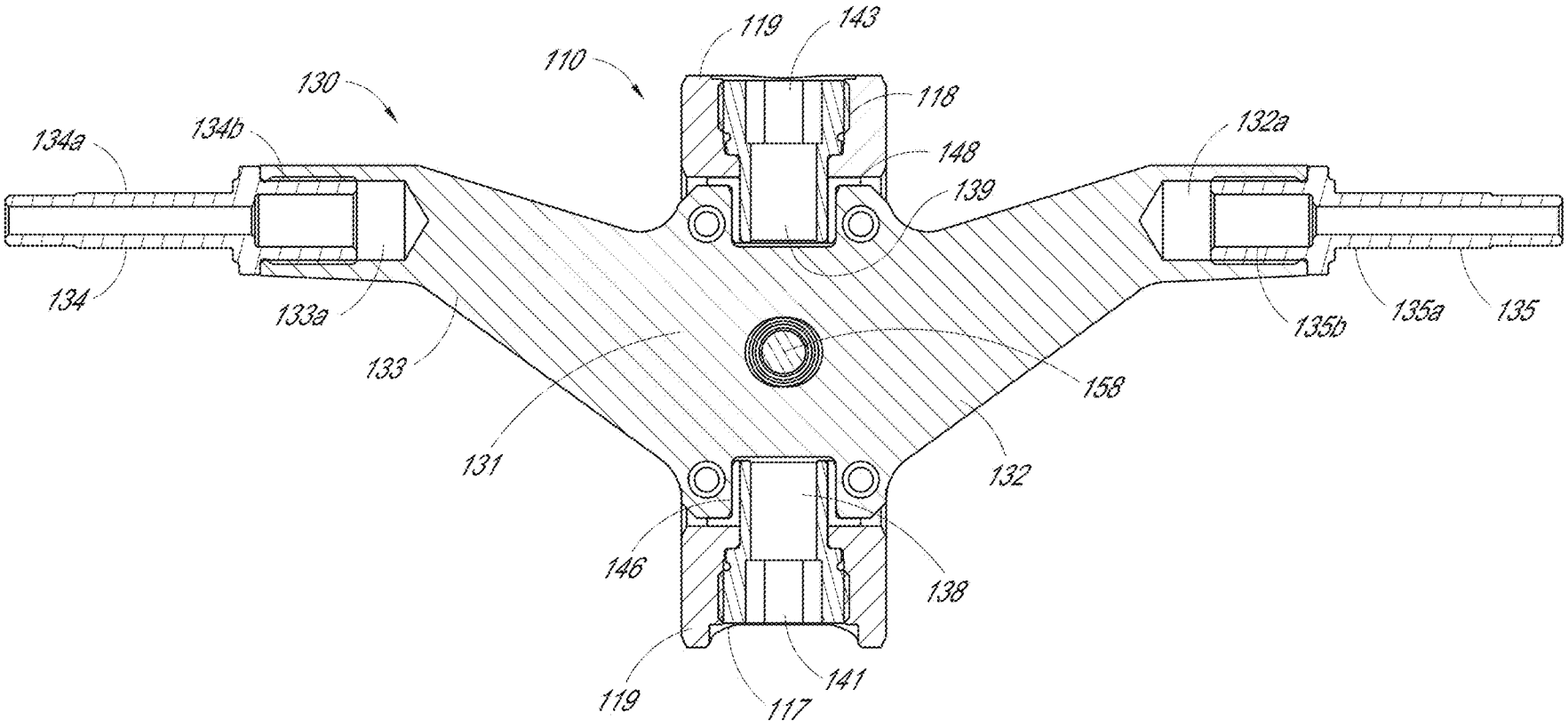
FIG. 25 is a section view taken along the line 25-25 in FIG. 24.

FIGS. 24-25 illustrate a section view of the truck 100 taken along the pivot axis 101 and showing the assembly of the components discussed above.

Figure 26:
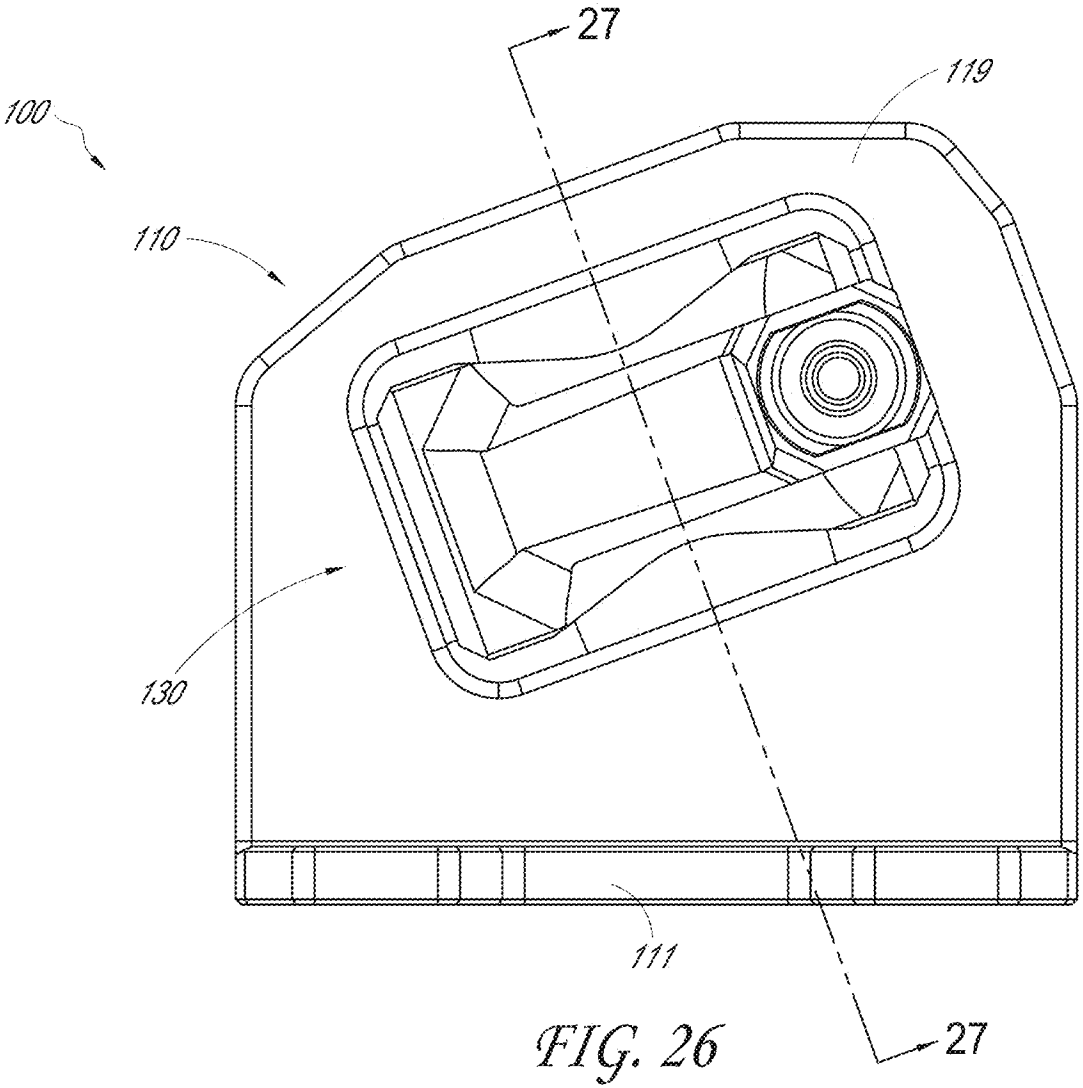
FIG. 26 is a side view of the truck of FIG. 2A.
Figure 27:
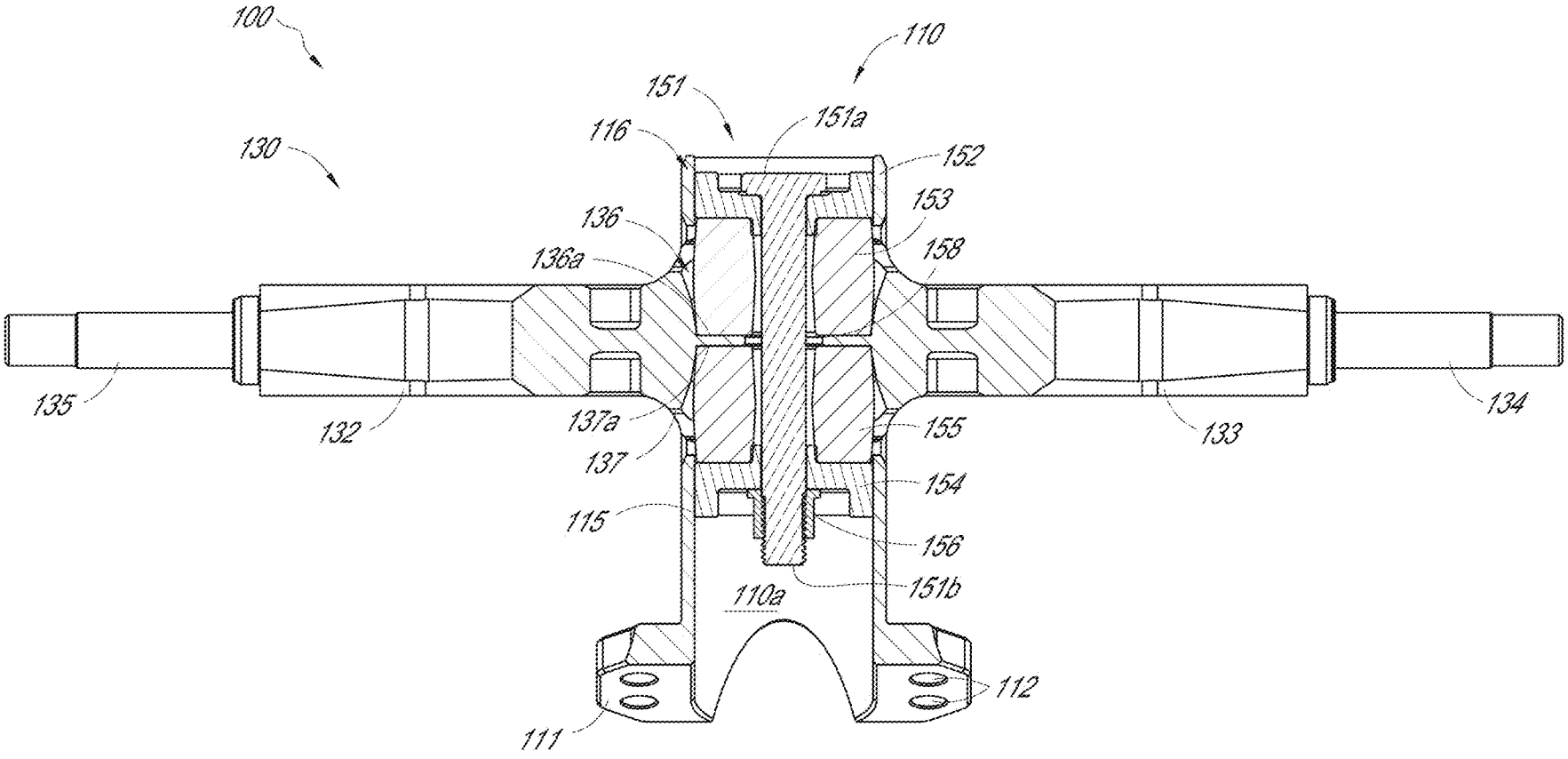
FIG. 27 is a section view taken along the line 27-27 of FIG. 26.

FIGS. 26-27 illustrate a section view of the truck 100 taken along the compression axis 103 and showing the assembly of the components discussed above.

Figure 28:
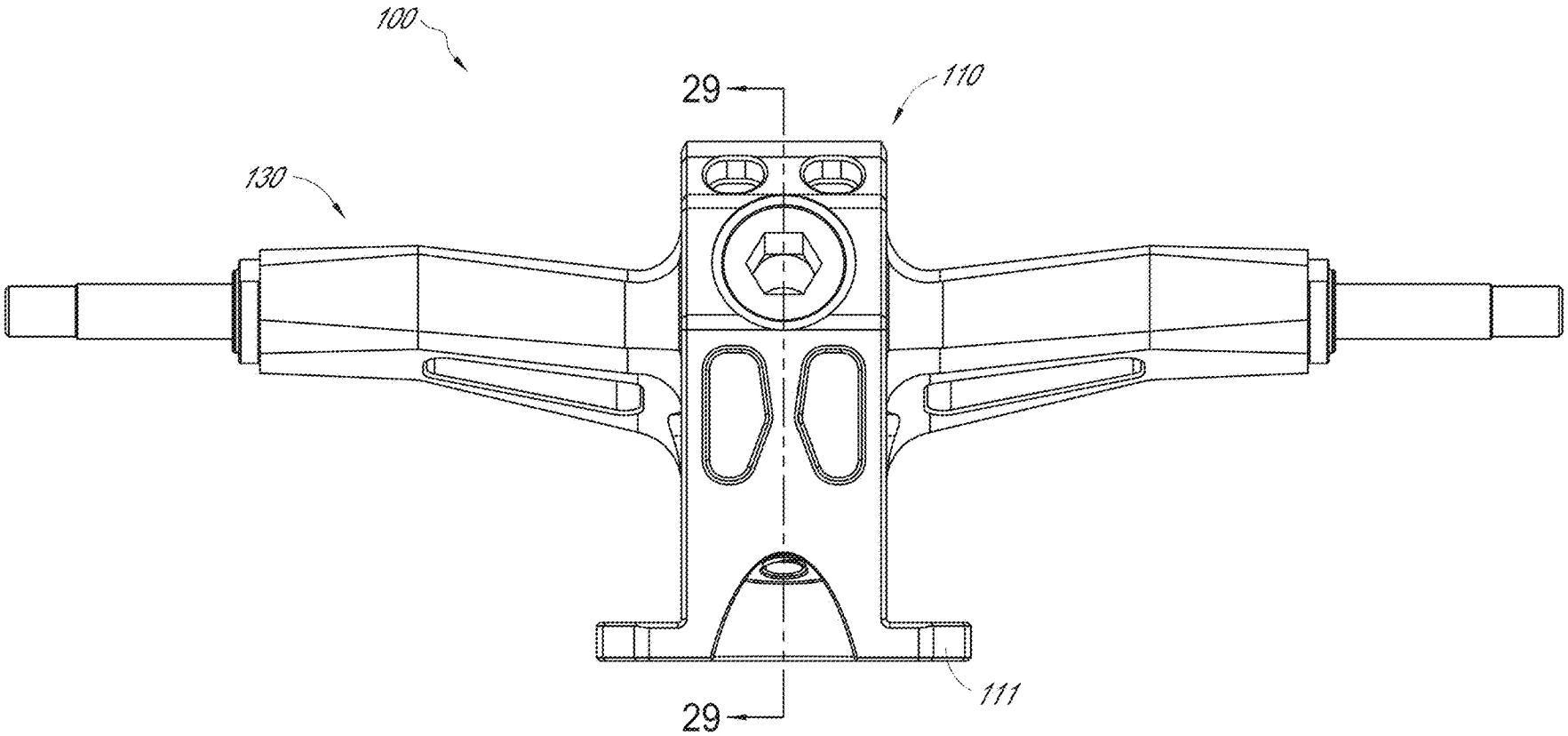
FIG. 28 is a rear view of the truck of FIG. 2A.
Figure 29:
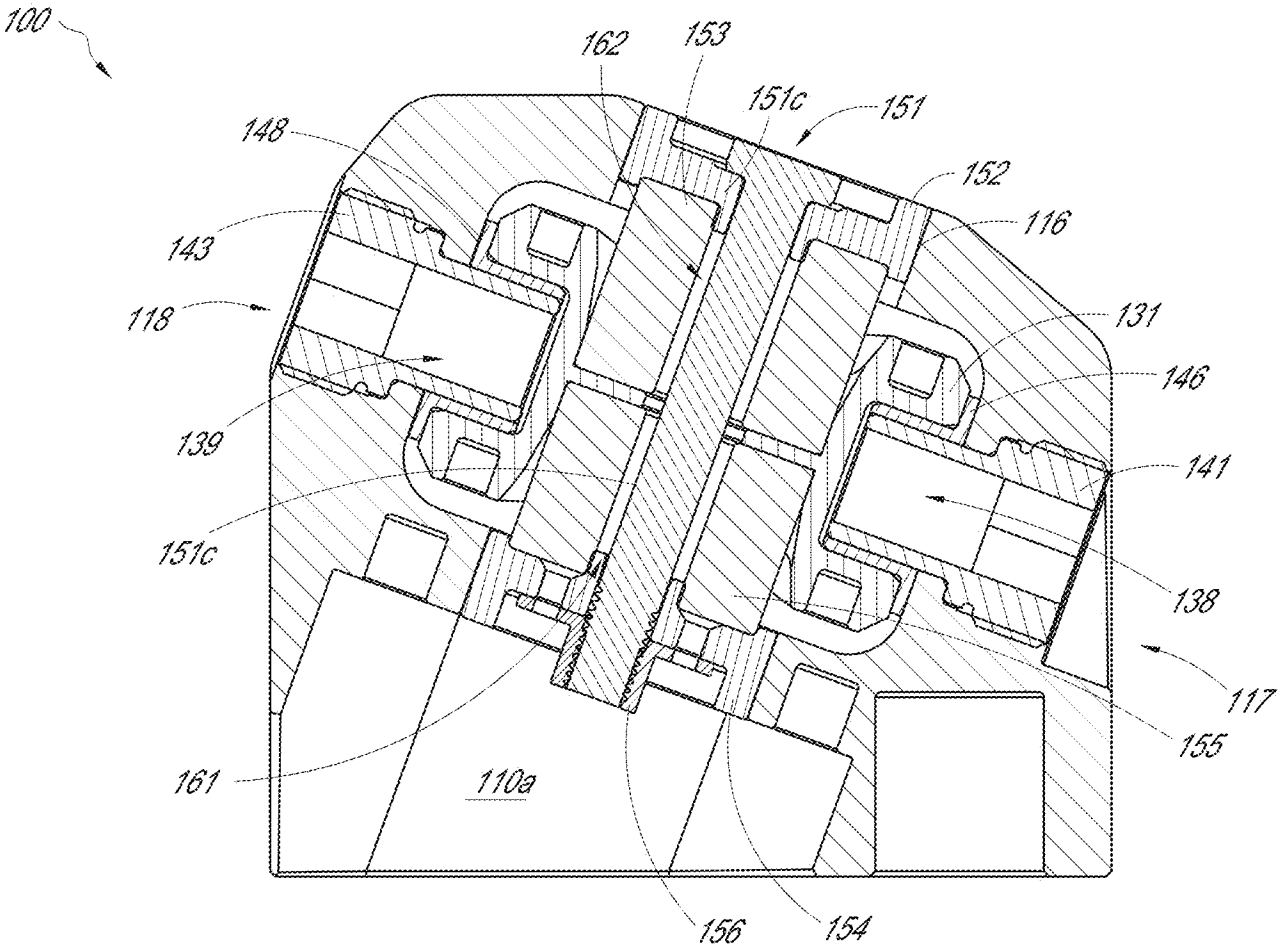
FIG. 29 is a section view taken along the line 29-29 of FIG. 28.

FIGS. 28-29 illustrate a section view taken along the line 29-29 in FIG. 28. As shown in FIG. 29, in certain implementations (e.g., depending on the state of compression of the compression assembly 150) a space 161 can exist between the upper bushing 155 (e.g., the inner surface of the aperture) and the compression bolt 151 (e.g., the outer cylindrical surface 151*c*). Similarly a space 162 can exist between the lower bushing 153 (e.g., the inner surface of the aperture) and the compression bolt 151 (e.g., surface 151*c*).

Figure 30:
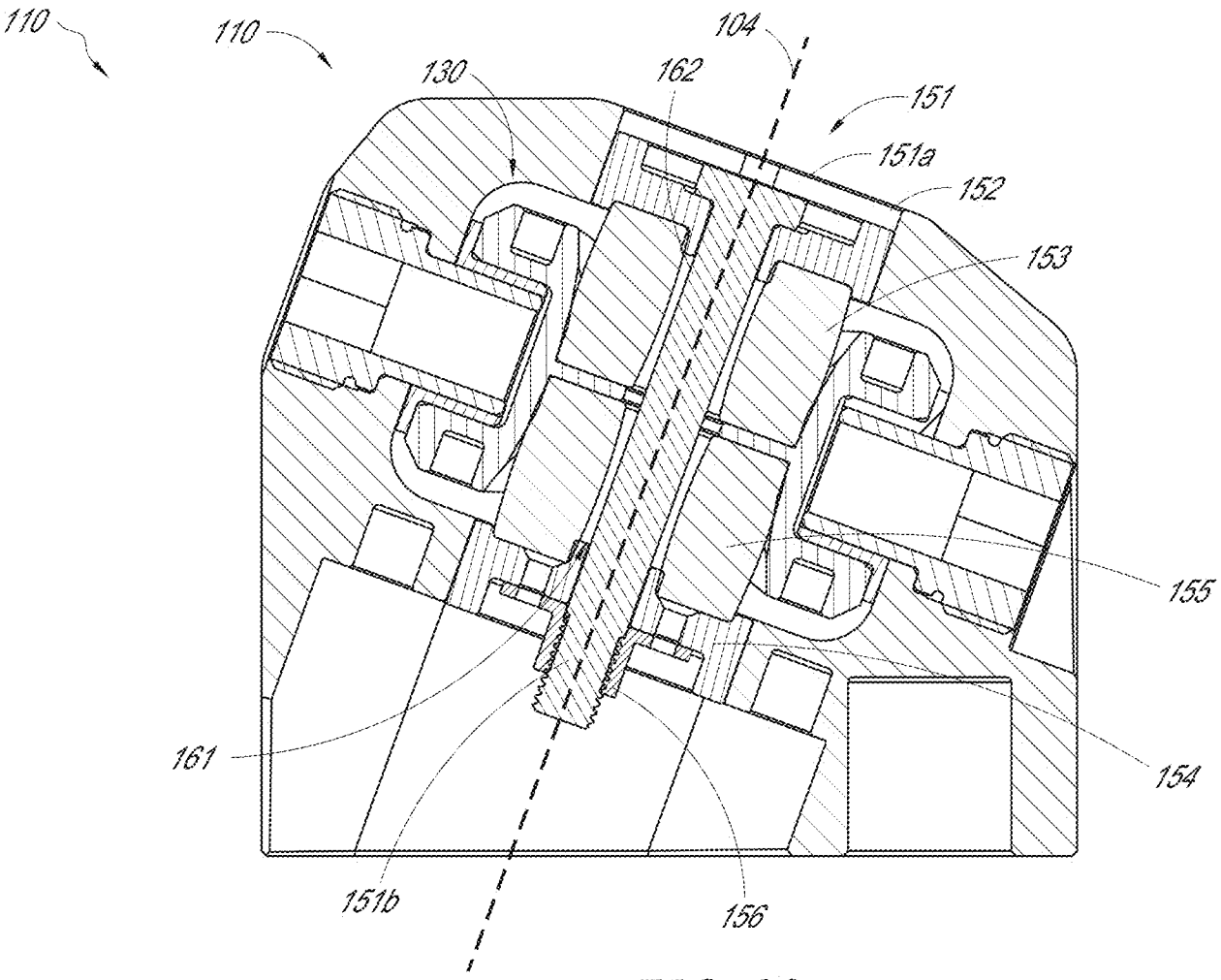
FIG. 30 is another configuration of the cross-section of FIG. 29.

In certain implementations, as shown in FIG. 30 in a compressed state, the upper and lower bushings 153, 155 can deform and begin to fill the spaces 161, 162. As the bushings 153, 155 engage with the compression bolt 151 more or less compression force can be effected based on tightening of the compression bolt 151. This can affect the overall stiffness of the roll-resistance of the hanger 130 with respect to the base 110. The bushings 153, 155 can be generally incompressible (i.e., at the forces that are generally present in the context of the truck 100). As tension forces are increased on the compression bolt 151, the bushings will deform and create a stiffer roll-resistance, which is at least in part determined by the amount and deformation of the bushings 153, 155 allowed by the geometry of the truck 100.

Figure 31:
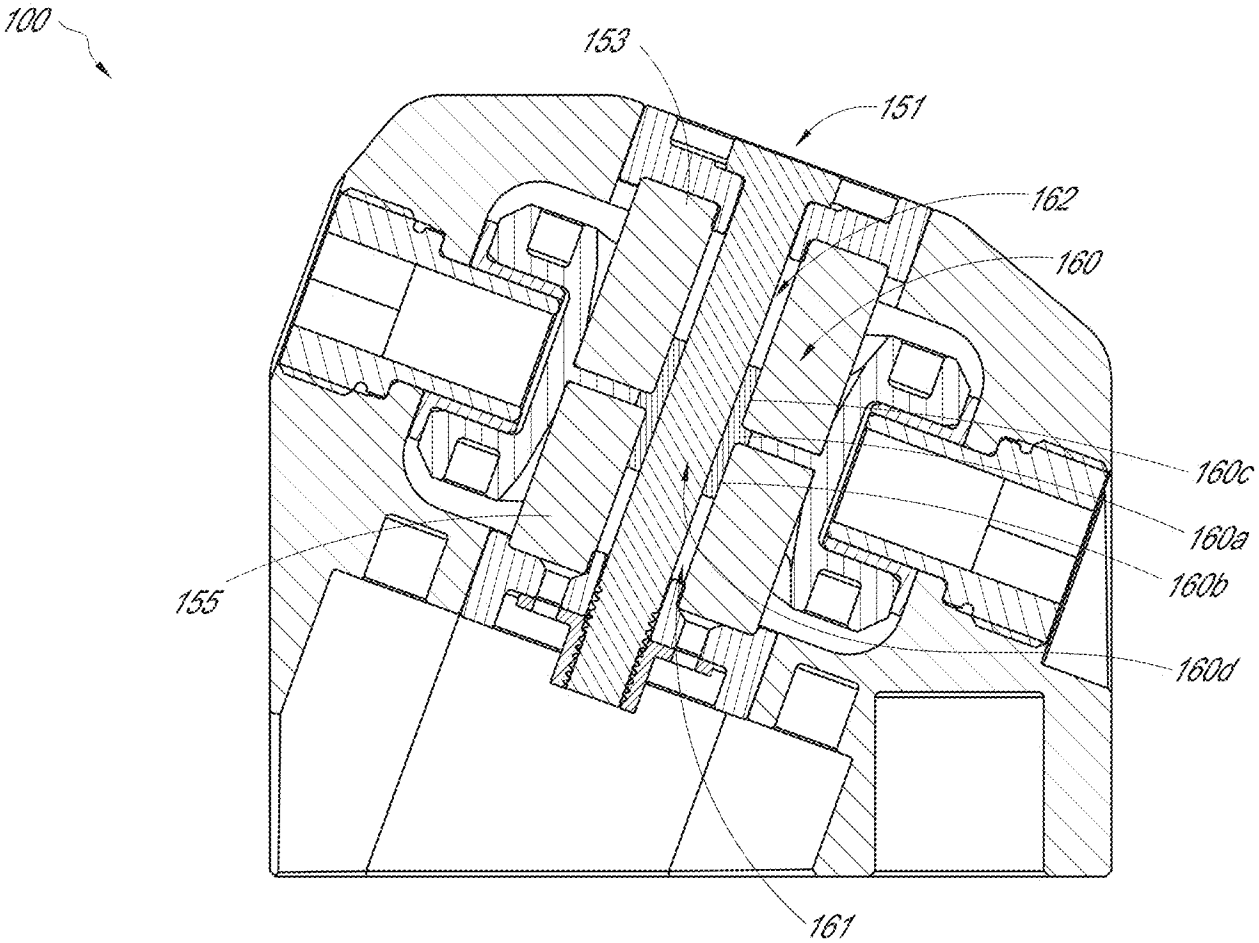
FIG. 31 is another possible configuration of the truck of FIG. 29.
Figure 32:
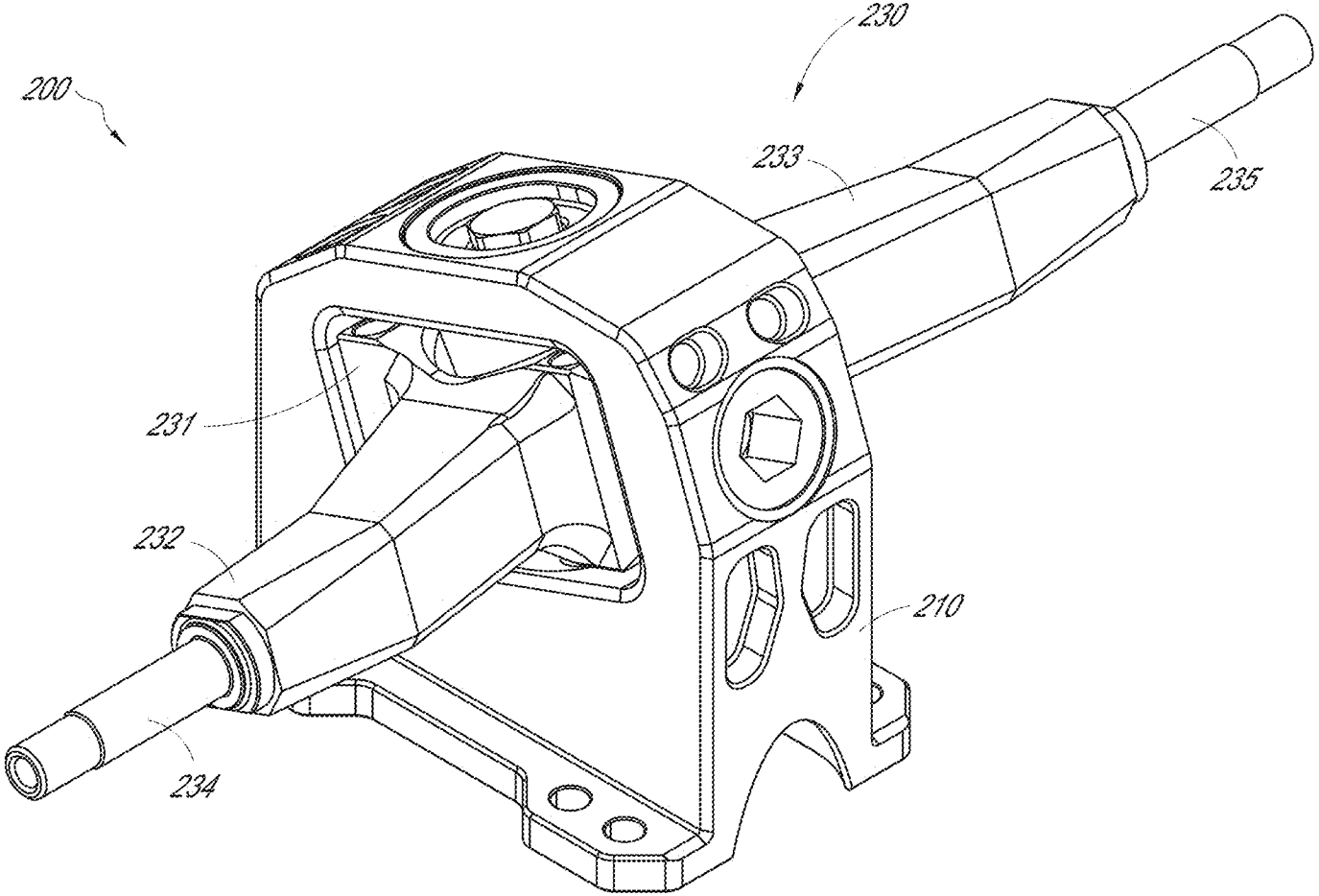
FIG. 32 is a perspective view of a second embodiment of a truck.

As shown in FIG. 31, the rollbar 160, when inserted into the compression assembly 150, fills portions of either or both the spaces 161 and 162. Thus, by using the cylindrical portions 160*a*, 160*b* to fully or partially fill the spaces 161, 162, the roll-resistance can be customized to a user's desires (e.g., by constraining deformation of the bushings). The central flange 160*d* can help to maintain the rollbar between the first and upper bushings 153, 155.

Figure 33:
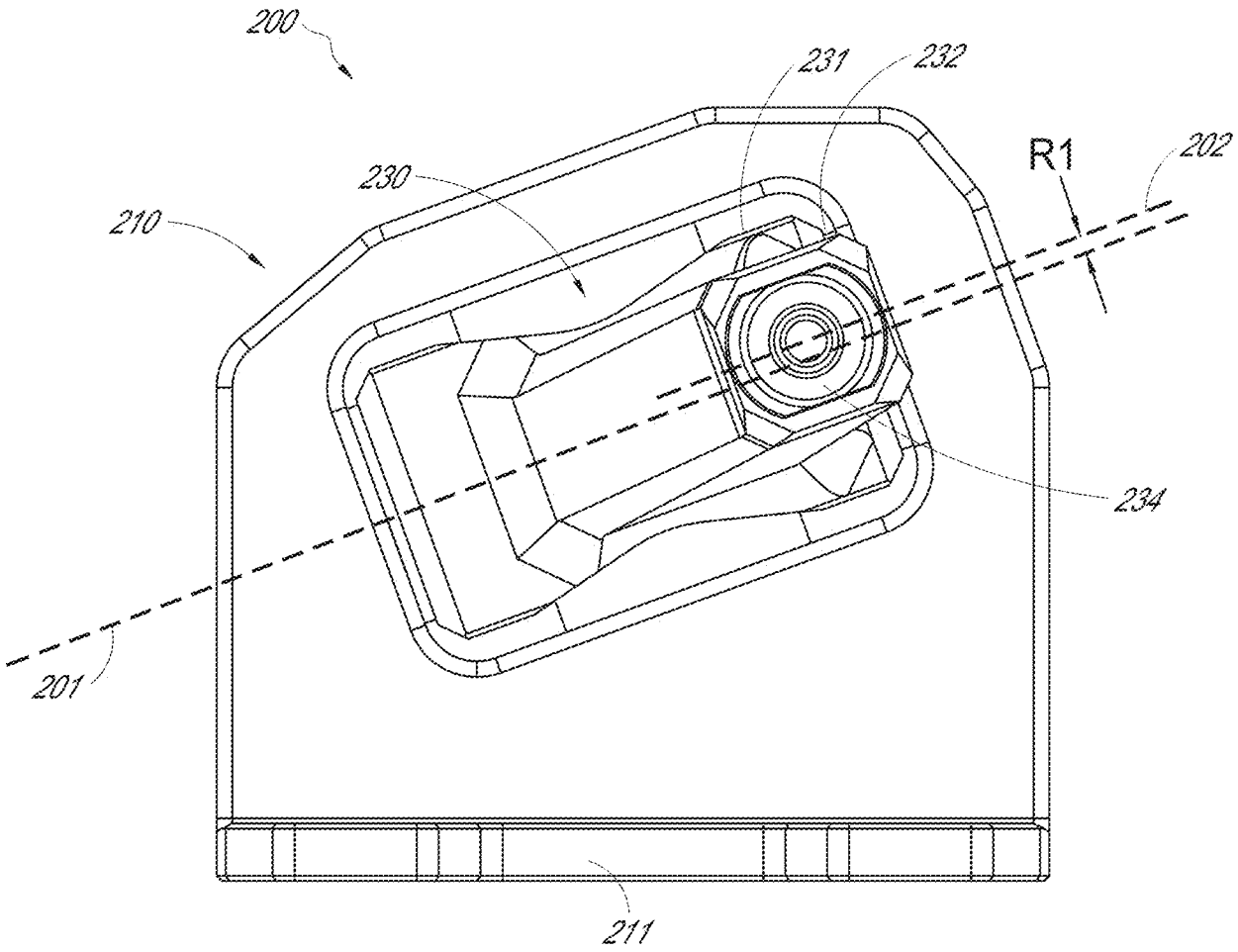
FIG. 33 is a side view of the truck of FIG. 32.
Figure 34:
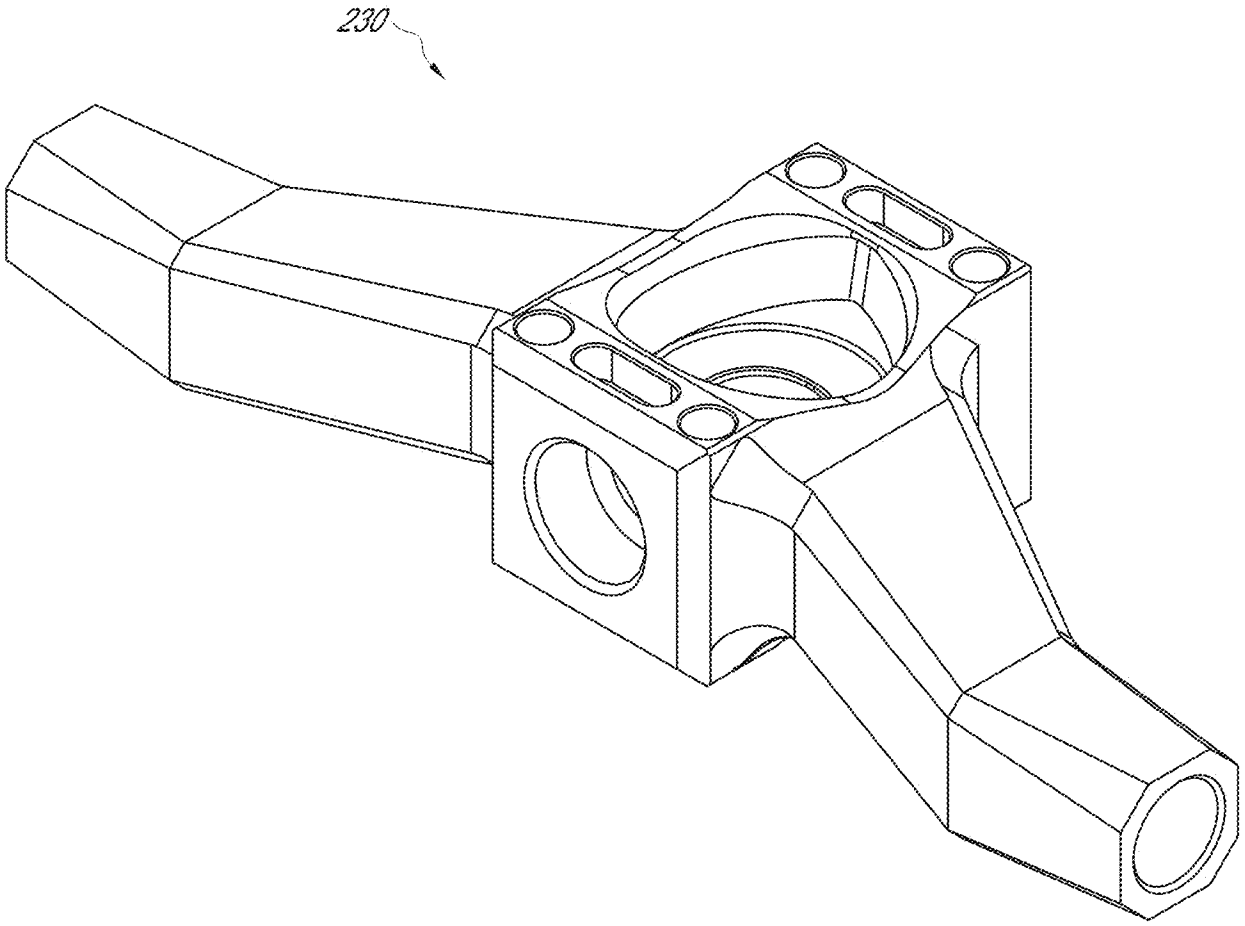
FIG. 34 is a hanger of the truck of FIG. 32.
Figure 35A:
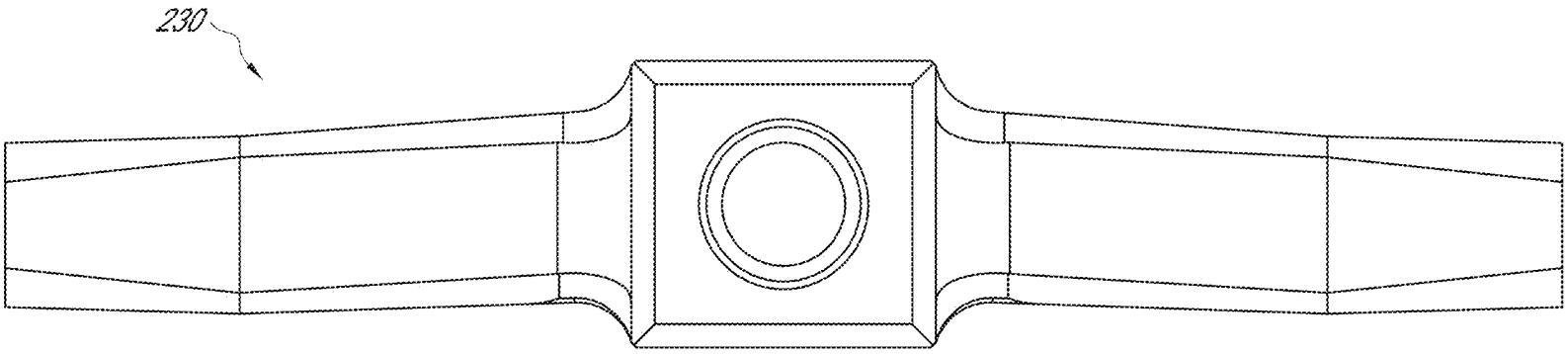
FIG. 35A is a bottom view of the hanger of FIG. 34.
Figure 35B:
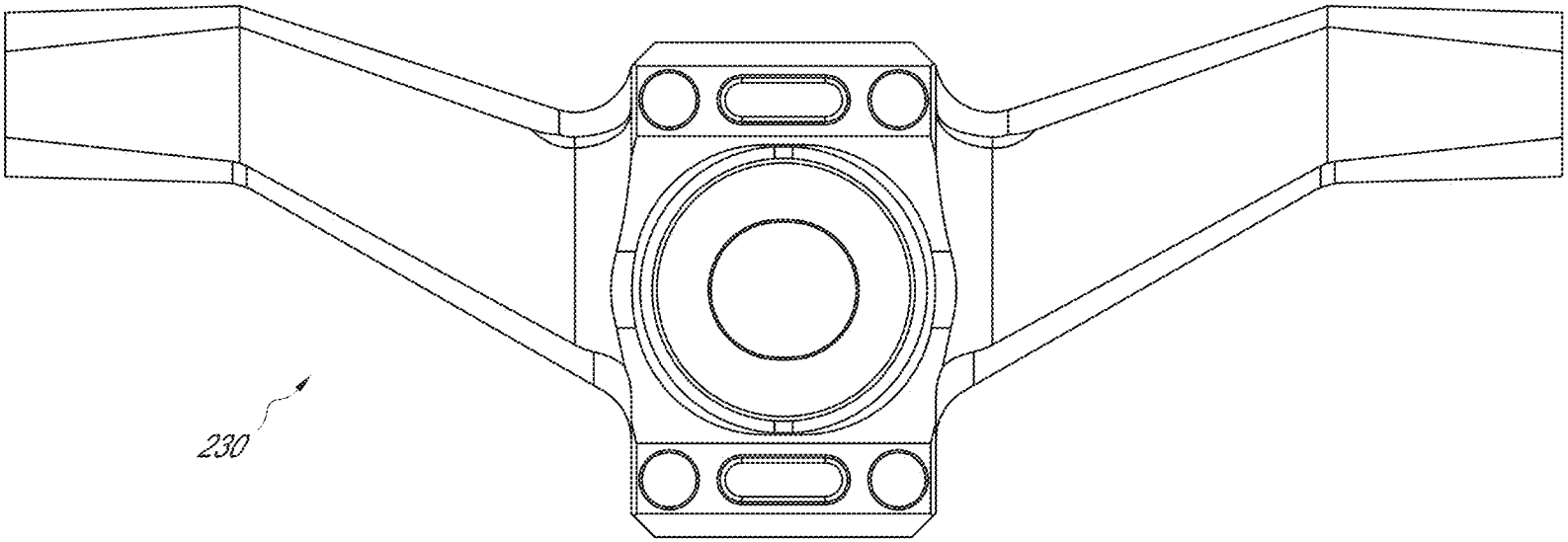
FIG. 35B is a back view of the hanger of FIG. 34.
Figure 36:
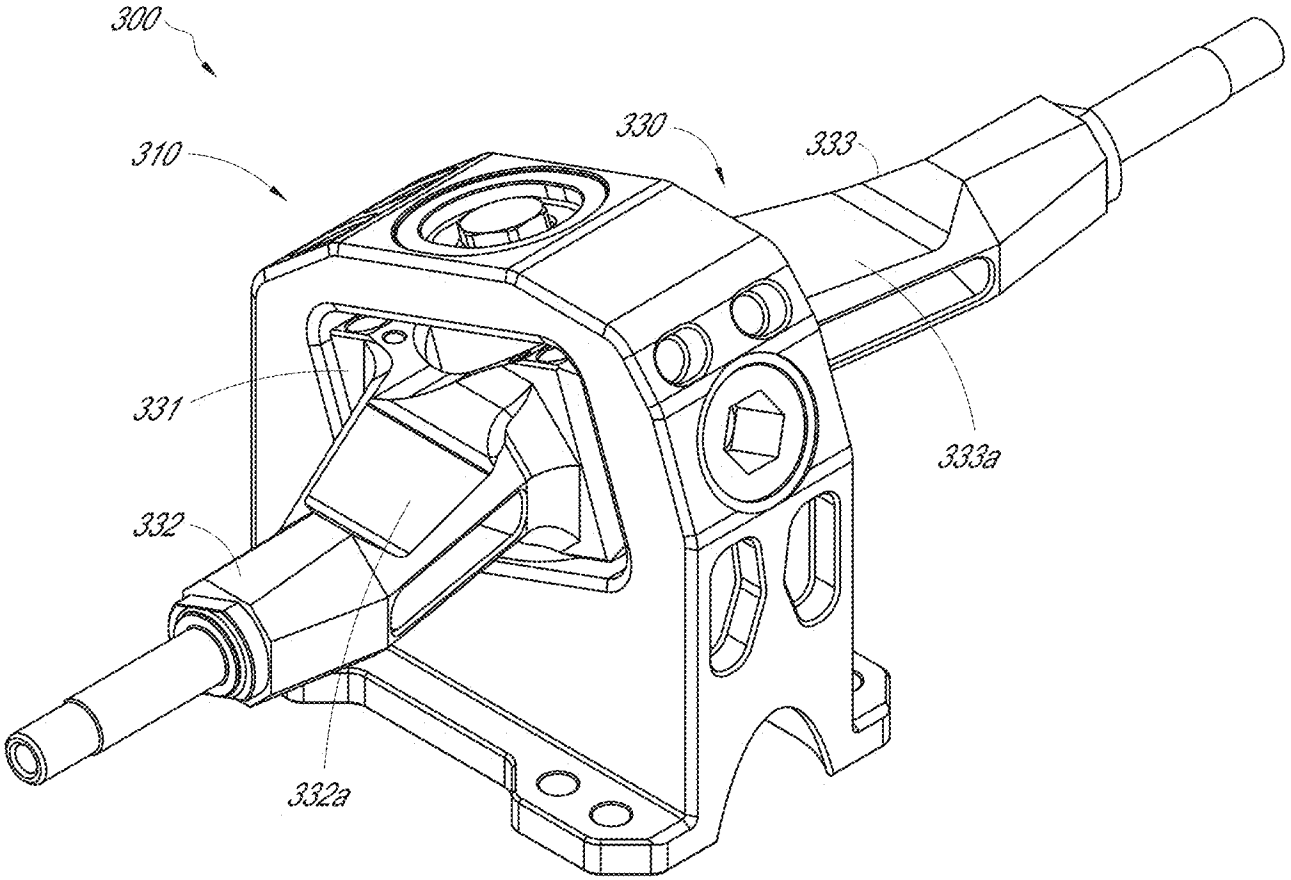
FIG. 36 is another embodiment of a truck
Figure 37:
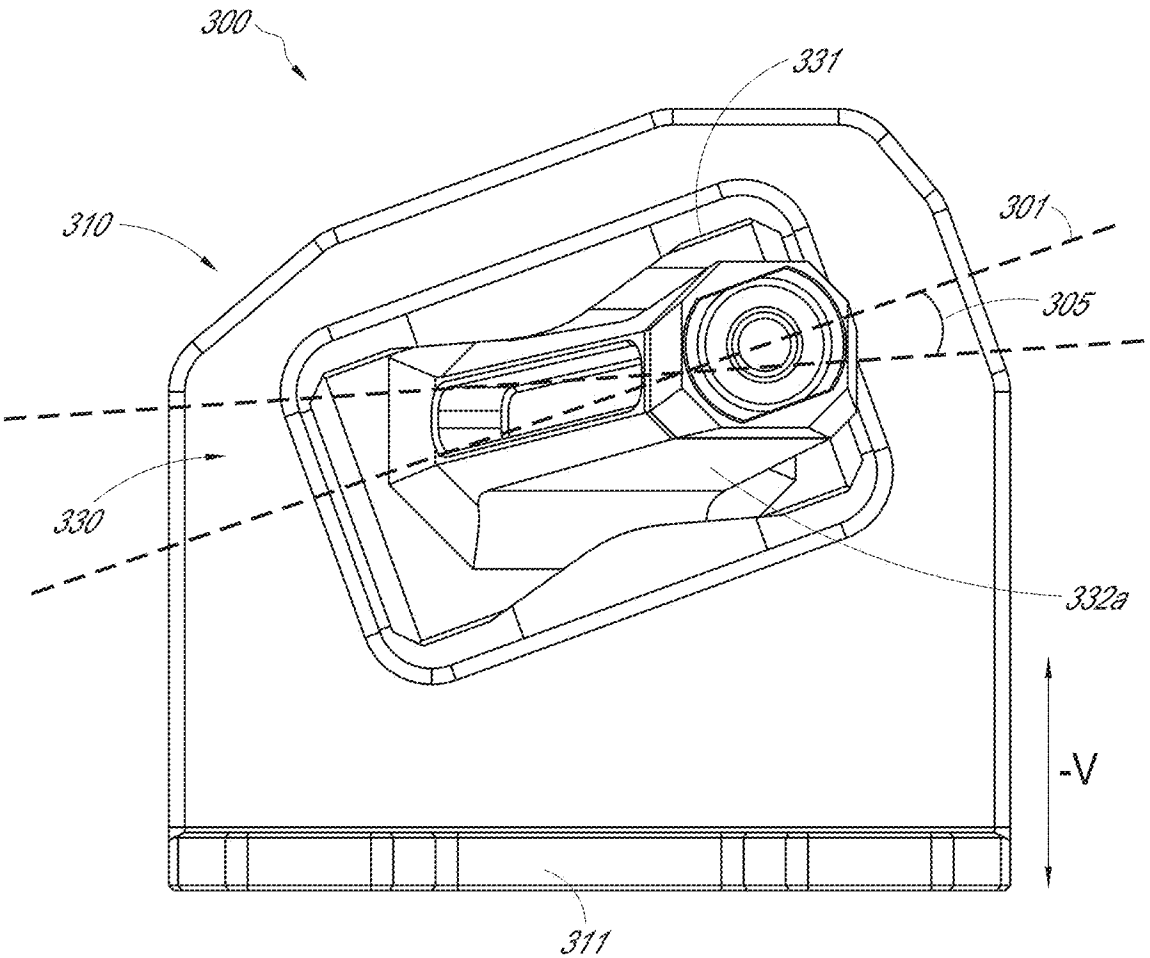
FIG. 37 is a side view of the truck of FIG. 36.
Figure 38:
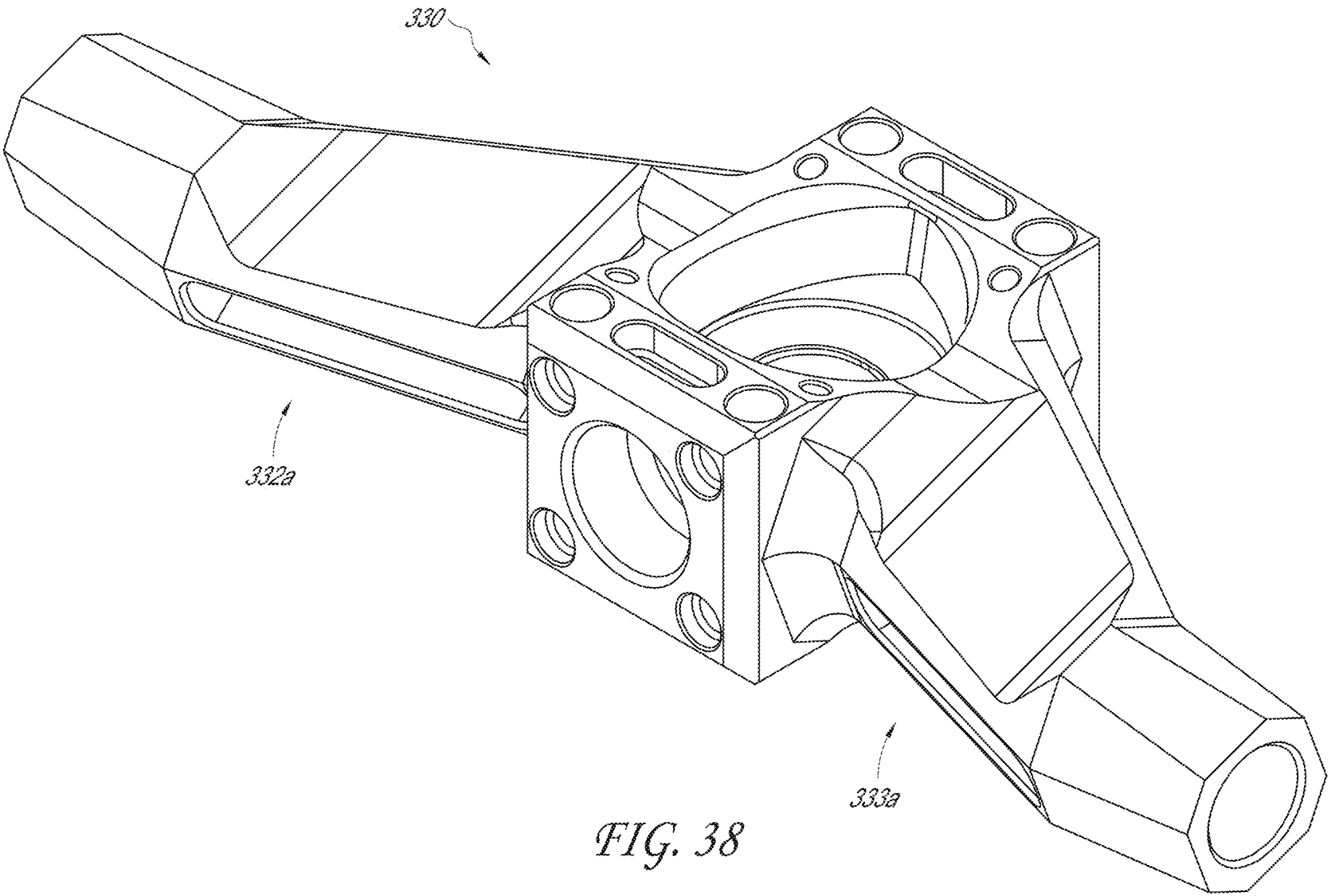
FIG. 38 is a perspective view of a hanger of the truck of FIG. 36.
Figure 39:
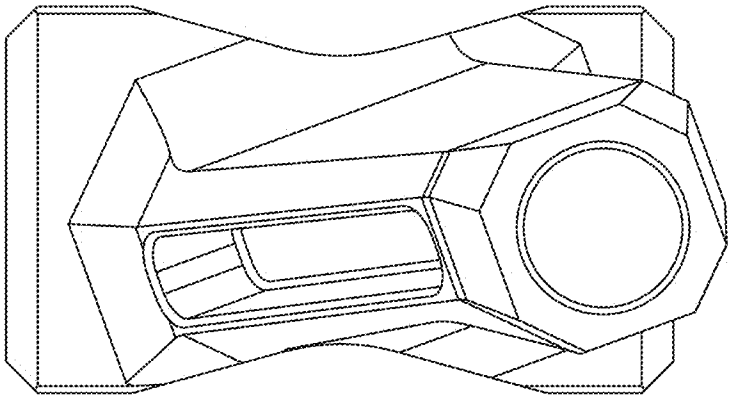
FIG. 39 is a side view of the hanger of FIG. 38.

FIGS. 32-35 illustrate a second truck 200. The truck 200 includes a base 210 and a hanger 230. In most respects, the truck 200 operates in the same manner and includes the same components as the truck 100 with the differences disclosed herein. As illustrated in FIG. 33, a pivot axis 201 extends through the base 210 and the hanger 230. The axles 234 and 235 however are aligned offset from the pivot axis 201 by a rake distance R1.

FIGS. 36-39 illustrate a third truck 300. The truck 300 includes a base 310 and a hanger 330. Except for the aspects disclosed herein, the truck 300 operates identical to and has the same components as the truck 100. The hanger 330 includes first and second wings, 332, 333 connected to a central portion 331. Each of the first and second wings 332, 333 include a length (e.g., angled sections 332*a*, 333*a*) that is generally rectangular in cross-section. The rectangular cross-sections of the angled sections 332*a*, 333*a* are angled with respect to the central portion 331. The central portion 331 is generally parallel with a pivot axis 301 (e.g., at angle 305). The angled sections 332*a*, 333*a* of the left and right wings 332*a*, 333*a* are at an angle 302 with respect to the pivot axis 301. The angled sections 332*a*, 333*a* can be generally parallel with the flange 311 (e.g. the angled sections 332*a*, 333*a* are generally parallel with the deck or the ground).

In the implementation of the hanger 330 (e.g., with sections 332*a*, 333*a*), the first and second wings 332, 333 are allowed to flex vertically to provide a suspension action for the user on the deck. Aligning the angled sections 332*a*, 333*a* with the flange 311 makes the hanger 330 more compliant in the vertical direction.

Figure 40:
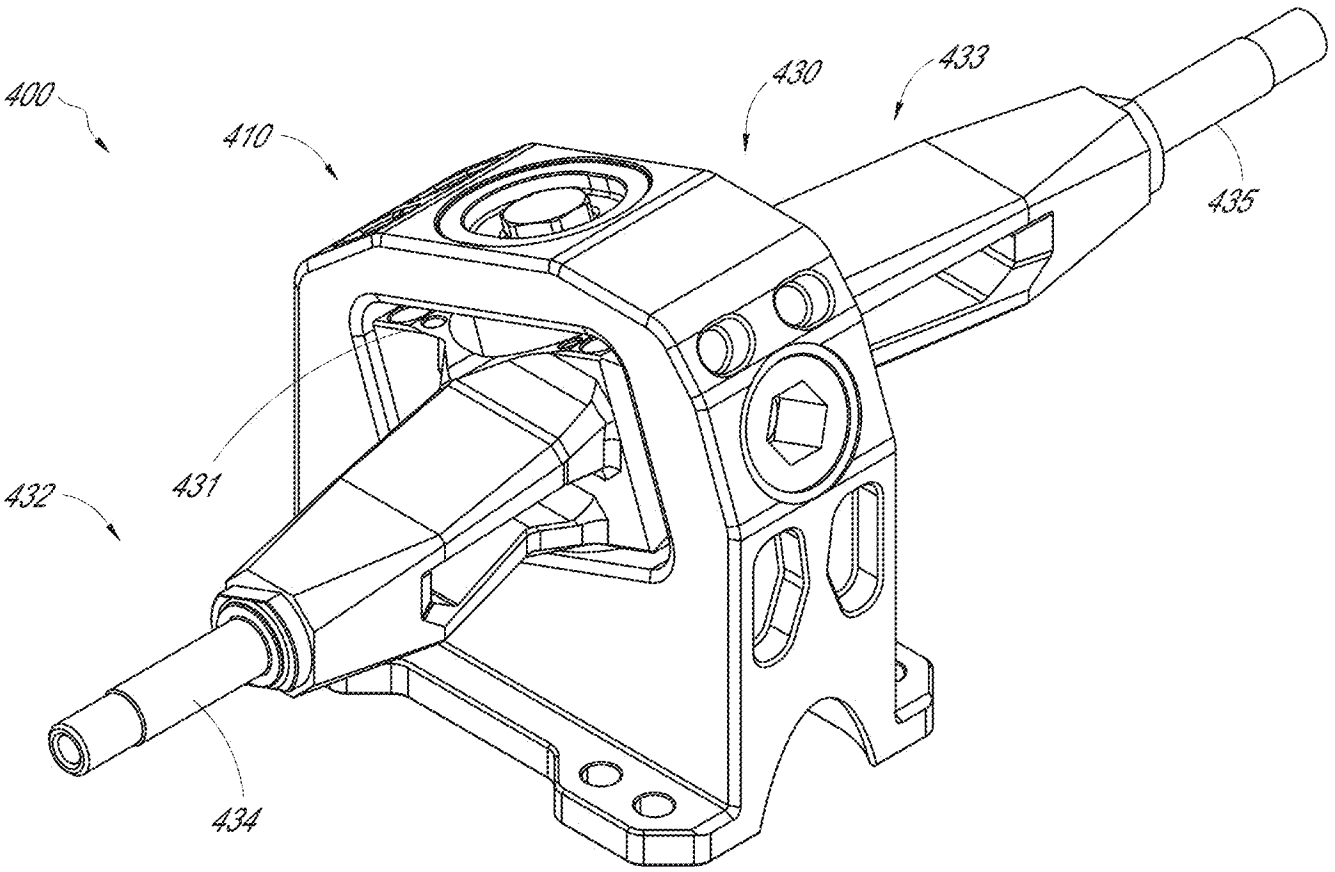
FIG. 40 is a fourth embodiment of a truck.
Figure 41:
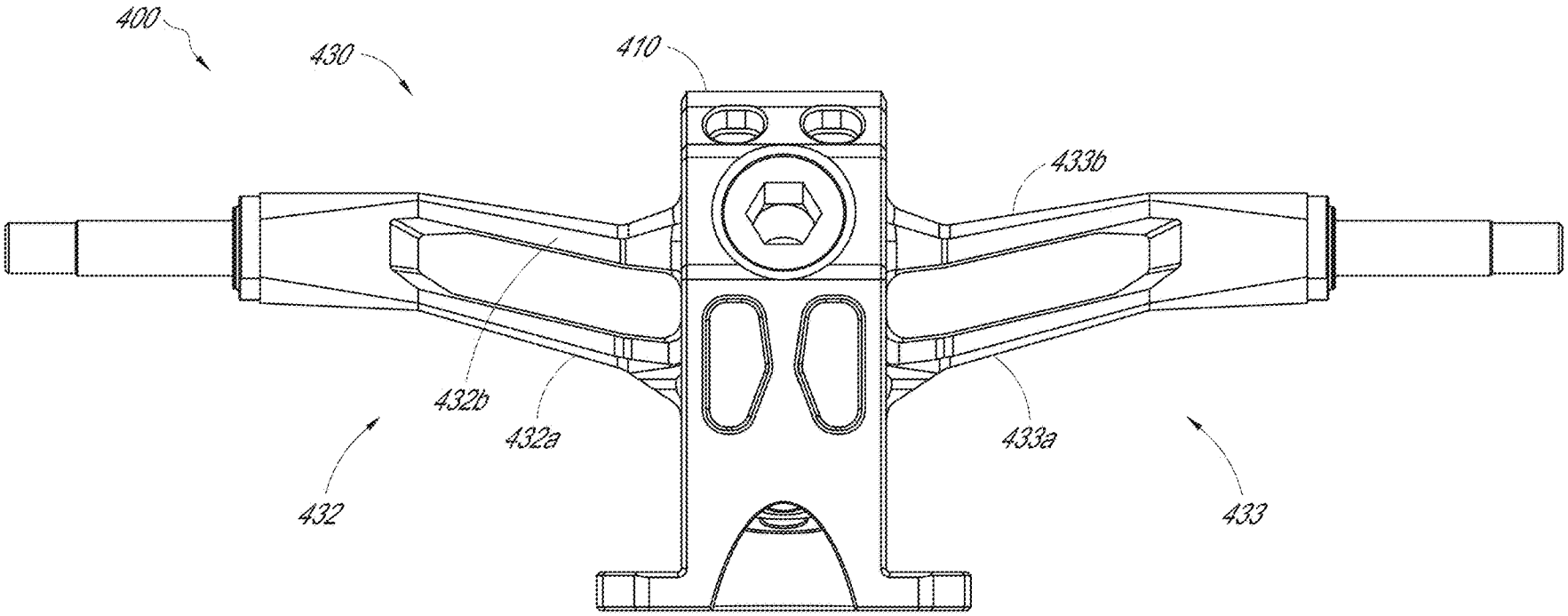
FIG. 41 is a rear view of the truck of FIG. 40.
Figure 42:
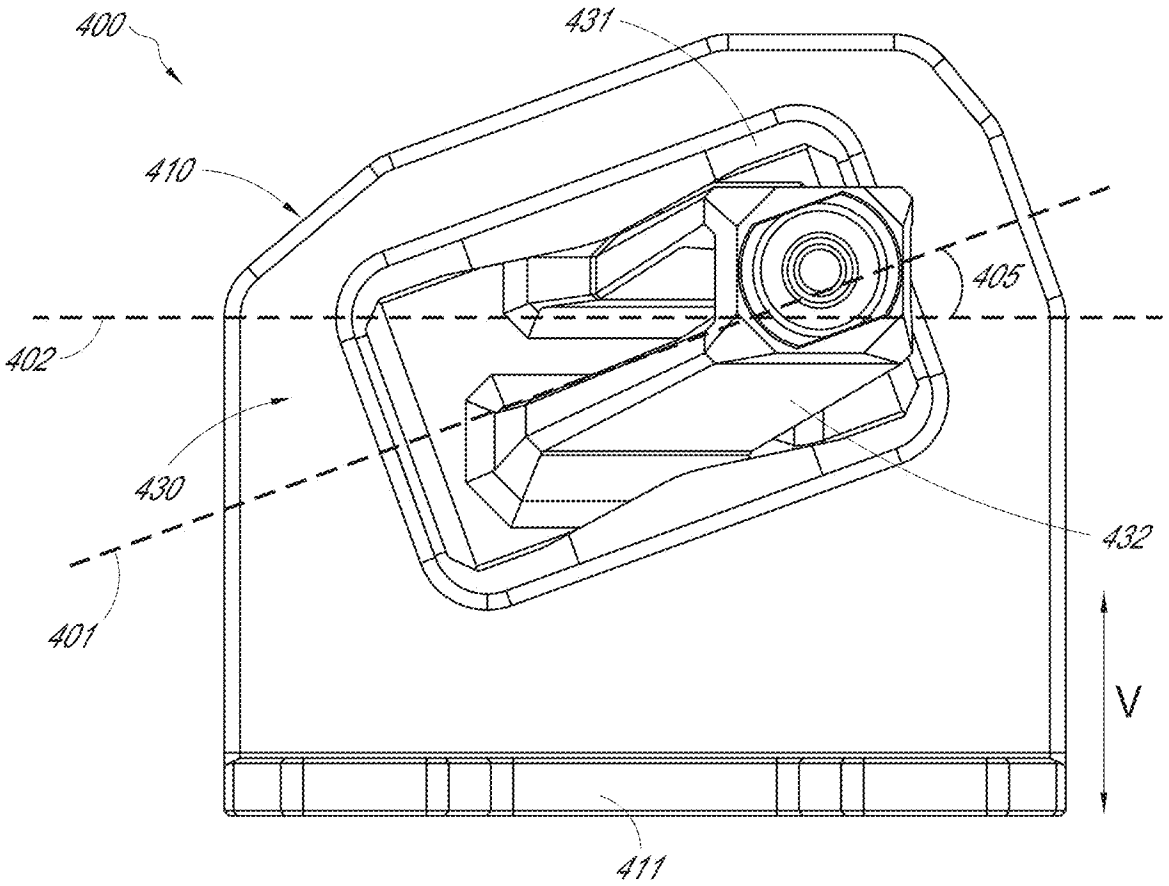
FIG. 42 is a side view of the truck of FIG. 40.
Figure 43:
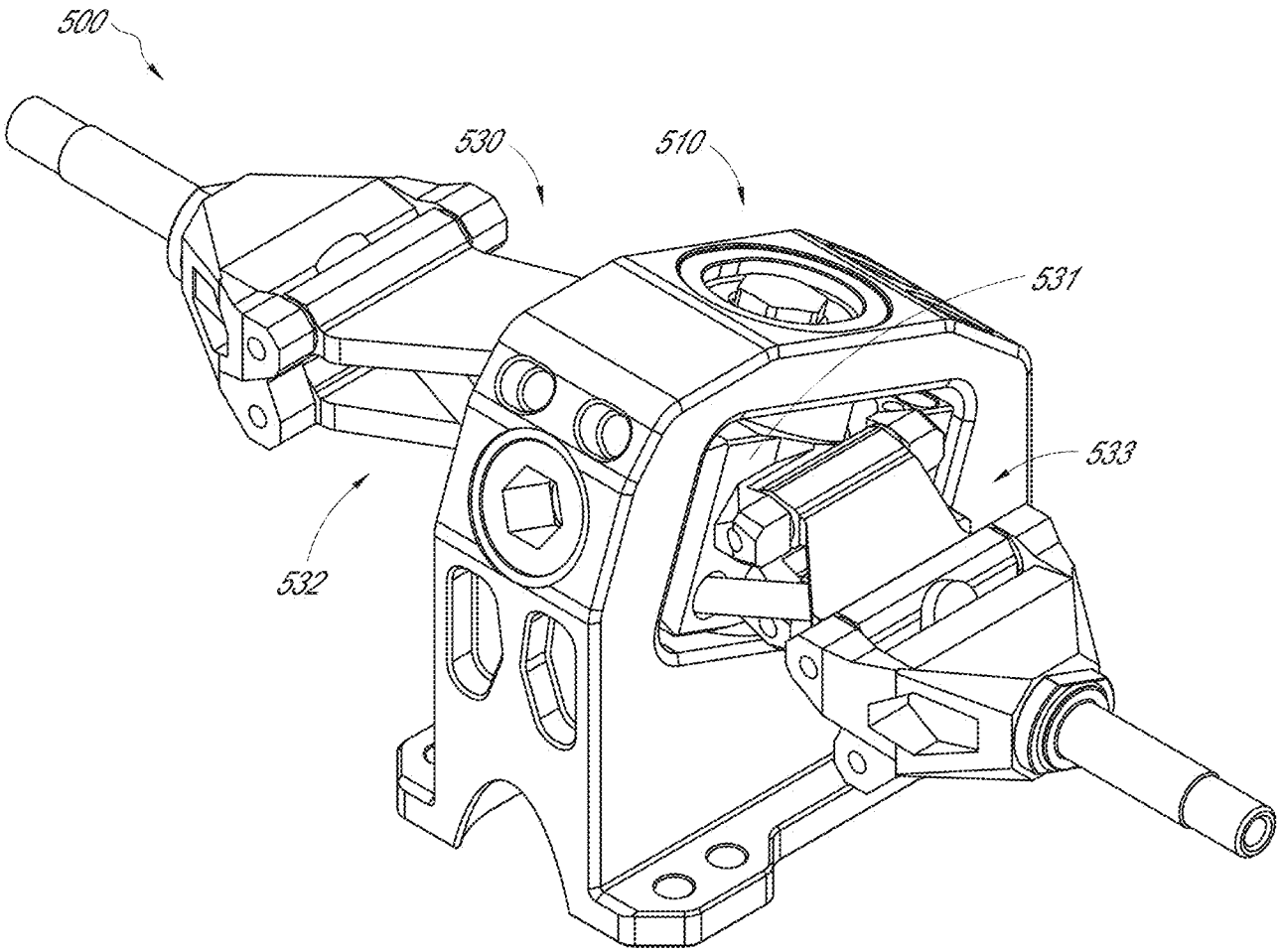
FIG. 43 is a fifth embodiment of a truck.
Figure 44:
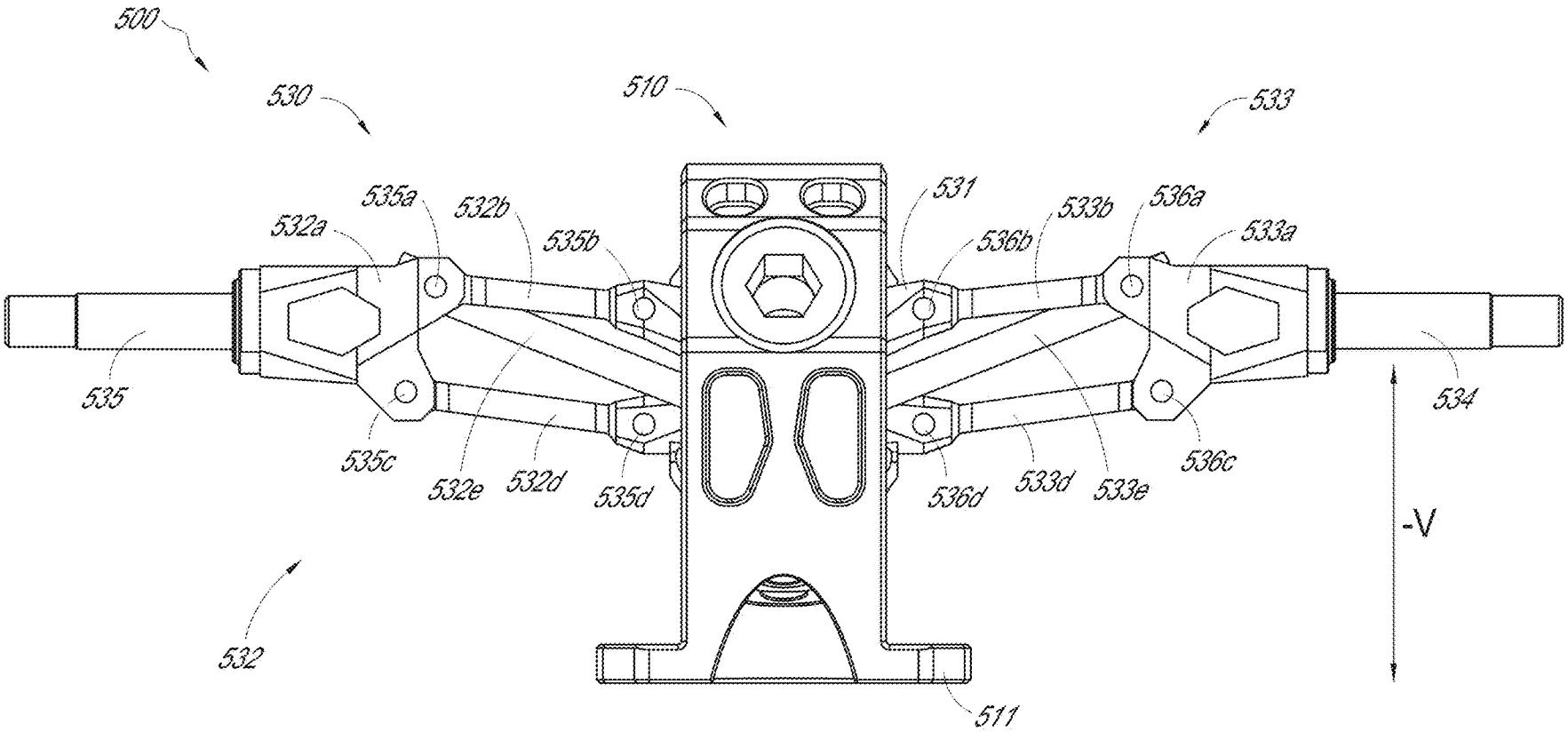
FIG. 44 is a rear view of the truck of FIG. 43.
Figure 45:
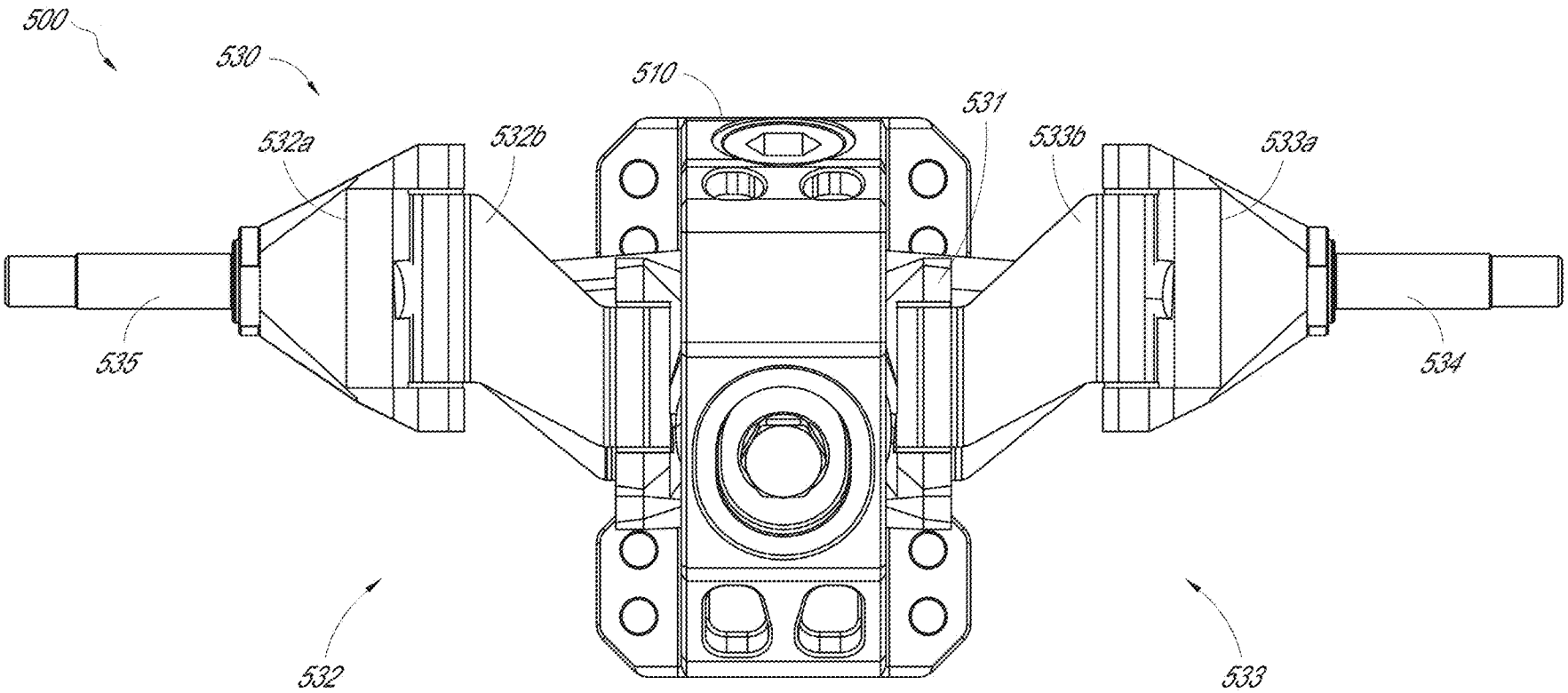
FIG. 45 is a bottom view of the truck of FIG. 43.
Figure 46:
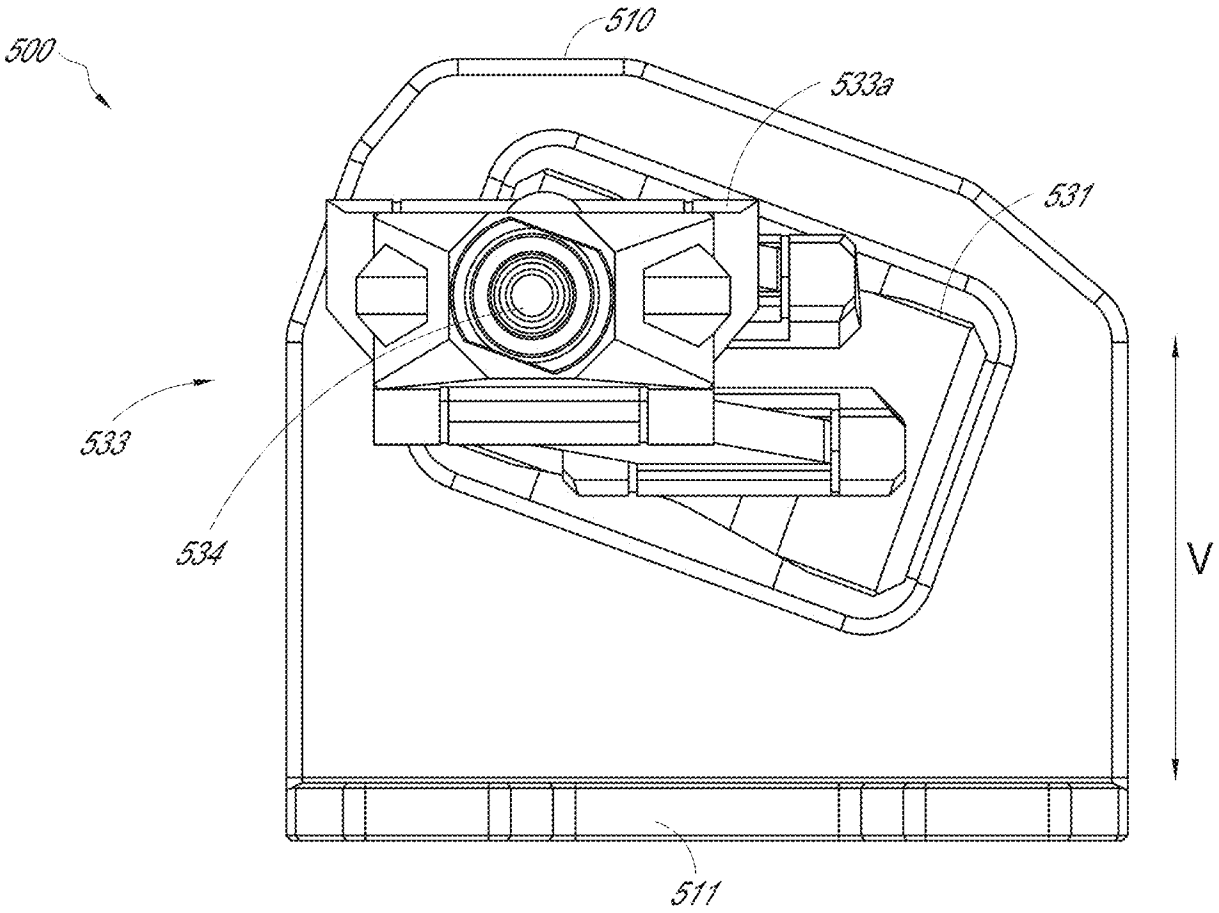
FIG. 46 is a side view of the truck of FIG. 43.
Figure 47:
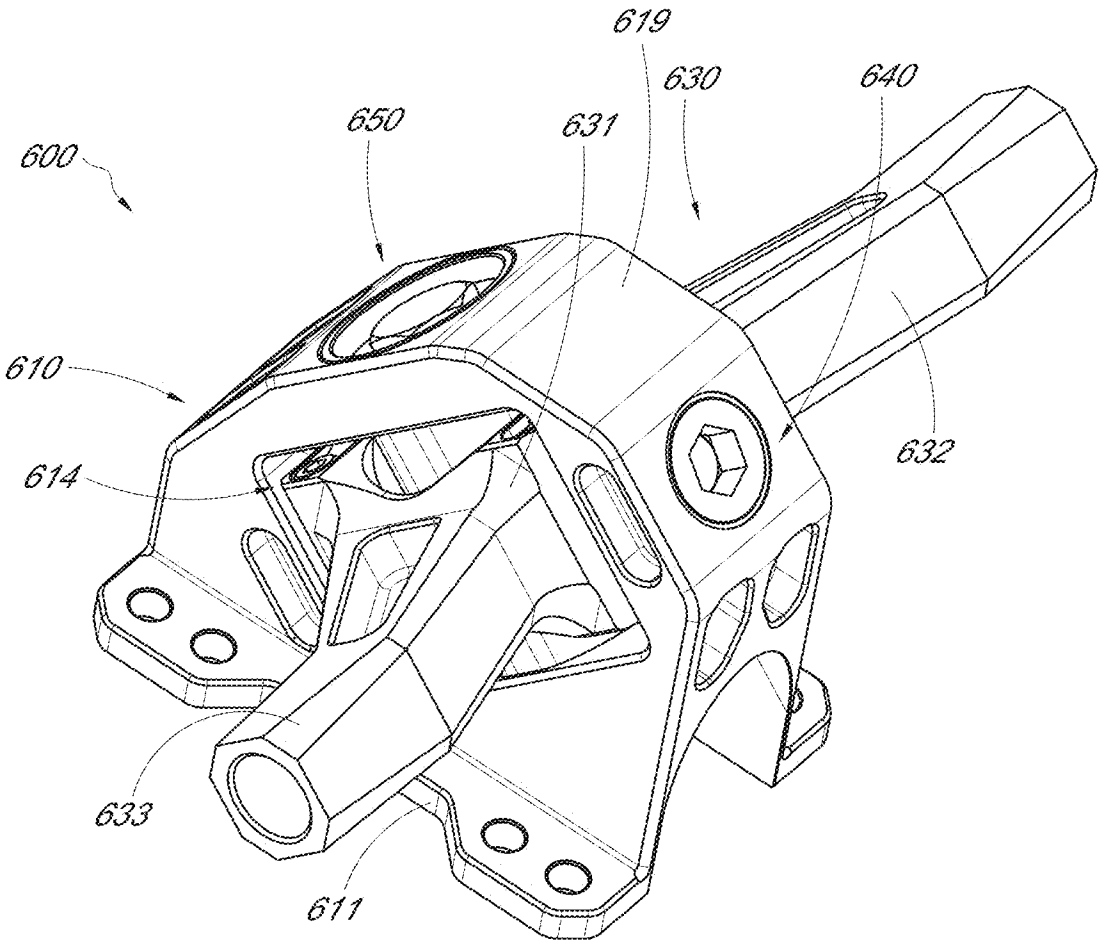
FIG. 47 is a sixth embodiment of a truck.
Figure 48:
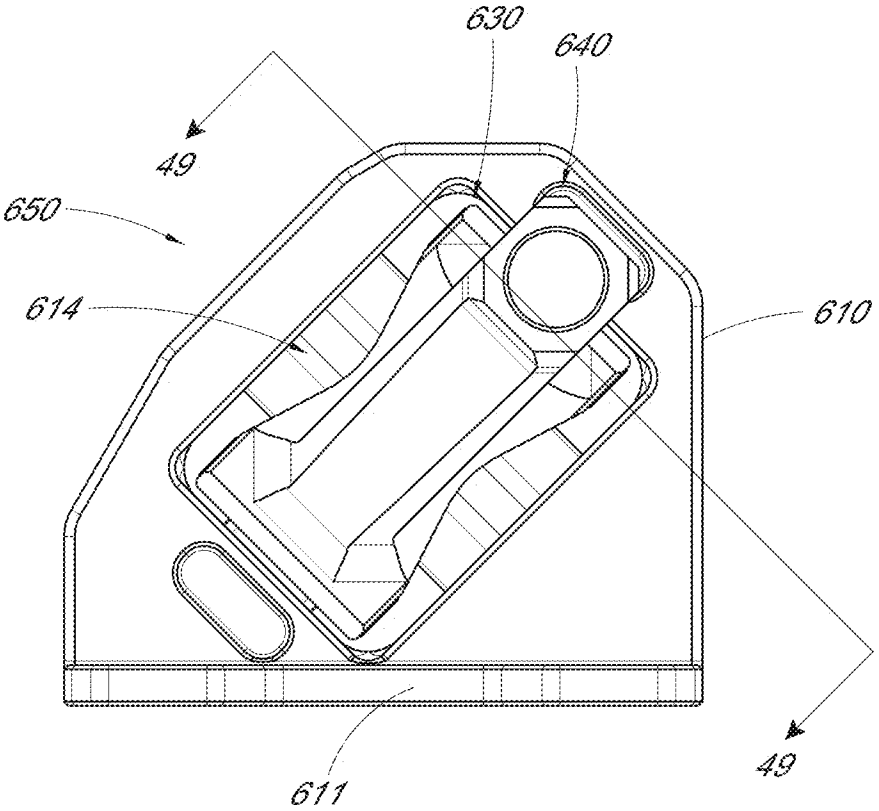
FIG. 48 is a side view of the truck of FIG. 47.

FIGS. 40-42 illustrate a fourth embodiment of a truck 400, similar to the truck 100 with the differences disclosed herein. Truck 400 can include a base 410 and a hanger 430 that is pivotally coupled with the base 410 about a pivot axis 401. The pivot axis 401 can be at an angle 405 with respect to a base plate 411.

Similar to the hanger 330, the hanger 430 can include left and right wings, 433, 432 coupled with a central portion 431 (e.g., the wings 433, 432 can be angled with respect to the central portion 431). The left wing 433 can comprise angled wing sections 433*a*, 433*b*. The angled sections 433*a*, 433*b* can be a double wing structure. The double wing structure can increase the ability of the left wing 433 to translate in the vertical direction (e.g., the angled sections 433*a*, 433*b* can be generally parallel with the ground) and provide suspension to the board through compliant (e.g., elastic deformation) of the angled sections 433*a*, 433*b*. The right wing 432 can comprise angled wing sections 432*a*, 432*b*. The angled sections 432*a*, 432*b* can be a double wing structure. The double wing structure can increase the ability of the right wing 432 to translate in the vertical direction (e.g., the angled sections 432*a*, 432*b* can be generally parallel with the ground) and provide suspension to the board through compliant (e.g., elastic deformation) of the angled sections 432*a*, 432*b*. Furthermore, the double wing structure can be aerodynamic.

FIGS. 43-46 illustrate a fifth embodiment of a truck 500, similar to the truck 100 with the differences disclosed herein. The truck 500 can include a base 510 and a hanger 530. The hanger 530 can include a right wing 532 coupled with a central portion 531 and a left wing 533 coupled with the central portion 531. The right and left wings 532, 533 can each comprise a four-bar suspension mechanism.

The right wing 532 (which can be a mirror of the left wing 533) can include an outer member 532*a* that couples with an axle 535. A lower member 532*b* couples between the outer member 532*a* and the central portion 531 at first and second pivots 535*a*, 535*b*, respectively. An upper member 532*d* can couple with the outer member 532*a* and the central portion 531 at third and fourth pivots 535*c*, 535*d*, respectively. The pivots can be formed of a plurality of pin mechanisms and optionally include bearings. The assembly of the outer member 532, lower member 532*b*, upper member 532*d* and the central portion 531 form the four-bar suspension mechanism.

Where the members and pivots of the four-bar suspension mechanism are angled relative to the central portion 531 of the hanger 530 and/or are generally parallel with a flange 511 of the base 510, the four-bar suspension mechanism can translate the outer member 532*a* in the vertical direction and can allow the axle 535 to translate in the vertical direction. Depending on the lengths between the pivots 535*a-d*, the behavior of the axle 535 can be controlled. For example, if the distance between first pivot 535*a* and the second pivot 535*b* is equivalent to the distance between the third pivot 535*c* and the fourth pivot 535*d*, and the distance between the first pivot 535*a* and the third pivot 535*c* is equivalent to the distance between the second pivot 535*b* and the fourth pivot 535*d*, then the four-bar suspension mechanism can translate the axle 535 in the vertical direction without angling or rotating. In other implementations, a specific camber curve for attached wheels can be determined by the lengths between the pivots 535*a-d*.

The four-bar suspensions mechanisms of the right wing 532 can include a pushrod 532*e*. The pushrod 532*e* can be a spring and/or dampening mechanism. The pushrod 532*e* can couple across the four-bar suspension mechanism between the outer member 532*a* (or between other suitable members) and the central portion 531. The left wing 533 can include the four-bar suspension assembly with a mirror structure to the right wing 532. The four-bar of the left wing 533 can include an outer member 533*a*, an upper member 533*b*, a lower member 533*d* and pivot members 536*a-d*. A pushrod 533*e* can be similar to the pushrod 532*e* and couple between the outer member 533*a* and the central portion 531.

FIGS. 47-50 illustrate a sixth embodiment of a truck 600. The truck 600 can include similar components and function similarly to the previously described trucks. The truck assembly 600 can include a base 610 and a hanger 630. The hanger can be pivotally coupled with the base 610. The base 610 can be coupled with a deck (e.g., of a skateboard or longboard) like the previously described trucks.

The base 610 can include the features of the base 110 or other previously described bases. The base 610 can include a flange 611. The mounting flange 611 can include a flattened region of the base 610. The flattened regions can include one or more apertures within the flange 611 for receiving fasteners (not shown) to couple the base 610 and the hanger assembly 600 with the deck.

The base 610 can include a transverse portion 619. The transverse portion 619 can extend out from the mounting flange 611. The transverse portion 619 can include a hanger aperture 614. The hanger aperture 614 can include an inner surface around the hanger aperture 614. The hanger 630 can be received within the hanger aperture 614 and pivotable therein about a pivot axis.

The hanger 630 can be structured similar to the hanger 130. The hanger 630 can include a left wing 632, a right wing 633 and a central portion 631. The hanger 630 can be coupled with a wheel assembly (not shown). The wheel assembly can be similar to the wheel assembly 120 and include (e.g.) axles, bearings, and/or urethane wheels. The central portion 631 can be disposed within the hanger aperture 614.

The central portion 631 can be coupled with a pivot assembly 640 (similar to the pivot assembly 140). The pivot assembly 640 can include pivot shafts engaged with pivot apertures in the base 610, bushings, and/or pivot seats on opposite ends of the central portion 631. The pivot assembly 640 can pivotably support the hanger 630 relative to the base 610.

The truck 600 can include a compression assembly 650 (similar to the compression assembly 150). The hanger 630 can be disposed within the hanger aperture 614 and rotatable with respect to the base 610 about the pivot assembly 640. Rotation of the hanger 630 with respect to the base 610 can be controlled or limited by the compression assembly 650. The compression assembly 650 can include force transfer bushings, bushings, bushing sockets, a nut, and/or a compression bolt. The compression assembly 650 can engage opposite sides of the hanger 630 (e.g., at bushing sockets). Tightening and loosening of the compression assembly 650 can adjust the force required to rotate the hanger 630.

Figure 49:
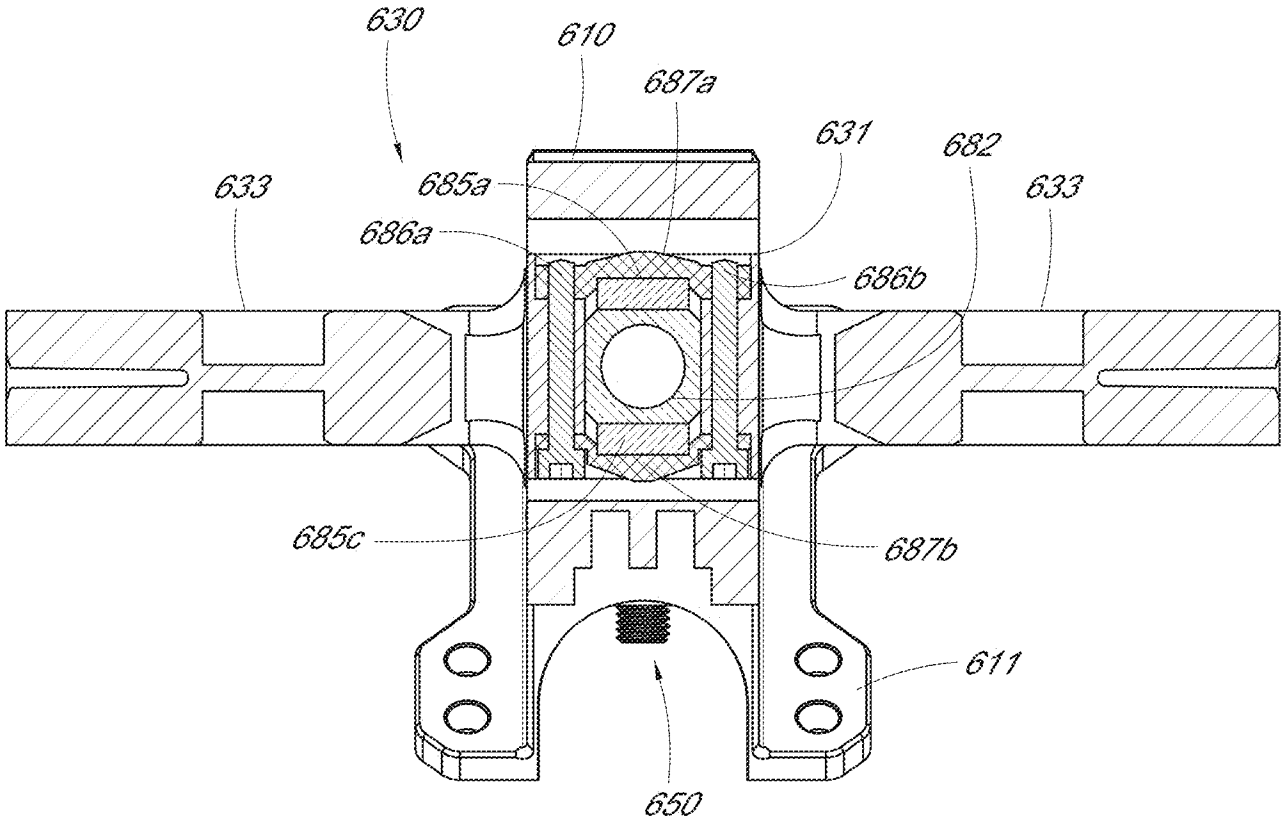
FIG. 49 is a section view taken along the line 49-49.
Figure 50:
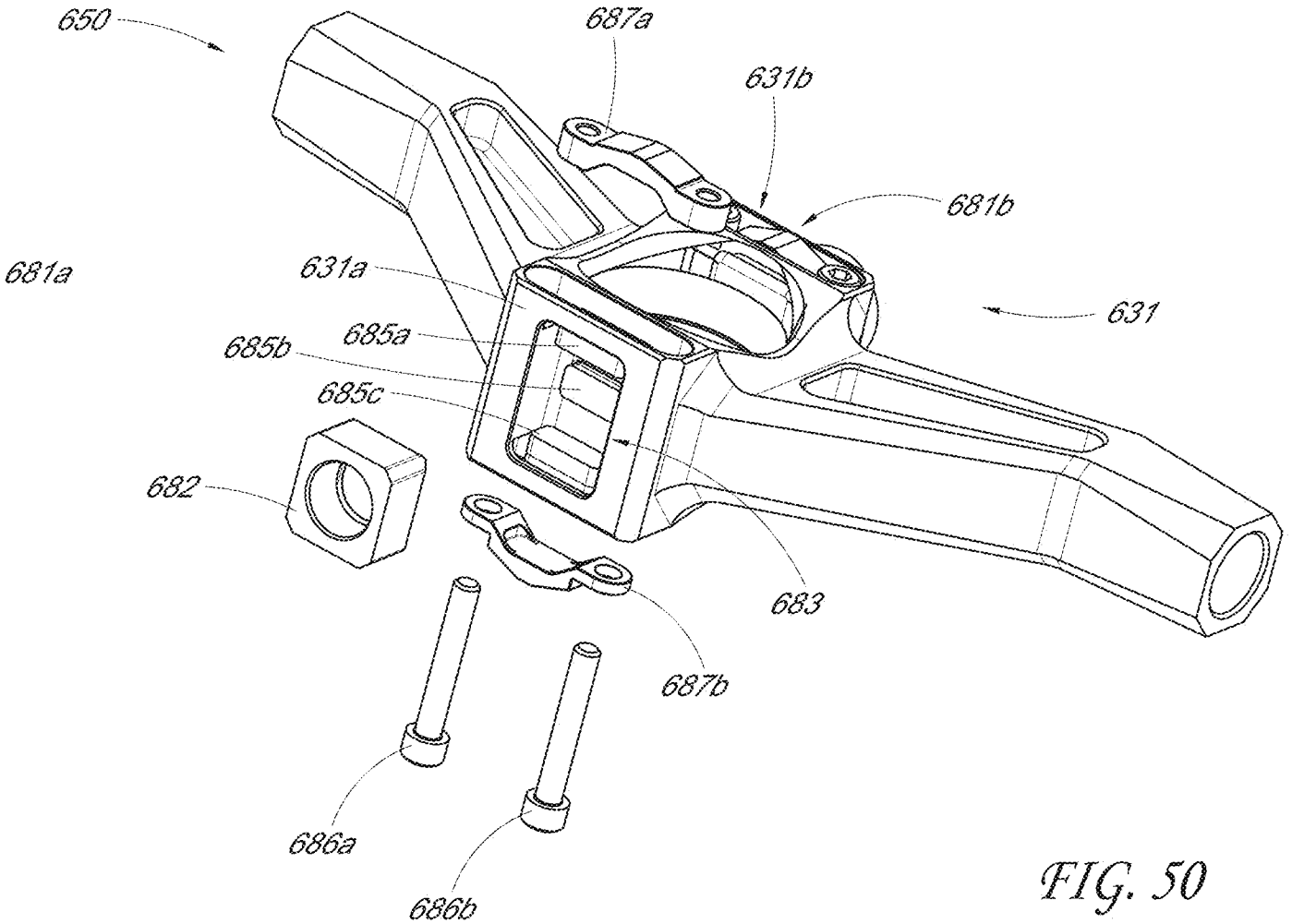
FIG. 50 is a partially exploded view of a hanger of the truck of FIG. 47.
Figure 51:
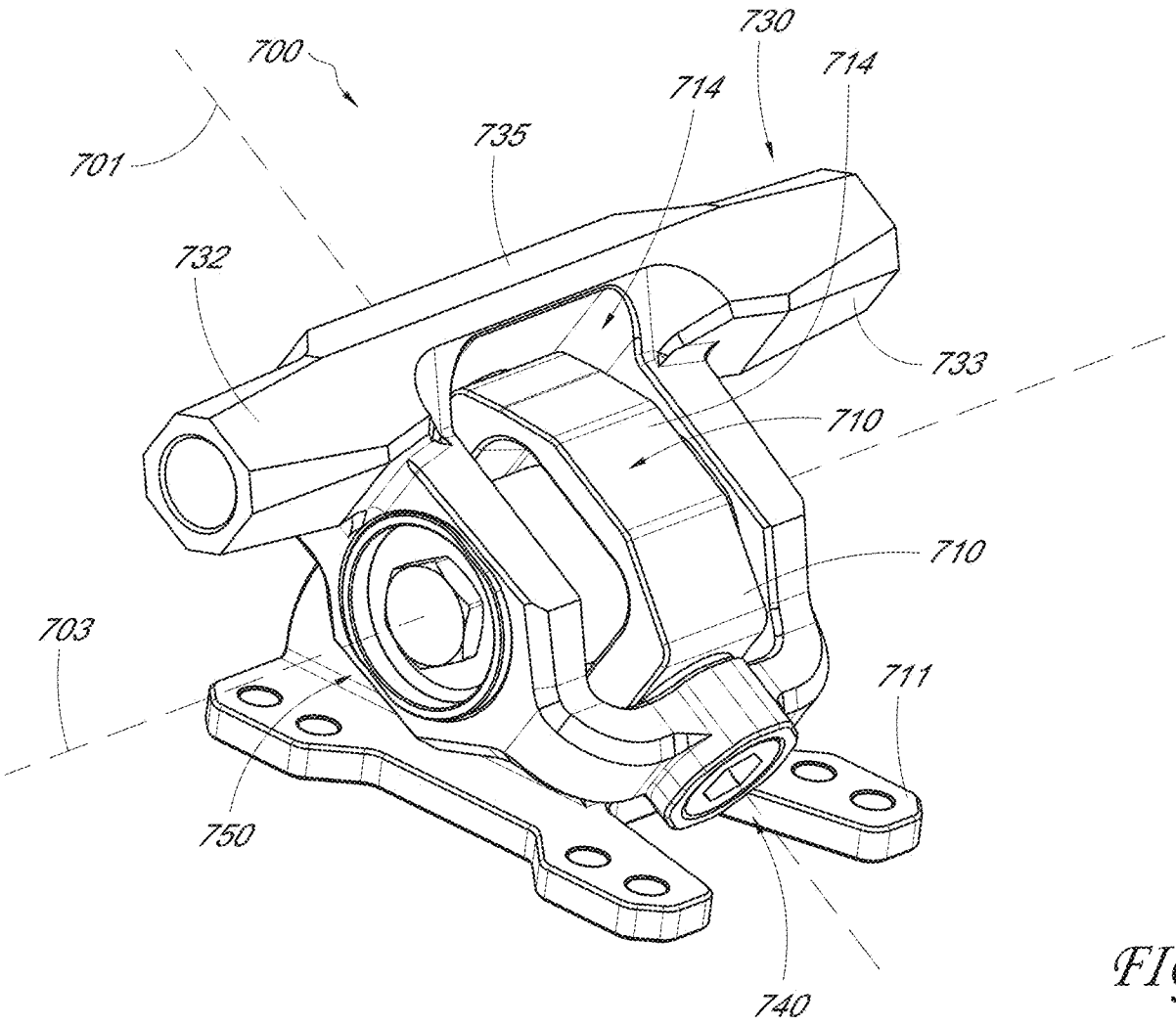
FIG. 51 is a seventh embodiment of a truck.

As shown in FIGS. 49-50 the hanger 630 can include one or more floating pivot seat assemblies 681*a*, 681*b*. The floating pivot seat assemblies 681*a*, 681*b* can be located on opposite ends 631*a*, 631*b* of the central portion 631 of the hanger 630, respectively. The pivot seat assemblies 681*a*, 681*b* can be assembled at least partially within the central portion 631.

The floating pivot seat assembly 681*a* can include a pivot seat 682 for pivotably coupling with the hanger 630 through the pivot assembly 640 (e.g., with a pivot shaft). The pivot seat can include a pivot aperture for receiving an end of a pivot shaft. The pivot seat 682 can be movable or 'floating' with respect to the central portion 631 through one or more spacers 685*a-c*. The spacers 685*a-c* are merely example implementations of spacers, which can have different shapes. The spacers 685*a-c* can include upper, lower, front, back, and/or left and right spacers. The spacers 685*a-c* can be formed of an elastic material (e.g., rubber, plastic, metal, urethane, etc.) or other material having dampening properties.

The spacers 685*a-c* and/or the pivot seat 682 can be assembled within an opening 683 on the central portion 631. Desirably the floating seat 682 can fit entirely within the opening 683. An outer face or surface of the end 631*a* can be flush with an outer face of the floating seat 682. The spacers 685*a-c* can be placed around and in contact with sides of the pivot seat 682. The pivot seat 682 can be spaced from inner walls of the opening 683. The inner walls of the opening 683 can include recessed areas sized to receive at least one end of the spacers 685*a-c*. The recessed areas can keep the spacers 685*a-c* and the pivot seat 682 in place within the opening 683.

The floating pivot seat assembly 681*a* can include one or more mounting clamps 687*a*, 687*b*. The mounting clamps 687*a*, 687*b* can each include a central region with a recess sized to receive at least one end of one of the spacers 685*a-c*. The mounting clamps 687*a*, 687*b* can be at least partially assembled within the central portion 631. The mounting clamps 687*a*, 687*b* can be coupled together through one or more bolts 686*a*, 686*b*. The bolts 686*a*, 686*b* can be coupled on opposite sides of the recesses. The mounting clamps 687*a*, 687*b* can be tightened onto the bolts 686*a*, 686*b*, such as through threaded engagement with a nut or directly with threads cut into the sides of the apertures of the mounting clamps 687*a*, 687*b*. The mounting clamps 687*a*, 687*b* can be adjusted to tighten and loosen the engagement of the spacers 685*a-c* with the pivot seat 682.

The floating seat 682 can be held in compression within the first end 631*a* by the spacers 685*a-c* in conjunction with the mounting clamps 687*a*, 687*b*. When assembled with the pivot assembly 640, a shaft can fit within the aperture of the floating seat 682 and the hanger 630 can rotate with respect to the base 610 about the shaft. The first end 631*a* of the hanger 630 is afforded a degree of freedom in a direction perpendicular or transverse to the pivot axis of the pivot assembly 640. Accordingly in use, the spacers 685*a-c* can function to dampen vibrations and/or absorb shock (depending on the material and structure of the spacers 685*a-c*) that would otherwise pass through the wheel assembly and truck 600 to the deck. The stiffness or relative softness of the response of the floating pivot assembly 681*a* can be adjusted by adjusting tightness of the shafts 686*a*, 686*b* and by changing the material, structure and dimensions of the spacers 685*a-c* and/or pivot seat 682.

FIGS. 51-57B illustrate a seventh embodiment of a truck 700. This embodiment places a hanger 730 in a more external, accessible position to allow a grinding surface 735 to be exposed, while retaining all or many benefits from the other embodiments that allow specific adjustments to select compression and constraints on various degrees of freedom. The truck 700 can include a base 710 and a hanger 730. The hanger 730 can be pivotably coupled with the base 710 by a pivot assembly 740. A compression assembly 750 can limit and control rotation of the hanger 730. The hanger 730 can be coupled to pivot with respect to the base 710 by a pivot assembly 740. Rotation of the hanger 730 with respect to the base 710 can be controlled by a compression assembly 750. The compression assembly 750 can extend in a transverse direction to the pivot assembly 740. The pivot assembly 740 can constrain the hanger to only rotate with respect to the base 710 (e.g. transverse movement of the hanger 730 with respect to the base 710 can be negligible).

Figure 57B:
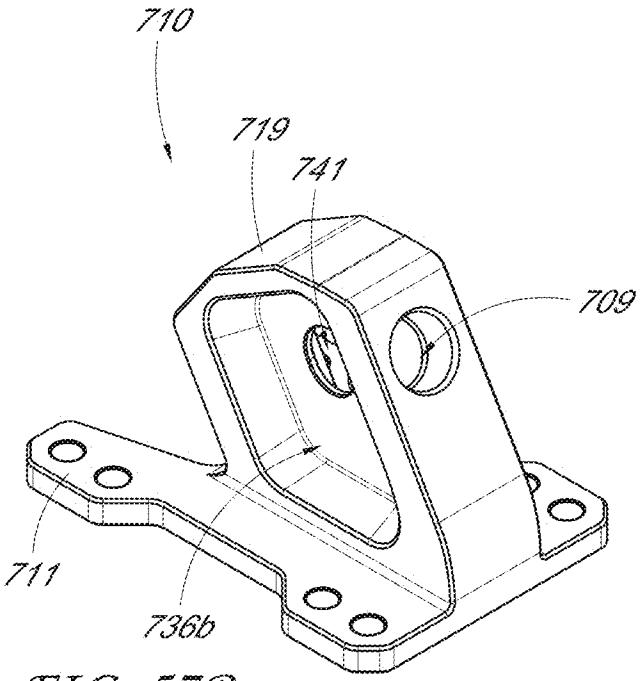
FIGS. 57A-B are perspective views of a base of the truck of FIG. 51.
Figure 57A:
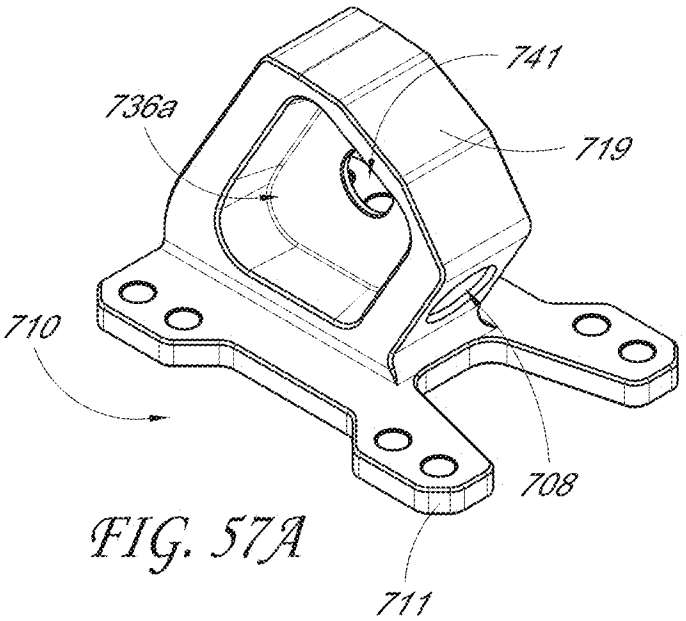

FIGS. 57A-B further illustrate an embodiment of the base 710. The base 710 can include a flange 711. The flange 711 can couple the base 710 with a deck, similar to the base 110 and other bases described above. The base 710 can include a transverse portion 719. The transverse portion 719 can extend out from the flange 711. The transverse portion 719 can include opposite bushing seats 736*a* and 736*b*. The bushing seats 736*a* and 736*b* can be concave regions of the transverse portion 719. The bushing seats 736*a* and 736*b* are sized to receive bushings of the compression assembly 750. A roll aperture 741 can be disposed through bottom surfaces of the bushing apertures 736*a*, 736*b* (e.g., through the transverse portion 719). The roll aperture 741 can be sized to receive a compression bolt of the compression assembly 750. The roll aperture 741 can be larger than the outer diameter of the compression bolt to allow rotation of the compression assembly 750 within the roll aperture 741. The base 710 can include front and rear apertures 708, 709.

Figure 55:
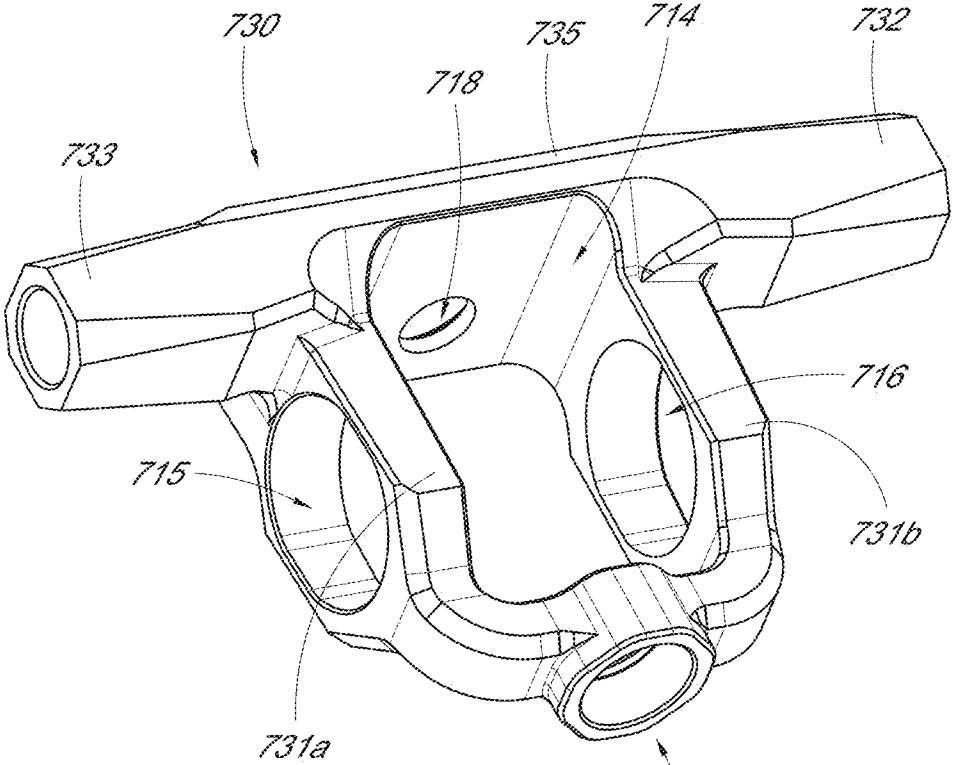
FIG. 55 is a perspective view of the hanger of the truck of FIG. 51.

FIG. 55 further illustrates an embodiment of the hanger 730. The hanger 730 can include a left wing 733 and a right wing 732. The left and right wings 733, 732 couple with a wheel assembly, similar to the wheel assembly 120 comprising axles, bearings and/or wheels, as described above in conjunction with the truck 100.

The hanger 730 can include first and second extension portions 731*a*, 731*b*. The first and second extension portions 731*a*, 731*b* can extend out from the left and right wings 733, 732. The first and second extension portions 731*a*, 731*b* can at least partially define include a base aperture 714. The base aperture 714 can be disposed around the transverse portion 719 of the base 710 when assembled therewith by the pivot assembly 740. The base aperture 714 can include an inner surface.

The hanger 730 can include opposite bushing apertures 715, 716. The bushing apertures 715, 716 can be disposed on opposite sides of the base aperture 714. The bushing apertures can be disposed on respective first and second extension portions 731*a*, 731*b*. The bushing apertures 715, 716 can be aligned along a compression axis 703 of the compression assembly 750. The compression assembly 750 couples with the hanger 730 and the base 710 through the bushing apertures 715, 716.

The hanger 730 can include pivot apertures 717, 718. The pivot apertures 717, 718 can be disposed on opposite sides of the base aperture 714. The pivot apertures 717, 718 can be aligned along a pivot axis 701 of the pivot assembly 740. The pivot axis 701 can be orthogonal to the compression axis 703. Internal surfaces of the shafts 717, 718 can include threads for engaging with shafts of the pivot assembly. The pivot assembly 740 pivotably couples the hanger 730 with respect to the base 710 within the shaft apertures 717, 718.

Figure 52:
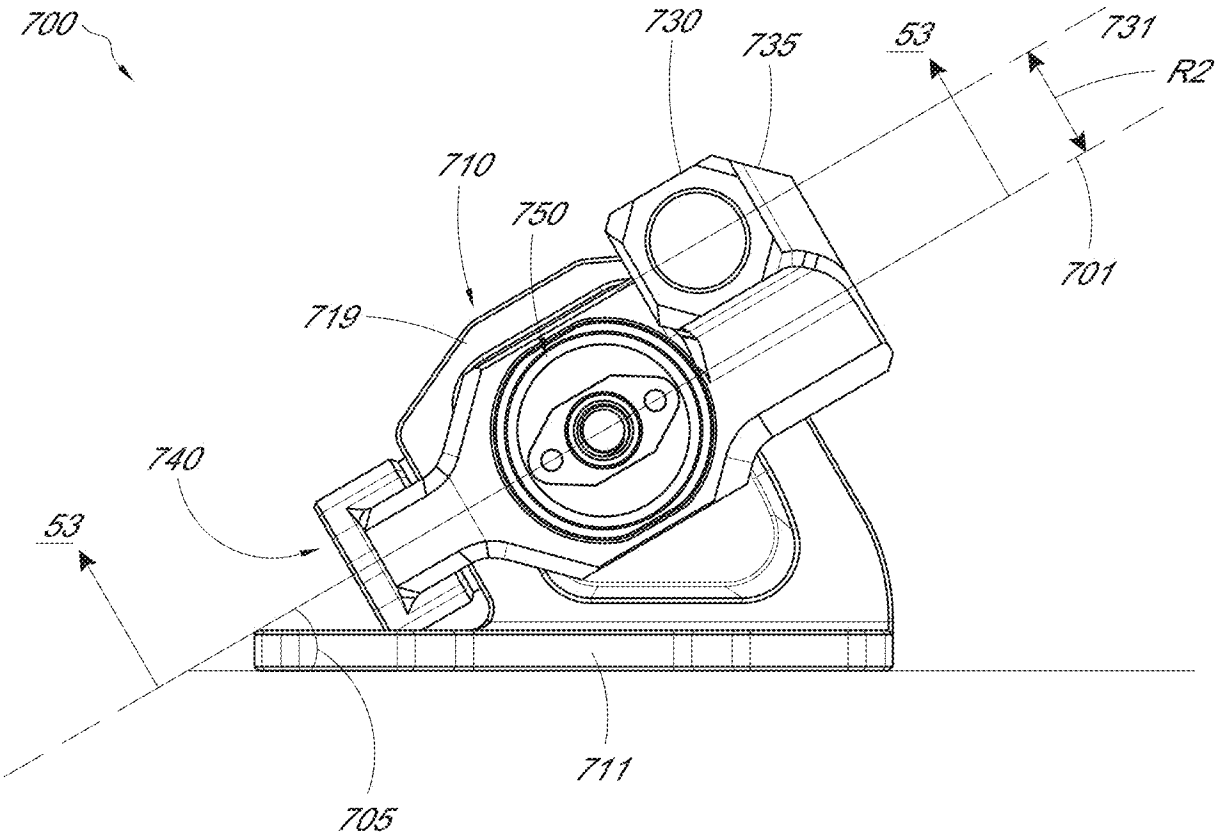
FIG. 52 is a side view of the truck of FIG. 51.

The hanger 730 can include an outer grinding surface 735. The grinding surface can extend across or onto the left and right wings 732, 733. As shown in FIG. 52, the grinding surface 735 can extend lower in use (although in this figure it is shown as higher because of the figure's orientation) than the transverse portion 719 of the base 710. The grinding surface 735 can enable additional uses and applications for the truck 700, such as for use in street skating and tricks where it can be positioned to grind or slide along a railing, curb, or other obstacle. Optionally, the grinding surface 735 can include a replaceable material (such as plastic or metal) that can enhance the grinding properties of the truck 700 and protect the material and integrity of the hanger 730. Optionally, the removable material can be bolted in place on the grinding surface 735. Optionally, the removable material can be received within a recess on or otherwise attachable to the grinding surface 735.

As shown in FIG. 52, a wheel axis 731 of the hanger 730 along which the wheel assembly is aligned can be offset from the pivot axis 701. The offset can be a rake offset distance R2. The rake offset distance R2 can be between about 0.0 inches to 0.75 inches or more. The amount of rake offset for the truck 700 can influence the handling properties of the truck 700 and/or the position of the outer grinding surface 735. The pivot axis 701 can be at an angle 705 with respect to the base 710/flange 711 (e.g., with a deck). Generally, the angle 705 can be between about 0 and 60 degrees.

Figure 53:
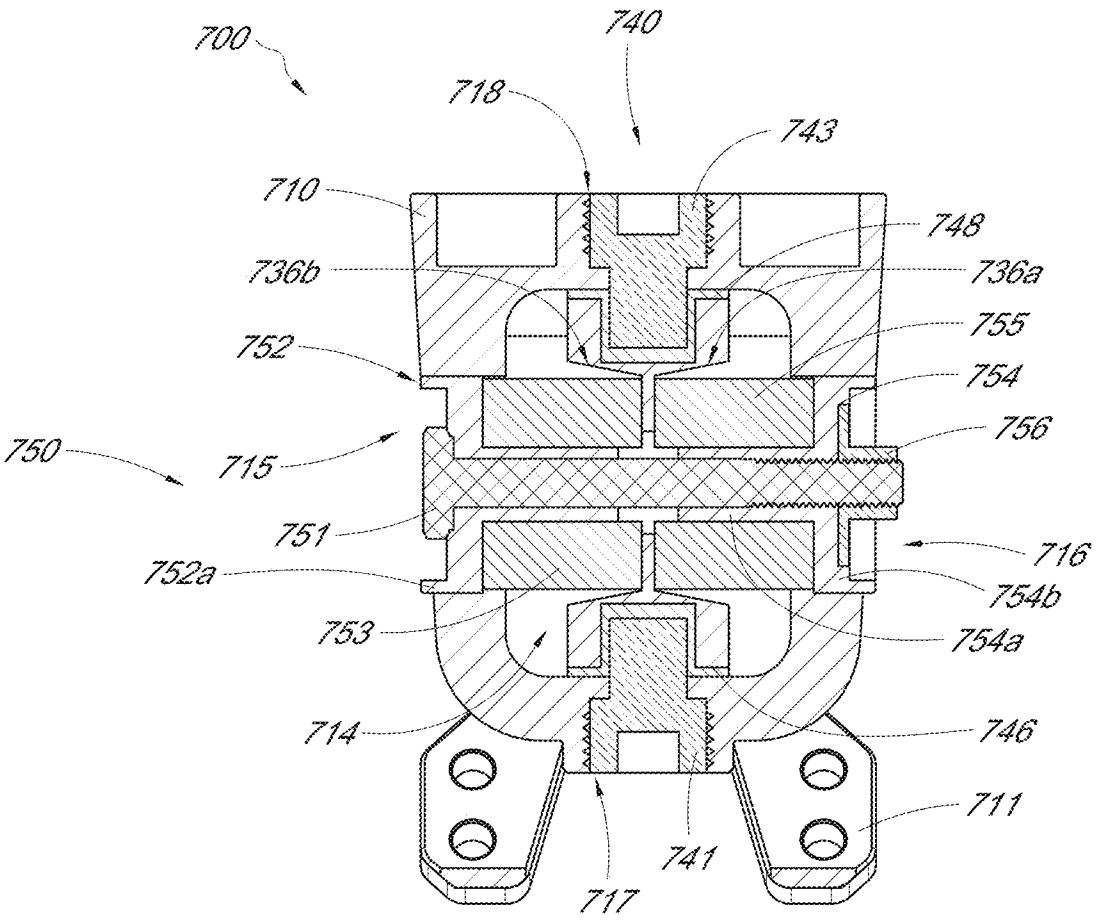
FIG. 53 is a section view taken along the line 53-53.
Figure 54:
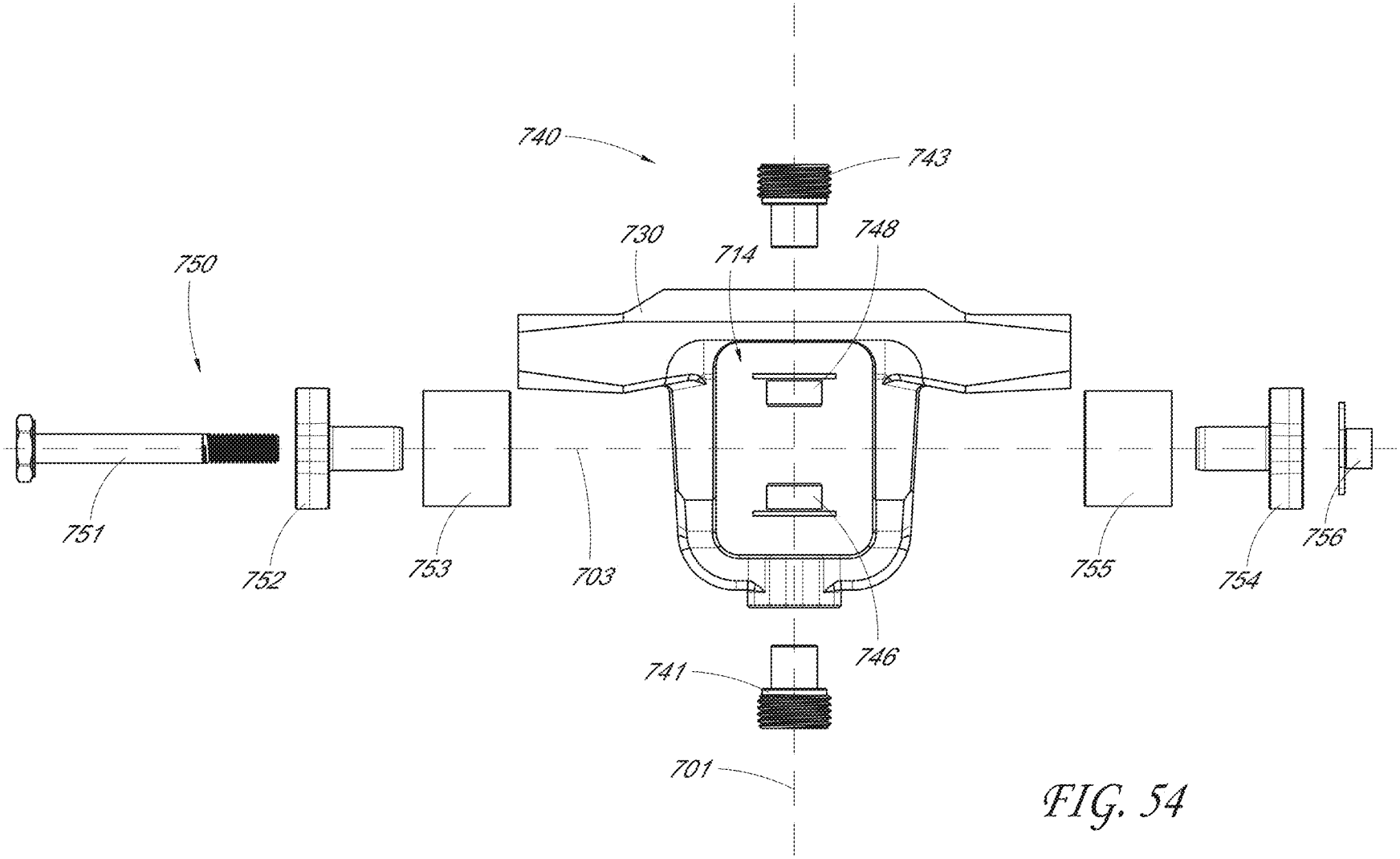
FIG. 54 is an exploded view of a compression assembly and hanger of the truck of FIG. 51.

As shown in FIGS. 53-54, the pivot assembly 740 can include front and rear shafts 743, 741. The shafts 741, 743 can be similar to the shafts 141, 143 described in conjunction with the truck 100. The shafts 741, 743 can each include a threaded head and a cylindrical portion. The threaded head can include an internal key for assembly with the hanger 730.

The pivot assembly 740 can include bearings 746, 748. The bearings 748, 746 can each include a flange portion and a cylindrical extension portion. An aperture can extend therethrough. The aperture can be sized to receive the shafts 741, 743.

The compression assembly 750 can include a compression bolt 751, a first force transfer bushing 752, a first bushing 753, a second bushing 755, a second force transfer bushing 754 and/or a nut 756. The compression bolt 751 can include a head and/or a threaded shaft. The compression bolt 751 can couple with the nut 756. Optionally, the nut 756 can be integrated in the second force transfer bushing 754. The first and second bushing 753, 755 can be similar to the bushing 153, 155 described above and include a central aperture therethrough.

Figure 56B:
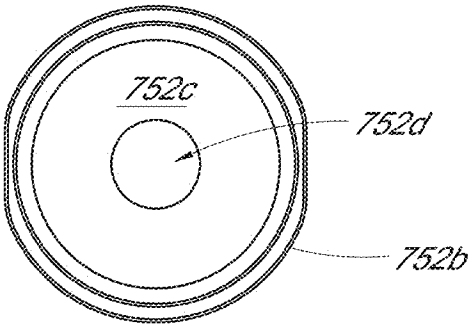
FIGS. 56A-C show a force transfer bushing of the compression assembly.
Figure 56C:
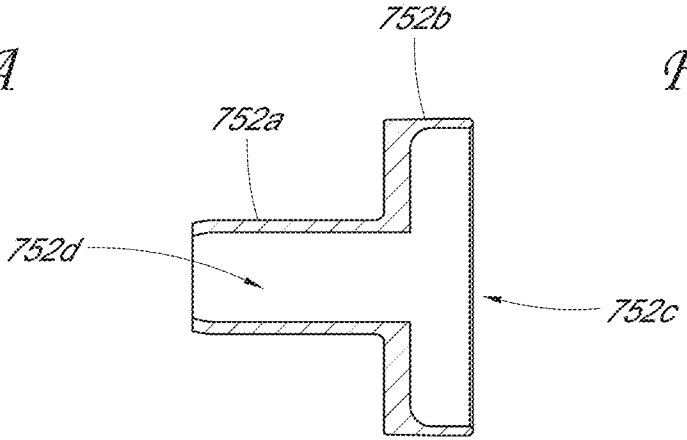
Figure 56A:
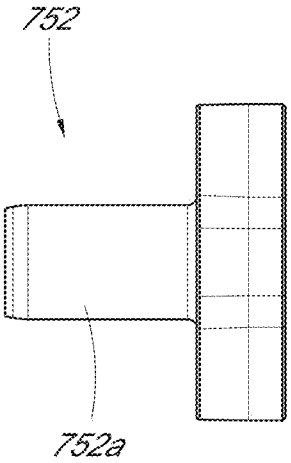

As shown further in FIGS. 56A-C, the force transfer bushing 752 (which can be similar or identical to the force transfer bushing 754) can include a shaft 752*a*. The shaft 752*a* can be sized to fit within the central aperture of the first bushing 753. The shaft 752*a* can be coupled with an upper portion 752*b*. The upper portion 752*b* can comprise an outer peripheral shape. The outer peripheral shape can fit within the bushing aperture 715 of the hanger 730. Optionally the outer peripheral shape is noncircular such that the force transfer bushing 752 is prevented from rotating within the bushing aperture 715. The outer peripheral shape can be circular with two parallel sides formed therein to prevent rotation. As shown in FIG. 56B, the upper portion 752*b* can include tapered sides for an interference sliding fit with the hanger apertures 715, 716.

The force transfer bushing 752 can include an upper cavity 752*c*. The upper cavity 752*c* can be sized to receive a head of the compression bolt 751 or the nut 756. A central aperture 752*d* can extend through the force transfer bushing 752. The central aperture 752*d* is sized to slidingly receive the compression bolt 751. Optionally, the force transfer bushing 752 does not include the shaft 752*a* and/or the cavity 752*c*.

When in an assembled state of the truck 700, the bushings 753 and 755 can be assembled within the opposite bushing apertures at 736*a*, 736*b* of the base 710. The central apertures thereof can be aligned with the roll aperture 741. The shafts 752*a*, 754*a* of the force transfer bushings 752, 754 can be assembled within the central apertures of the bushings 755, 753, respectively. Upper portions 752*b*, 754*b* of the force transfer bushings 752, 754 can be assembled within the bushing apertures 715, 716 of the hanger 730. The force transfer bushings 752, 754 can be slidingly engaged within the bushing apertures 715, 716. The compression bolt 751 can be threaded through the apertures of the force transfer bushings 752, 754, the central apertures of the bushings 753, 755, the roll aperture 741 of the hanger 730 and coupled with the nut 756. The compression assembly 750 can be tightened and/or loosened by rotation of the compression bolt 751 relative to the nut 756. The compression assembly 750 can limit rotation of the hanger 730 by a compression force engaging bottom surfaces of the bushing seats 736*a*, 736*b*. The compression state of the compression assembly 750 can effect the rideability of the truck 700.

The bearings 748, 746 can be assembled within the front and rear apertures 708, 709 of the base 710. Flanges of the bearings 748, 746 can be disposed between opposing faces of the base 710 and the inner surface of the base aperture 714 of the hanger 730. The shafts 743, 741 an be engaged within the front and rear shaft apertures 717, 718 of the hanger 730. External threads of the heads of the shafts 743, 741 can engage with internal threads of the front and rear shaft apertures 717, 718. Cylindrical portions of the shafts 741, 743 can engage within the bearings 746, 748. If bearings 746, 748 are not included, the shafts 741, 743 can engage directly with the front and rear apertures 708, 709. The hanger 730 can thereby be rotatably engaged with the base 710.

Figure 58:
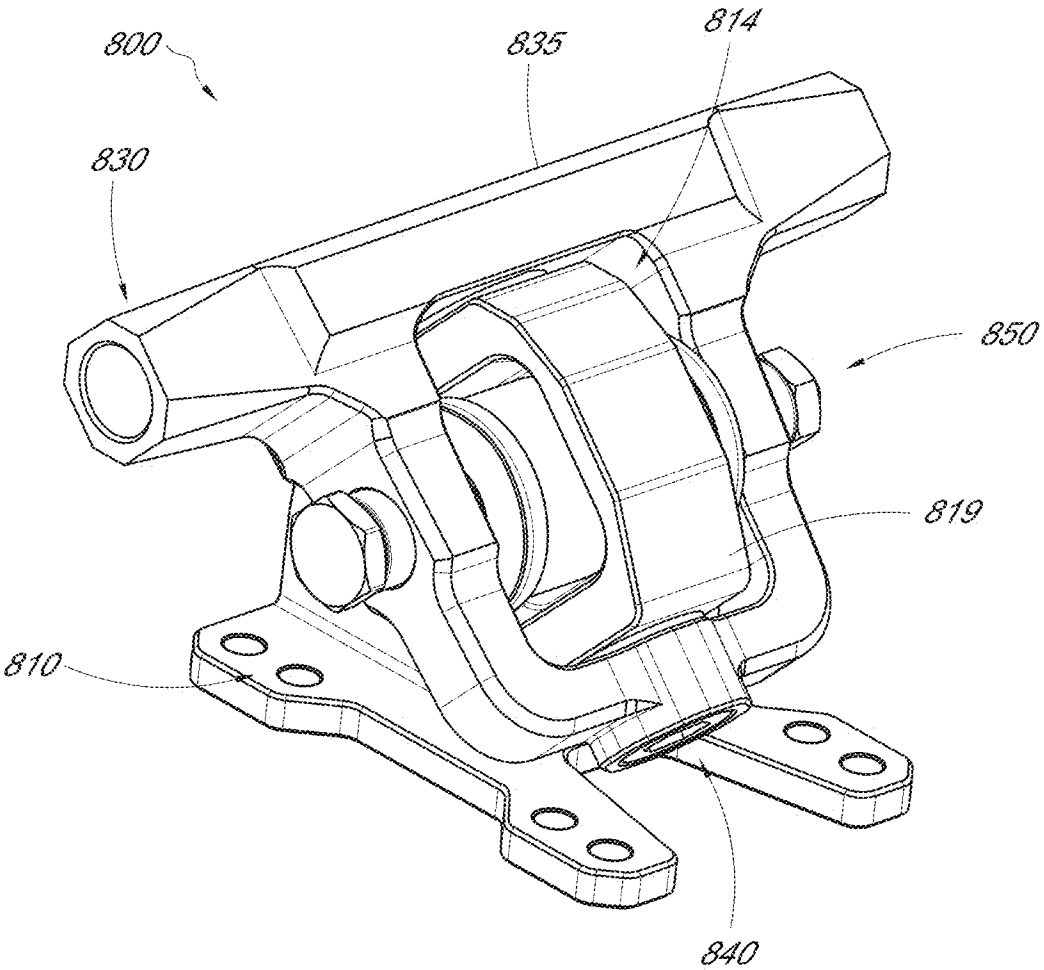
FIG. 58 is an eighth embodiment of a truck.
Figure 59:
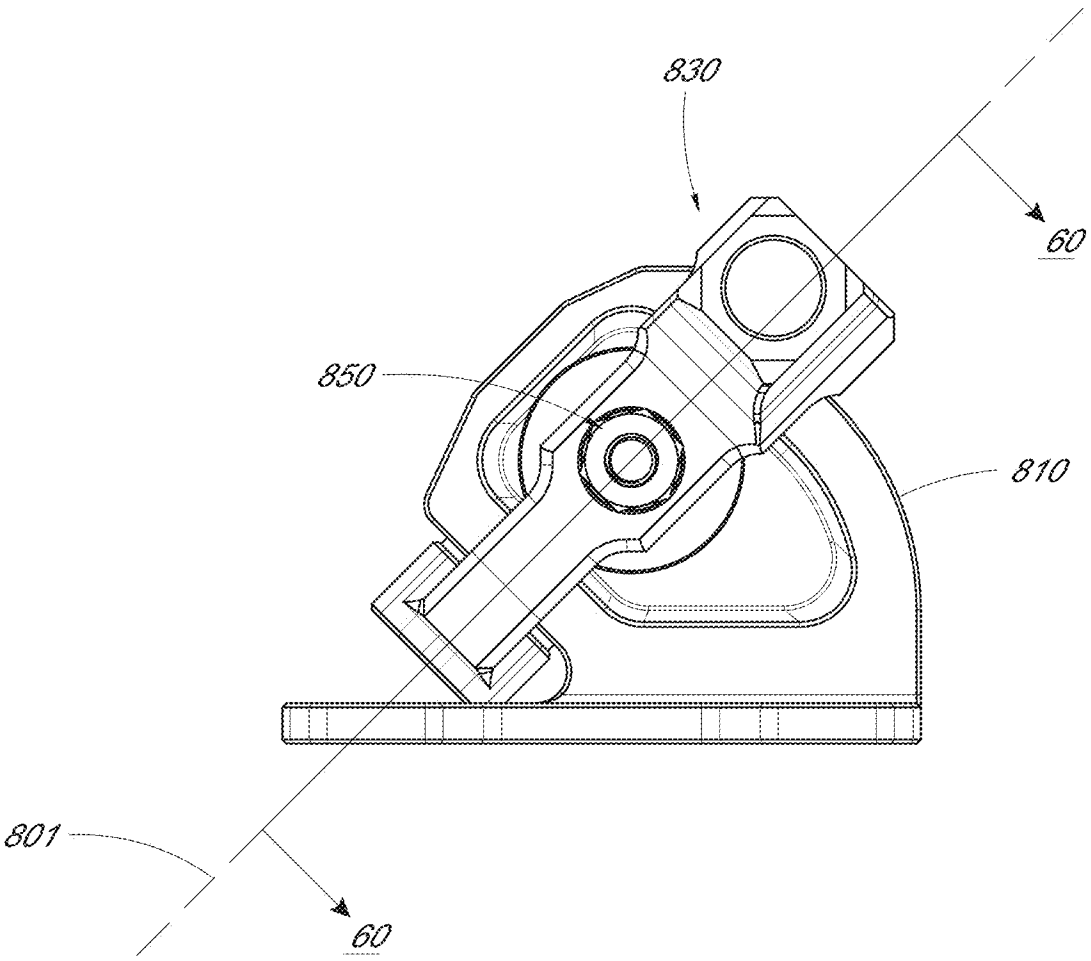
FIG. 59 is a side view of the truck assembly of FIG. 58.
Figure 60:
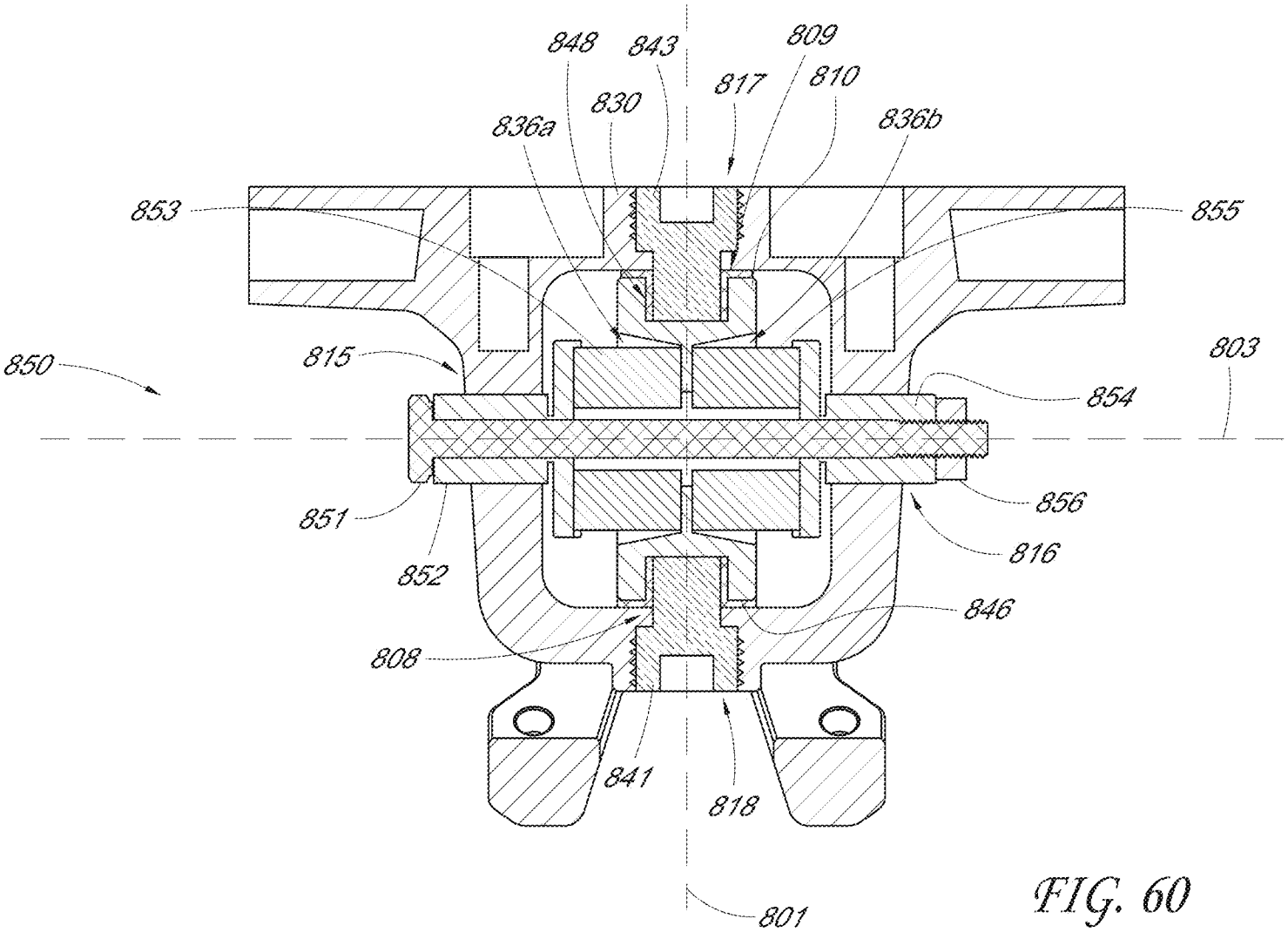
FIG. 60 is a section view taken along the line 60-60.

FIGS. 58-60 illustrate an eighth embodiment of a truck 800. The truck 800 can include a base 810 and a hanger 830. This configuration also has a grinding surface 835. The hanger 830 is pivotally coupled with respect to the base 810 by a pivot assembly 840. Rotation of the hanger 830 with respect to the base 810 can be controlled by a compression assembly 850. The base 810 can include the same structure and features as the base 710. The hanger 830 can include the same features and structures as the hanger 730, with the differences noted below.

The pivot assembly 840 can include the same features and components as the pivot assembly 740. The pivot assembly 840 can be aligned along a pivot axis 801. The pivot assembly 840 can include front and rear shafts 841, 843. The pivot assembly 840 can include bushings 846, 848. The bushings 846, 848 and/or shafts 841, 843 can be received within respective front and rear pivot apertures 808, 809 of the base 810.

The compression assembly 850 can include the same features and components as the compression assembly 750, with the differences noted below. The compression assembly 850 can be aligned along a compression axis 803. The compression assembly 850 can include any or all of a compression bolt 851, a force transfer first bushing 852, a first bushing 853, a second bushing 855, a second force transfer bushing 854 and a nut 856 engaged with an end of the force transfer bolt 851. The force transfer bushings 852, 854 can include respective cylindrical (circular) extensions 852*a*, 854*a* and bushing seaters 852*b*, 854*b*.

The hanger can include a base aperture 814 through which a transverse portion 819 of the base 810 extends. The hanger 830 can include front and rear pivot apertures 817, 818 aligned along the pivot axis 801. The hanger 830 can include bushing apertures 815, 816 aligned along the compression axis 803. The pivot assembly 840 can be assembled with the pivot apertures 817, 818, as described above for the pivot assembly 740. The base 810 can include bushing seats 836*a*, 836*b*. The bushing seats 836*a*, 836*b* can receive the bushings 853, 855, respectively. The compression assembly 850 can be assembled with the bushing apertures 815, 816, as described for the compression assembly 750.

The bushing apertures 815, 816 can be cylindrical having circular cross sections. When the compression assembly 850 is assembled, the bushing apertures 815, 816 can slidingly receive respective cylindrical extensions 852*a*, 854*a* of the force transfer bushings 852, 854. The bushing seats 842*b*, 854*b* can have larger diameters than the bushing apertures 815, 816. The bushing seats 842*b*, 854*b* can engage with the respective bushings 853, 855. This arrangement for the hanger 830 can be easer to manufacture than the hanger 730 described above. It is contemplated that the components of the assembly 800 can be cast and machined into a final shape with looser tolerances required than for the hanger 730.

Figure 61:
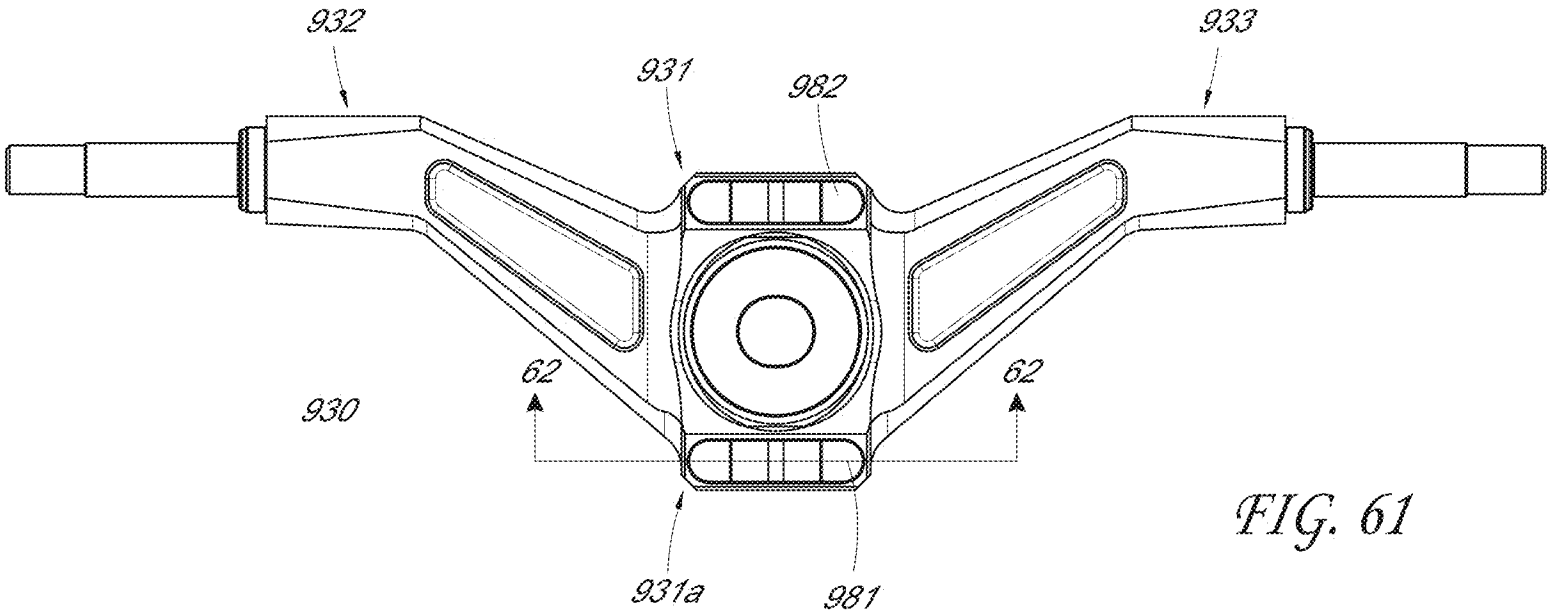
FIG. 61 is an exploded view of another embodiment of a hanger.
Figure 62:
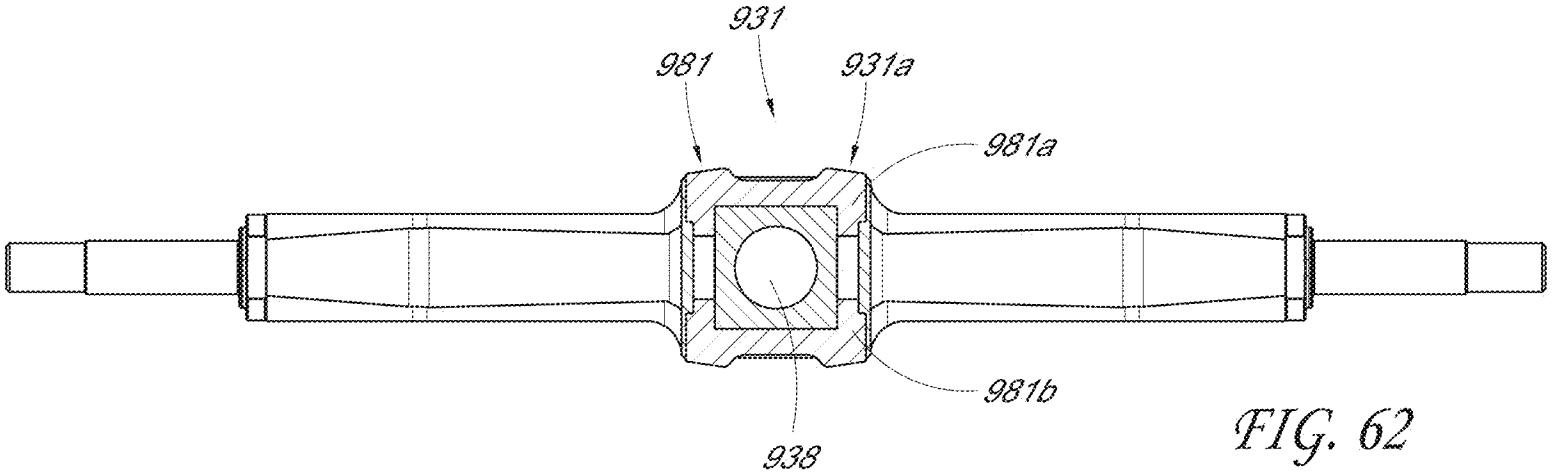
FIG. 62 is a section view taken along the line 61-61.

FIGS. 61-62 illustrate an embodiment of a hanger 930. The hanger 930 can be similar to any of the hangers of the same type (e.g., 130, 230, 330, 430, 530, 630) described above. The hanger 930 can include a central portion 931 and left and right wings 932, 933. The central portion 931 can include one or more limiters 981, 982. The limiters 981, 982 function similar to the limiters 181 described above. The limiters 981, 982 can contact an inner surface of a base (e.g., inner surface of hanger aperture 114) to limit rotation of the hanger 930 with respect to said base. The limiters 981, 982 can prevent over-rotation of the hanger, which can lead to negative consequences such as wheel bite for the overall truck assembly.

The limiters 981, 982 can be formed of an elastic material (e.g., plastic, metal) or any other suitable material. The elastic material can be shaped to fit within a cavity 931*a* on the central portion 931 and extend out of the cavity 931*a*. As shown in FIG. 62 the limiter 981 can optionally include multiple portions. An upper portion 981*a* can be on a first side of the central portion 931 and a lower portion 981*b* can be on a second side of the central portion 931. Optionally the cavity 931*a* is a through-hole through one or more portions of the central portion 931.

The dimensions of the limiters 981, 982 and/or the material of the limiter 981 can be adjusted according to the user's preferences to limit or enable rotation of the hanger 930 with respect to said base. The limiter 981 can include a contoured profile such that only outer portions or inner portions or any combination thereof is designed to contact the inner surface of the base. Optionally the contoured portions can be angled so that a flat edge of the limiter 981 contacts the inner surface of the base.

Certain Terminology

Terms of orientation used herein, such as "upper," "lower," "front," "rear," "top," "bottom," and "end," are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Summary

Several illustrative embodiments of trucks have been disclosed. Although this disclosure has been described in terms of certain illustrative embodiments and uses, other embodiments and other uses, including embodiments and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various embodiments. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one embodiment or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example assemblies. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative embodiments have been described, any embodiments having equivalent elements, modifications, omissions, and/or combinations are also within the scope of this disclosure. Moreover, although certain aspects, advantages, and novel features are described herein, not necessarily all such advantages may be achieved in accordance with any particular embodiment. For example, some embodiments within the scope of this disclosure achieve one advantage, or a group of advantages, as taught herein without necessarily achieving other advantages taught or suggested herein. Further, some embodiments may achieve different advantages than those taught or suggested herein.

Some embodiments have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein.

For purposes of summarizing the disclosure, certain aspects, advantages and features of the inventions have been described herein. Not all, or any such advantages are necessarily achieved in accordance with any particular embodiment of the inventions disclosed herein. No aspects of this disclosure are essential or indispensable. In many embodiments, the devices and systems may be configured differently than illustrated in the figures or description herein. For example, various functionalities provided by the illustrated modules can be combined, rearranged, added, or deleted. In some embodiments, additional or different processors or modules may perform some or all of the functionalities described with reference to the example embodiment described and illustrated in the figures. Many implementation variations are possible. Any of the features, structures, steps, or processes disclosed in this specification can be included in any embodiment.

In summary, various embodiments and examples of trucks have been disclosed. This disclosure extends beyond the specifically disclosed embodiments and examples to other alternative embodiments and/or other uses of the embodiments, as well as to certain modifications and equivalents thereof. Moreover, this disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims.

What is claimed is:

1. A truck comprising:

a base for coupling with an underside of a deck, the base comprising:
- a mounting flange;
- a hanger aperture;
- first and second shaft apertures aligned along a pivot axis;
- first and second bushing apertures aligned along a compression axis; and
- a pivot angle defined between the mounting flange and the pivot axis;

a hanger for rotatably coupling with the base comprising:
- a center portion with first and second wings extending from the center portion;
- first and second bearing seats disposed on opposite ends of the center portion;
- first and second bearings disposed in the first and second bearing seats, respectively;
- first and second wheel axles extending from the first and second wing portions, respectively, for supporting first and second wheels, the first and second wheel axles aligned along a wheel axis;
- first and second bushing sockets on opposite sides of the center portion; and a roll aperture disposed through first and second bottom surfaces of the first and second bushing seats;

wherein the central portion of the hanger is disposed within the hanger aperture;

first and second shafts for pivotably coupling the hanger with the base, the first shaft disposed through the first shaft aperture of the base and into the hanger, the first shaft received within the first bearing, and the second shaft disposed through the second shaft aperture of the base and into the hanger, the second shaft received within the second bearing, the first and second shafts aligned along the pivot axis of the base and the hanger rotatable about the first and second shafts;

first and second bushings for providing roll stiffness to the rotation of the hanger, each of the first and second bushings comprising an inner aperture, the first bushing disposed in the first bushing socket of the hanger and the second bushing disposed in the second bushing socket of the hanger;

a first force transfer bushing slideably disposed within the first bushing aperture of the base and a second force transfer bushing slideably disposed within the second bushing aperture of the base;

a compression bolt for adjusting the roll stiffness of the hanger, the compression bolt aligned along the compression axis of the base and disposed through the first and second bushing apertures of the base, the first and second force transfer bushings, the inner apertures of the first and second bushings, the roll aperture of the hanger, and a nut, the compression bolt for applying a compression force to the hanger by rotation relative to the nut.

2. A truck comprising:

a base for coupling with a deck and comprising:

a hanger aperture; and first and second shaft apertures aligned along a pivot axis, the first shaft aperture disposed on a first side of the hanger aperture and the second shaft aperture disposed on a second side of the hanger aperture opposite the first side;

a hanger disposed within the hanger aperture of the base and pivotable about the pivot axis, the hanger comprising first and second seats;

a compression bolt disposed through the hanger along a compression axis, the compression axis transverse to the pivot axis;

wherein first and second ends of the hanger are fully constrained against translation perpendicular to the pivot axis and first and second ends of the compression bolt are slidingly engaged with the base; and wherein first and second shafts pivotably couple the hanger with the base, the first shaft disposed through the first shaft aperture of the base and into the first seat of the hanger, and the second shaft disposed through the second shaft aperture of the base and into the second seat of the hanger, the first and second shafts aligned with the pivot axis.

3. The truck of claim 2, wherein the base comprises first and second bushing apertures aligned along the compression axis.

4. The truck of claim 3, wherein the base includes a pivot angle of the pivot axis defined between a mounting flange of the base and the pivot axis.

5. The truck of claim 4, wherein the hanger comprises:

a center portion with first and second wings extending from the center portion; the first and second seats disposed on opposite ends of the center portion; first and second wheel axles extending from the first and second wing portions, respectively, for supporting first and second wheels, the first and second wheel axles aligned in a wheel axis;

first and second bushing sockets on opposite sides of the center portion; and a roll aperture disposed through first and second bottom surfaces of the first and second bushing sockets.

6. The truck of claim 5, further comprising first and second bushings for providing roll stiffness to the rotation of the hanger, each of the first and second bushings comprising an inner aperture, the first bushing disposed in the first bushing socket of the hanger and the second bushing disposed in the second bushing socket of the hanger.

7. The truck of claim 6, further comprising a first force transfer bushing slideably disposed within the first bushing aperture of the base and a second force transfer bushing slideably disposed within the second bushing aperture of the base.

8. The truck of claim 7, wherein the compression bolt for adjusting the roll stiffness of the hanger is aligned along the compression axis of the base and disposed through the first and second bushing apertures of the base, the first and second force transfer bushings, the inner apertures of the first and second bushings, the roll aperture of the hanger, and a nut, the compression bolt for applying a compression force to the hanger by rotation relative to the nut.

9. The truck of claim 8, further comprising first and second bearings, the first bearing disposed within the first seat and slideably engaged with the first shaft, the second bearing disposed within the second seat and slideably engaged with the second shaft.

10. The truck of claim 9, wherein the first bearing comprises a first flange and a first side of the first flange is flush with an end surface of the central portion of the hanger and a second side of the first flange flush with a surface disposed around the first shaft aperture of the base.

11. The truck of claim 8, wherein:

the compression bolt is made of steel and has an outside diameter of approximately 0.25 inches; and the first and second bushings are made of urethane and the inner apertures have a diameter of approximately 0.375 inches.

12. The truck of claim 8, wherein increasing the compression force on the hanger by rotation of the compression bolt relative to the nut deforms the first and second bushings to at least partially fill a space disposed between a surface of the inner aperture of the first bushing and an outer surface of the compression bolt.

13. The truck of claim 8, further comprising a roll bar, the roll bar disposed on the compression bolt between the first and second urethane bushings, a first sleeve of the roll bar extending at least partially into the inner aperture of the first bushing and a second sleeve of the roll bar extending at least partially into the inner aperture of the second bushing.

14. The truck of claim 8, wherein an outer profile of the first force transfer bushing is noncircular and corresponds to an inner profile of the first bushing aperture such that the first force transfer bushing translates within the first bushing aperture.

15. The truck of claim 8, wherein the base comprises an outer arc, the first bushing aperture disposed on the outer arc.

16. The truck of claim 8, wherein the pivot angle is between 0 and 60 degrees.

17. The truck of claim 8, wherein the nut is mechanically coupled with the first force transfer bushing.

18. The truck of claim 8, wherein the wheel axis is offset from the pivot axis in a rake direction.

19. The truck of claim 8, wherein the hanger comprises at least one limiter that limits rotation of the hanger with respect to the base.

20. The truck of claim 19, wherein the limiter is received within a recess on the center portion of the hanger and contacts an inner surface of the base to limit rotation of the hanger.

21. The truck of claim 8, wherein the first bottom surface of the first bushing socket comprises a tapered surface.

22. The truck of claim 8, wherein the first seat of the hanger is a floating seat assembly.

23. A truck for coupling with a deck comprising:

an internal structure pivotably coupled with an external structure by a pivot assembly, the internal structure extending within an aperture of the external structure;

a compression assembly coupled between the internal structure and the external structure, the compression assembly comprising an elongate member aligned along a compression axis and disposed through a roll aperture of the internal structure, and opposite ends of the elongate member coupled within the external structure;

the compression assembly comprising first and second elastic members disposed on opposite sides of the internal structure and within the aperture of the external structure to limit rotation of the internal structure relative to the external structure;

wherein the pivot assembly comprises a first shaft aperture and a second shaft aperture in the external structure that are aligned along a pivot axis, the first shaft aperture disposed on a first side of the aperture of the external structure and the second shaft aperture disposed on a second side of the aperture of the external structure, the second side being opposite the first side;

wherein the pivot assembly comprises a first seat and a second seat in the internal structure that are aligned along the pivot axis, the first seat disposed on a first side of the internal structure and the second seat disposed on a second side of the internal structure, the second side being opposite the first side; and wherein the pivot assembly comprises first and second shafts aligned along the pivot axis, the first shaft disposed within the first seat and the first shaft aperture, and the second shaft is disposed within the second seat and the second shaft aperture.

24. The truck of claim 23, wherein the internal structure is a hanger for coupling with a wheel assembly and the external structure is a base for coupling with the deck.

25. The truck of claim 23, wherein the internal structure is a base and the external structure is a hanger.

26. The truck of claim 25, wherein the hanger comprises a grinding surface extending lower than the base relative to the deck.

27. The truck of claim 23, wherein each of the opposite ends of the elongate member is slidingly engaged with the external structure through a force transfer bushing that is in contact with one of the first and second elastic members.

28. The truck of claim 23, wherein the first seat includes a first bearing, the first shaft disposed within the first bearing.

* * * * *